US011682548B2

(12) United States Patent
Suzuki et al.

(10) Patent No.: US 11,682,548 B2
(45) Date of Patent: Jun. 20, 2023

(54) LIGHT EMITTING SEALED BODY AND LIGHT SOURCE DEVICE

(71) Applicant: HAMAMATSU PHOTONICS K.K., Hamamatsu (JP)

(72) Inventors: Akio Suzuki, Hamamatsu (JP); Toru Fujita, Hamamatsu (JP); Shinichi Ohba, Hamamatsu (JP); Akinori Asai, Hamamatsu (JP); Tomoya Nakazawa, Hamamatsu (JP); Taiga Morimoto, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 17/956,130

(22) Filed: Sep. 29, 2022

(65) Prior Publication Data

US 2023/0108659 A1 Apr. 6, 2023

(30) Foreign Application Priority Data

Oct. 4, 2021 (JP) ..... JP2021-163289

(51) Int. Cl.
*H01J 61/35* (2006.01)
*H01J 65/04* (2006.01)
*H01J 61/30* (2006.01)

(52) U.S. Cl.
CPC ..... *H01J 61/35* (2013.01); *H01J 61/302* (2013.01); *H01J 65/04* (2013.01)

(58) Field of Classification Search
CPC ..... H01J 61/35; H01J 61/302; H01J 65/04; H05G 2/008
See application file for complete search history.

(56) References Cited

U.S. PATENT DOCUMENTS

| | | | | |
|---|---|---|---|---|
| 10,561,008 | B2 * | 2/2020 | Mori | H01J 61/30 |
| 11,367,989 | B1 | 6/2022 | Suzuki et al. | |
| 2022/0199372 | A1 | 6/2022 | Suzuki et al. | |
| 2022/0200225 | A1 * | 6/2022 | Suzuki | H01S 3/09702 |

FOREIGN PATENT DOCUMENTS

JP 2009-021201 A 1/2009

* cited by examiner

*Primary Examiner* — Donald L Raleigh
(74) *Attorney, Agent, or Firm* — Faegre Drinker Biddle & Reath LLP

(57) ABSTRACT

A light emitting sealed body includes: a housing containing light-emitting gas in an internal space, on which laser light for maintaining a plasma generated in the light-emitting gas is incident; and a charging pipe including a first end portion and a second end portion and connected to the internal space at the first end portion. The second end portion of the charging pipe is sealed by being crushed. The second end portion of the charging pipe is covered with a covering member consists of an inorganic material. The covering member is covered with a cap member consists of a metal material.

8 Claims, 46 Drawing Sheets

712 hours 147 hours 0 hour 262 hours 0 hour

LIGHT EMITTING SEALED BODY AND LIGHT SOURCE DEVICE

TECHNICAL FIELD

One aspect of the present disclosure relates to a light emitting sealed body and a light source device.

BACKGROUND

U.S. Pat. No. 10,561,008 discloses a laser excitation light source that includes a housing containing light-emitting gas and that maintains a plasma generated in the light-emitting gas by irradiating the plasma with laser light and outputs light from the plasma as output light.

In the laser excitation light source as described above, after the light-emitting gas is introduced into the housing through a charging pipe connected to the housing, an end portion of the charging pipe may be sealed by being crushed. On the other hand, in the laser excitation light source, the light-emitting gas is charged at high pressure for high efficiency and high output, and during driving, the temperature rises due to irradiation with laser light and radiant heat from the plasma. For these reasons, when the laser excitation light source is continuously driven for a long time, the sealed end portion of the charging pipe is opened, and the light-emitting gas may leak. In order to extend the life span of the laser excitation light source, suppressing such leakage of the light-emitting gas is required.

SUMMARY

One aspect of the present disclosure is intended to provide a light emitting sealed body and a light source device having an extended life span.

A light emitting sealed body according to one aspect of the present disclosure includes: a housing containing light-emitting gas in an internal space, on which laser light for maintaining a plasma generated in the light-emitting gas is incident; and a charging pipe including a first end portion and a second end portion and connected to the internal space at the first end portion. The second end portion of the charging pipe is sealed by being crushed. The second end portion of the charging pipe is covered with a covering member consists of an inorganic material. The covering member is covered with a cap member consists of a metal material.

In the light emitting sealed body, the second end portion of the charging pipe which is sealed by being crushed is covered with the covering member consists of an inorganic material. Accordingly, the second end portion can be prevented from being opened, and even if a leakage from the second end portion occurs, the reduction of the charging pressure of the light-emitting gas inside the housing can be suppressed. In addition, since the covering member consists of an inorganic material, the covering member can stably cover the second end portion even under a high temperature environment. In addition, in the light emitting sealed body, the covering member is covered with the cap member consists of a metal material. Accordingly, the second end portion and the covering member can be protected. Therefore, according to the light emitting sealed body, the leakage of the light-emitting gas caused by the opening of the second end portion of the charging pipe can be suppressed, and the life span of the light emitting sealed body can be extended.

A thermal expansion coefficient of the covering member may be larger than a thermal expansion coefficient of the charging pipe. In this case, when the temperature rises, the second end portion of the charging pipe can be effectively pressed by the covering member, and the second end portion can be further prevented from being opened.

A hardness of the cap member may be larger than a hardness of the charging pipe. In this case, when the temperature rises, the covering member can be easily deformed toward a second end portion side instead of toward a cap member side, and the second end portion can be further prevented from being opened.

The covering member may consist of a thermoplastic material or may consist of solder. In these cases, it is possible to suitably achieve the above-described functions and effects such as being able to prevent the second end portion from being opened, being able to suppress the reduction of the charging pressure of the light-emitting gas inside the housing even if a leakage from the second end portion occurs, and being able to stably cover the second end portion even under a high temperature environment.

The cap member may be made of brass. In this case, it is possible to suitably achieve the above-described functions and effects such as being able to protect the second end portion and the covering member and being able to further prevent the second end from being opened by pressing the second end portion with the covering member.

A charging pressure of the light-emitting gas in the housing may be 3 MPa or more. In this case, the intensity of the plasma generated in the light-emitting gas can be increased, whereas the second end portion of the charging pipe is likely to be opened; however, according to the light emitting sealed body, also in such a case, the second end portion can be prevented from being opened.

A light source device according to one aspect of the present disclosure includes: the light emitting sealed body; and a light introduction unit that causes the laser light to be incident on the housing. According to the light source device, the life span can be extended for the above-described reasons.

According to one aspect of the present disclosure, it is possible to provide the light emitting sealed body and the light source device having an extended life span.

BRIEF DESCRIPTION OF THE DRAWINGS

FIG. 19A shows a state immediately after operation start, and FIG. 19B shows a state after an elapse of 46 hours.

DETAILED DESCRIPTION

Hereinafter, embodiments of the present disclosure will be described in detail with reference to the drawings. In the following description, the same reference signs are used for the same or equivalent elements, and a description thereof will not be repeated.

First Embodiment

[Laser Excitation Light Source]

Figure 1:
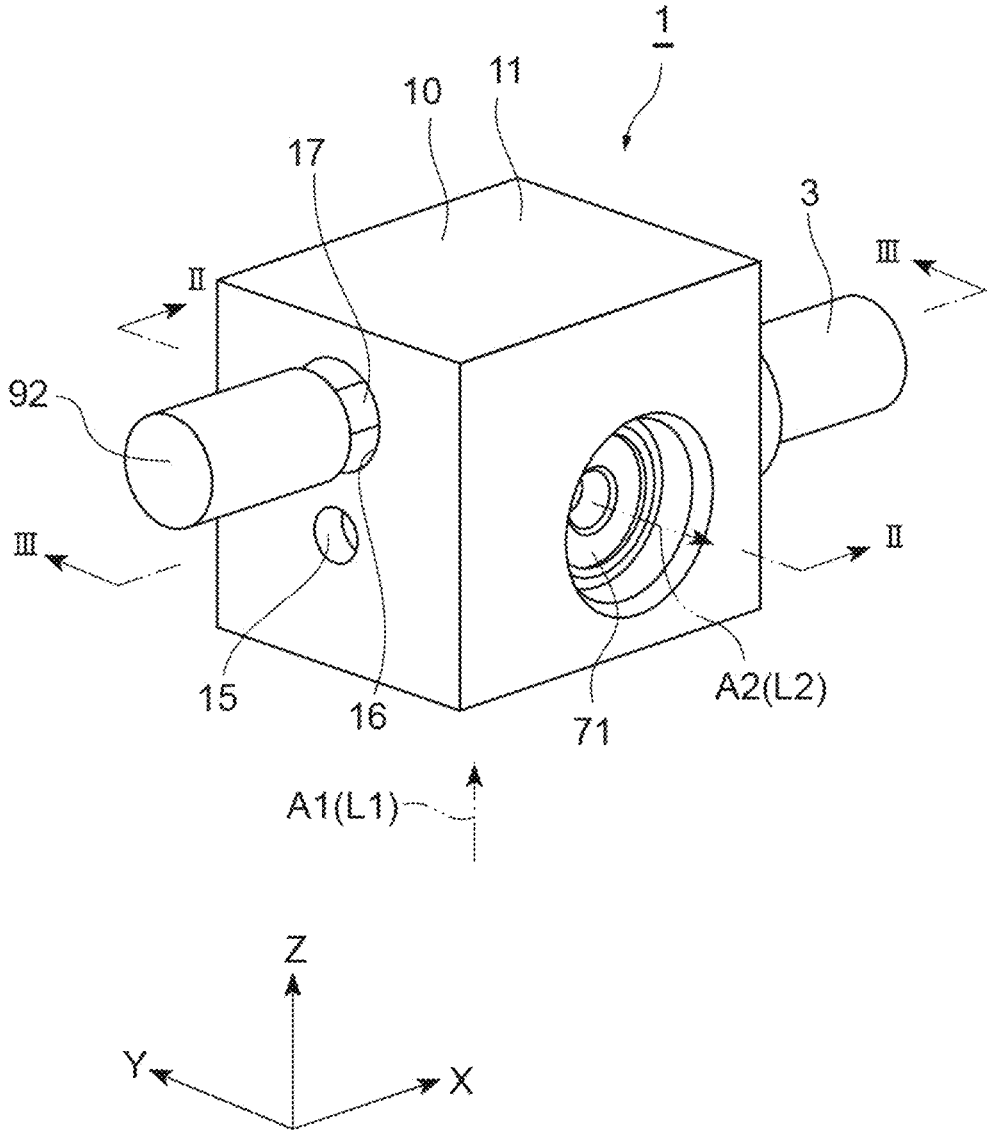
FIG. 1 is a perspective view of a light emitting sealed body according to a first embodiment.
Figure 2:
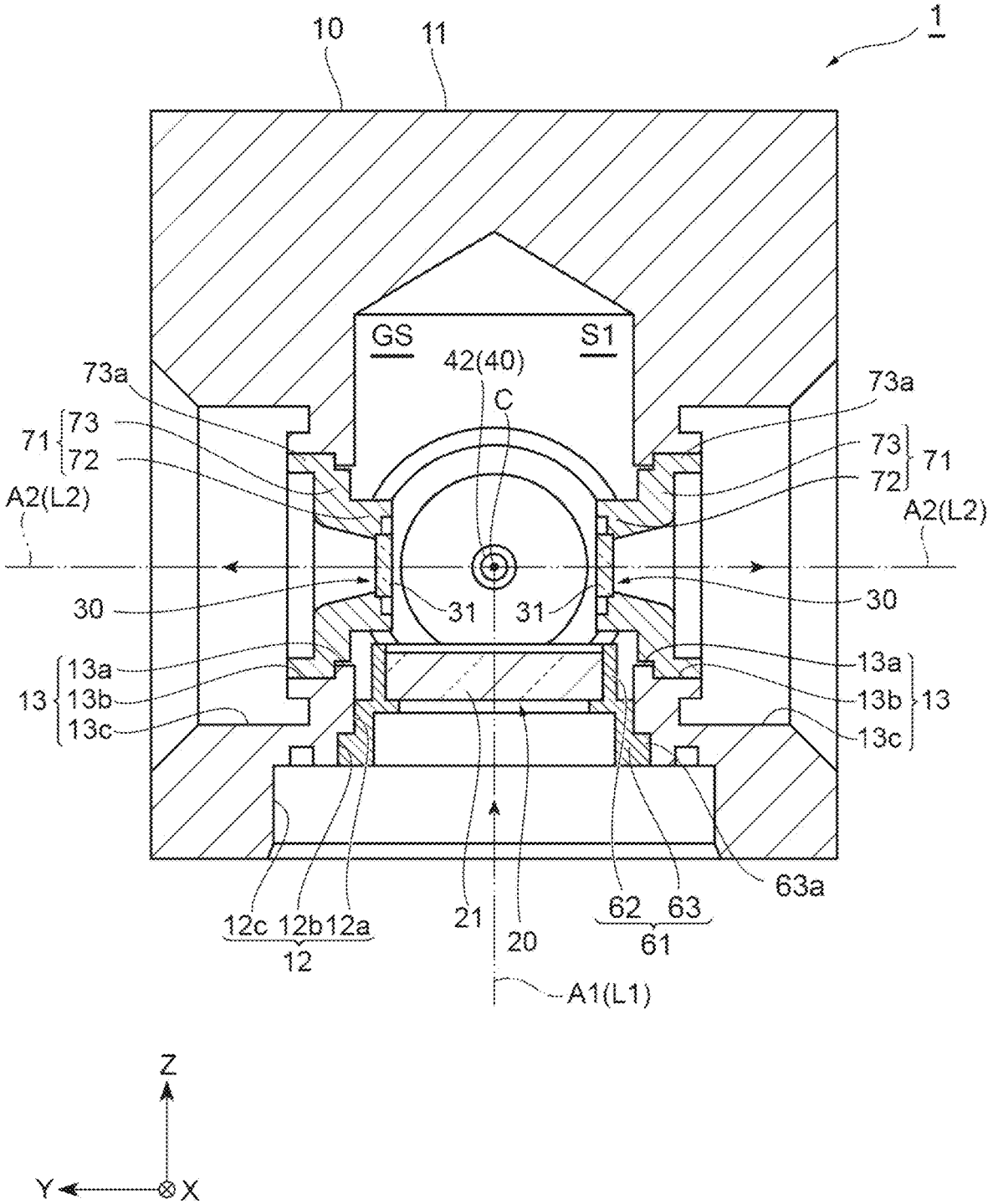
FIG. 2 is a cross-sectional view taken along line II-II of FIG. 1.
Figure 3:
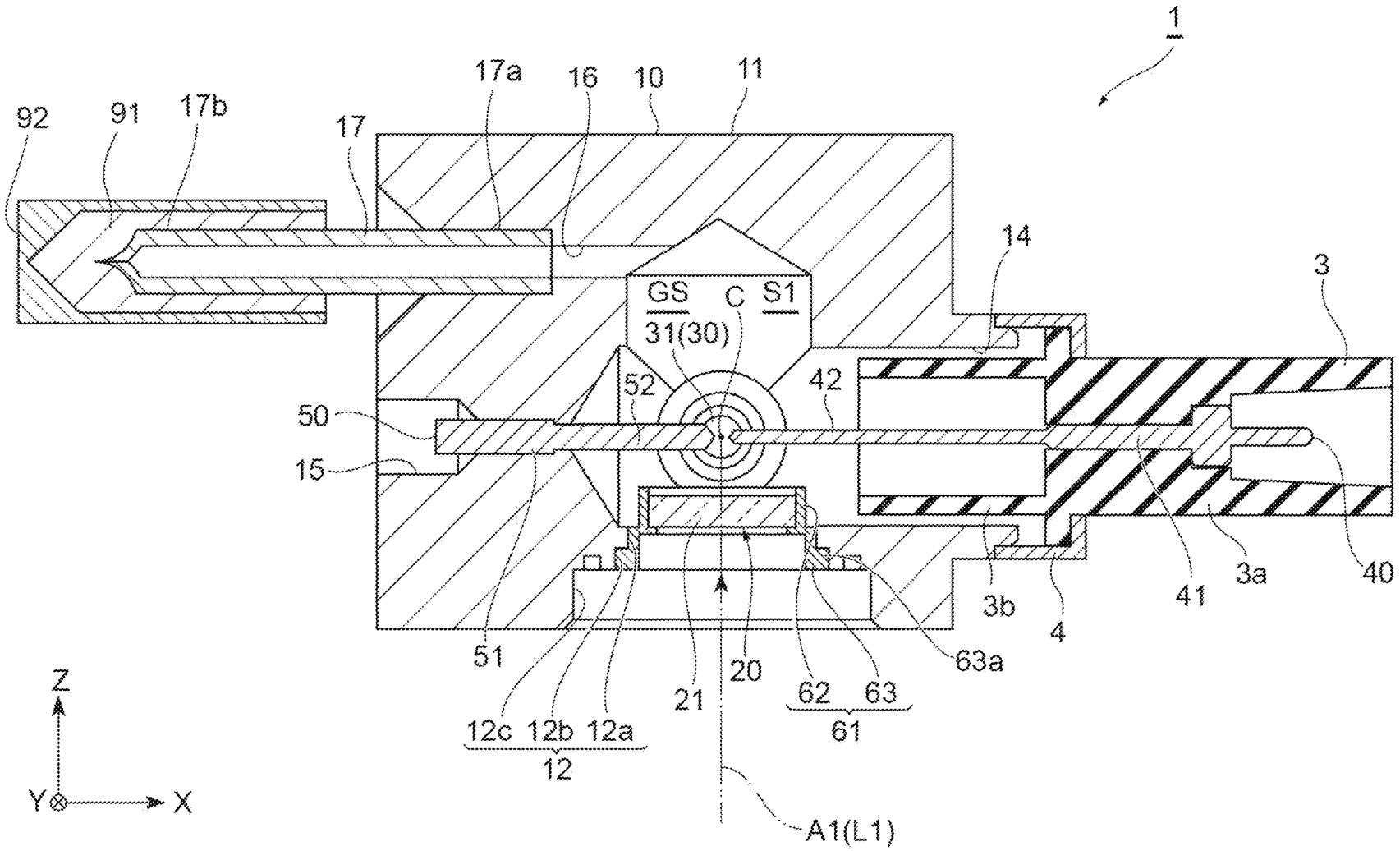
FIG. 3 is a cross-sectional view taken along line III-III of FIG. 1.

As shown in FIGS. 1 to 3, a light emitting sealed body 1 includes a housing 10. The housing 10 is charged with light-emitting gas GS. The light-emitting gas GS is, for example, xenon and is discharge gas in this example. For example, the light emitting sealed body 1 forms a laser excitation light source (light source device), together with a laser light source that outputs first light L1 that is laser light. In the laser excitation light source, a plasma is generated in the light-emitting gas GS. The first light L1 that is laser light for maintaining the plasma is incident on the light emitting sealed body 1, and second light L2 that is light from the plasma is emitted from the light emitting sealed body 1 as output light. The first light is, for example, light in a near-infrared region and has a wavelength of approximately 800 nm to 1100 nm. The second light L2 is, for example, light in an ultraviolet region to a mid-infrared region and has, for example, a wavelength of approximately 220 nm to 20 μm.

The laser excitation light source further includes, for example, a mirror, an optical system, and the like in addition to the light emitting sealed body 1 and the above-described laser light source, and these elements are configured to be contained in a case. The laser light source is, for example, a laser diode. The mirror reflects the first light L1 from the laser light source toward the optical system. The optical system includes one or a plurality of lenses. The optical system guides the first light L1 to the light emitting sealed body 1 while condensing the first light L1. The laser light source, the mirror, and the optical system form a light introduction unit that causes the first light L1 to be incident on the housing 10 from a first window portion 20 to be described later. Alternatively, the laser excitation light source itself may not include the laser light source. For example, the laser excitation light source may include an optical fiber that guides light from a laser light source disposed outside to the mirror, instead of its own laser light source. In this case, the optical fiber, the mirror, and the optical system form a light introduction unit that causes the first light L1 to be incident on the housing 10 from the first window portion 20.

[Light Emitting Sealed Body]

The light emitting sealed body 1 further includes the first window portion 20, two second window portions 30, a first electrode 40, a second electrode 50 in addition to the housing 10.

The housing 10 includes a housing body 11. The housing body 11 is formed from a metal material in a substantially box shape and contains the light-emitting gas GS. More specifically, an internal space S1 that is sealed is formed inside the housing body 11, and the internal space S1 is filled with the light-emitting gas GS. An example of the metal material forming the housing body 11 is stainless steel. In this case, the housing body 11 has a light-shielding property with respect to the first light L1 and to the second light L2. Namely, the housing body 11 is made of a light-shielding material that does not transmit the first light L1 and the second light L2.

A first opening 12 and two second openings 13 are formed in the housing body 11. The first light L1 is incident on the first opening 12 along a first optical axis A1. The first opening 12 is formed in, for example, a circular shape when viewed in a direction parallel to the first optical axis A1 (hereinafter, also referred to as a Z direction). In this example, the first optical axis A1 passes through a center of the first opening 12 when viewed in the Z direction. The first opening 12 includes an inner portion 12*a*, an intermediate portion 12*b*, and an outer portion 12*c*. The inner portion 12*a* is open to the internal space S1. The outer portion 12*c* is open to an outside of the housing body 11. The intermediate portion 12*b* is connected to the inner portion 12*a* and to the outer portion 12*c*. Each of the inner portion 12*a*, the intermediate portion 12*b*, and the outer portion 12*c* has, for example, a cylindrical shape. When viewed in an axial direction, an outer shape of the intermediate portion 12*b* is larger than an outer shape of the inner portion 12*a*, and an outer shape of the outer portion 12*c* is larger than the outer shape of the intermediate portion 12*b*. An "outer shape" of an element when viewed in an axial direction means a diameter when the element has a circular shape, and means a maximum length when the element has a non-circular shape.

The second light L2 is emitted from each of the second openings 13 along a second optical axis A2. Each of the second openings 13 is formed in, for example, a circular shape when viewed in a direction parallel to the second optical axis A2 (hereinafter, also referred to as a Y direction). In this example, the second optical axis A2 passes through a center of each of the second openings 13 when viewed in the Y direction. Each of the second openings 13 includes an inner portion 13*a*, an intermediate portion 13*b*, and an outer portion 13*c*. The inner portion 13*a* is open to the internal space S1. The outer portion 13*c* is open to the outside of the housing body 11. The intermediate portion 13*b* is connected to the inner portion 13*a* and to the outer portion 13*c*. Each of the inner portion 13*a*, the intermediate portion 13*b*, and the outer portion 13*c* has, for example, a cylindrical shape. When viewed in an axial direction, an outer shape of the intermediate portion 13*b* is larger than an outer shape of the inner portion 13*a*, and an outer shape of the outer portion 13*c* is larger than the outer shape of the intermediate portion 13*b*.

The first optical axis A1 intersects the second optical axis A2 in the internal space S1. Namely, the first opening 12 and the second openings 13 are disposed such that the first optical axis A1 and the second optical axis A2 intersect each other. An intersection point C of the first optical axis A1 and the second optical axis A2 is located in the internal space S1. In this example, the first optical axis A1 perpendicularly intersects the second optical axis A2, but the first optical axis A1 may intersect the second optical axis A2 at an angle other than the right angle. The first optical axis A1 is not parallel to the second optical axis A2. The first optical axis A1 does not pass through the second openings 13, and the second optical axis A2 does not pass through the first opening 12.

The first window portion 20 airtightly seals the first opening 12. The first window portion 20 includes a first window member 21. The first window member 21 is formed in, for example, a circular flat plate shape from a light transmissive material that transmits the first light L1. In this example, the first window member 21 is made of sapphire and transmits light having a wavelength of 5 μm or less. The first window member 21 transmits the first light L1 at the first opening 12.

The first window member 21 is fixed to a first frame member 61 and is fixed to the housing body 11 via the first frame member 61. Hereinafter, the first frame member 61 will be described as being regarded as a part of the housing 10. In this case, the housing 10 includes the first frame member 61 in addition to the housing body 11 described above. However, the first frame member 61 can also be regarded as a part of the first window portion 20. In this case, the housing 10 is formed of only the housing body 11.

The first frame member 61 is formed in, for example, a frame shape from a metal material such as Kovar metal. The first frame member 61 is formed in a substantially cylindrical shape as a whole. The first frame member 61 includes a first portion 62 having a cylindrical shape and a second portion 63 having a cylindrical shape that is integrally formed with the first portion 62. An outer shape of the second portion 63 is larger than an outer shape of the first portion 62. The first window member 21 is disposed inside the first portion 62 and is fixed to the first frame member 61. Details of a mode for fixing the first window member 21 to the first frame member 61 will be described later.

A flange portion 63*a* having a circular ring shape and protruding outward in a radial direction is formed on an outer surface of the second portion 63. The first frame member 61 is fixed to the housing body 11 in a state where the flange portion 63*a* is disposed inside the intermediate portion 12*b* of the first opening 12. In this state, a part of the first portion 62 of the first frame member 61 protrudes from the first opening 12. The first window member 21 is disposed to face the intersection point C of the first optical axis A1 and the second optical axis A2. The first frame member 61 is airtightly fixed to the housing body 11 at the flange portion 63*a*, for example, by laser welding.

Each of the second window portions 30 airtightly seals the second opening 13. Each of the second window portions 30 includes a second window member 31. The second window member 31 is formed in, for example, a circular flat plate shape from a light transmissive material that transmits the second light L2. In this example, the second window member 31 is made of diamond and transmits light having a wavelength of 20 μm or less. The second window member 31 transmits the second light L2 at the second opening 13.

The second window member 31 is fixed to a second frame member 71 and is fixed to the housing body 11 via the second frame member 71. Hereinafter, the second frame member 71 will be described as being regarded as a part of the housing 10. In this case, the housing 10 includes the second frame members 71 in addition to the housing body 11 and the first frame member 61 described above. However, the second frame member 71 can also be regarded as a part of the second window portion 30. In this case, the housing 10 is formed of only the housing body 11.

The second frame member 71 is formed in, for example, a frame shape from a metal material such as Kovar metal. The second frame member 71 is formed in a substantially cylindrical shape as a whole. The second frame member 71 includes a first portion 72 having a cylindrical shape and a second portion 73 having a cylindrical shape and integrally formed with the first portion 72. An outer shape of the second portion 73 is larger than an outer shape of the first portion 72. The second window member 31 is disposed inside the first portion 72 and is fixed to the second frame member 71. Details of a mode for fixing the second window member 31 to the second frame member 71 will be described later.

A flange portion 73*a* having a circular ring shape and protruding outward in the radial direction is formed on an outer surface of the second portion 73. The second frame member 71 is fixed to the housing 10 in a state where the flange portion 73*a* is disposed inside the intermediate portion 13*b* of the second opening 13. In this state, a part of the first portion 72 of the second frame member 71 protrudes from the second opening 13. The second window member 31 is disposed to face the intersection point C of the first optical axis A1 and the second optical axis A2. The second frame member 71 is airtightly fixed to the housing body 11 at the flange portion 73*a*, for example, by laser welding.

The first electrode 40 extends along an X direction perpendicular to both the Y direction and the Z direction. The first electrode 40 faces the second electrode 50 with the intersection point C of the first optical axis A1 and the second optical axis A2 interposed therebetween. In the X direction, a distance between the intersection point C and a tip of the first electrode 40 is equal to a distance between the intersection point C and a tip of the second electrode 50. The first electrode 40 is made of, for example, a metal material such as tungsten. The first electrode 40 is formed in a substantially rod shape as a whole. The first electrode 40 includes a first support portion 41 on a base end side and a first discharge portion 42 located on a tip side to be closer to the second electrode 50 than the first support portion 41. The first electrode 40 is fixed to the housing body 11 at the first support portion 41 via an insulating member 3 and is electrically separated from the housing 10. The first discharge portion 42 has a smaller diameter than that of the first support portion 41 and has a pointed shape. The first discharge portion 42 is disposed inside the housing 10 (in the internal space S1).

The insulating member 3 includes a body portion 3*a* and a tubular portion 3*b*. The insulating member 3 is made of, for example, an insulating material such as alumina (aluminum oxide) or ceramic. The body portion 3*a* is formed in, for example, a columnar shape and holds the first support portion 41 of the first electrode 40. The tubular portion 3*b* is formed in a cylindrical shape to extend from the body portion 3*a* along the X direction and surrounds a part on a first support portion 41 side (base end side) of the first discharge portion 42. A third opening 14 is formed in the housing body 11, and the tubular portion 3*b* is disposed inside the third opening 14. The insulating member 3 is airtightly fixed to the housing body 11 via a connection member 4 made of metal.

The second electrode 50 extends along the X direction. The second electrode 50 faces the first electrode 40 with the intersection point C of the first optical axis A1 and the second optical axis A2 interposed therebetween. The second electrode 50 is made of, for example, a metal material such as tungsten. The second electrode 50 is formed in a substantially rod shape having a larger diameter than that of the first electrode 40, as a whole. The second electrode 50 includes a second support portion 51 on a base end side and a second discharge portion 52 located on a tip side to be closer to the first electrode 40 than the second support portion 51. The second electrode 50 is fixed to the housing body 11 at the second support portion 51 and is electrically connected to the housing 10. More specifically, a fourth opening 15 is formed in the housing body 11, and the second support portion 51 is disposed inside the fourth opening 15. The second discharge portion 52 has a smaller diameter than that of the second support portion 51 and has a pointed shape. The second discharge portion 52 is disposed inside the housing 10 (in the internal space S1).

A charging hole 16 is formed in the housing body 11. The charging hole 16 is used to charge the internal space S1 with the light-emitting gas GS when the light emitting sealed body 1 is manufactured. In addition, the charging hole 16 also functions as an exhaust hole that discharges gas (impure gas such as residual air or gas released from forming materials) from the internal space S1 to the outside when the light emitting sealed body 1 is manufactured. A charging pipe 17 is connected to the charging hole 16. The charging pipe 17 is formed in, for example, a cylindrical shape from a metal material such as copper and includes a first end portion 17*a* and a second end portion 17*b*. The first end portion 17*a* is disposed inside the charging hole 16, and the charging pipe 17 is connected to the internal space S1 at the first end portion 17*a*. The second end portion 17*b* is sealed by being crushed. Details of the sealed portion will be described later.

In the light emitting sealed body 1, the internal space S1 is defined by the housing 10, the first window portion 20, and the second window portions 30. In the light emitting sealed body 1, the internal space S1 is also defined by the first electrode 40, the second electrode 50, the insulating member 3, the connection member 4, and the charging pipe 17. The entirety of the internal space S1 is filled with the light-emitting gas GS. Namely, the internal space S1 is charged with the light-emitting gas GS. A charging pressure (maximum charging pressure) of the light-emitting gas GS is, for example, 3 MPa (30 atm) or more, but may be 5 MPa (50 atm) or more. The light emitting sealed body 1 can withstand an internal pressure of 16 MPa or more.

[Operation Example]

In the laser excitation light source, a voltage application circuit disposed inside the case applies a negative voltage pulse to the first electrode 40 with the second electrode 50 set to a ground potential. Accordingly, electrons are released from the first electrode 40 toward the second electrode 50. As a result, an arc discharge is generated and a plasma is generated between the first electrode 40 and the second electrode 50 (at intersection point C). The plasma is irradiated with the first light L1 from the laser light source (light introduction unit) through the first window member 21. Accordingly, the generated plasma is maintained. The second light L2 that is light from the plasma is emitted to the outside through the second window member 31, as output light. In the laser excitation light source, the second light L2 is emitted from two second window members 31 toward both sides in the Y direction. Incidentally, a positive voltage pulse may be applied to the first electrode 40 as a trigger voltage for generating a plasma. In this case, electrons are released from the second electrode 50 toward the first electrode 40.

[Fixing Condition of Second Window Member]

Figure 4:
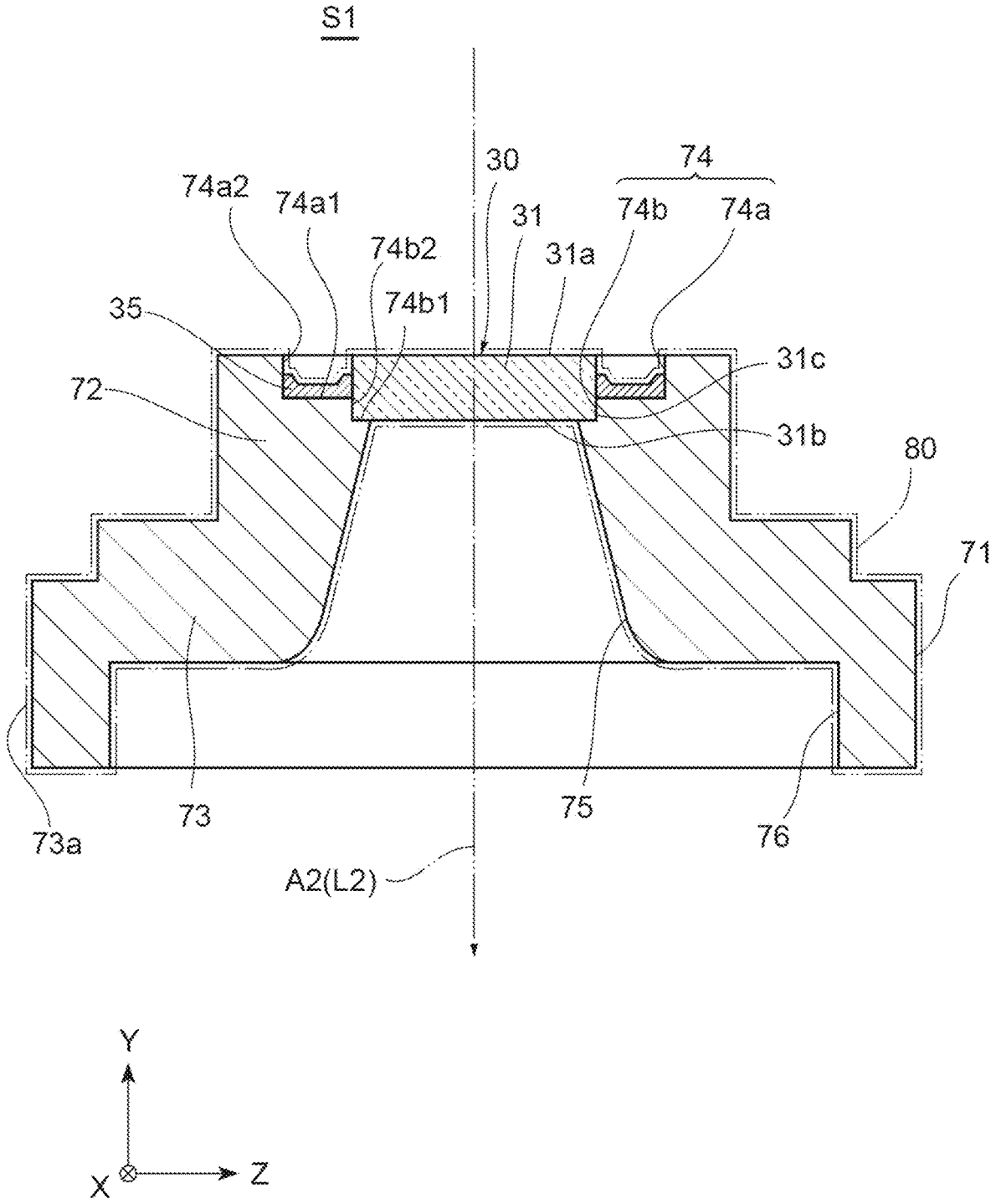
FIG. 4 is an enlarged view of a second window member and a second frame member.

As shown in FIG. 4, the second window member 31 of the second window portion 30 is formed in a circular flat plate shape and has a first major surface 31*a*, a second major surface 31*b*, and a side surface 31*c*. The first major surface 31*a* is a light incident surface on which the second light L2 is incident, and is a surface on an internal space S1 side (upper side in FIG. 4). The second major surface 31*b* is a surface opposite the first major surface 31*a* and is a light-emitting surface that emits the second light L2. In this example, the first major surface 31*a* and the second major surface 31*b* are flat surface perpendicular to the Y direction, and the side surface 31*c* is a cylindrical surface connected to the first major surface 31*a* and to the second major surface 31*b*.

The second window member 31 is disposed inside the first portion 72 of the second frame member 71. Specifically, a space inside the second frame member 71 includes a disposition portion 74 formed inside the first portion 72, an intermediate portion 75 formed from the inside of the first portion 72 to the inside of the second portion 73, and an outer portion 76 formed inside the second portion 73. The intermediate portion 75 has a truncated cone shape in which the outer shape increases toward the outside (side opposite the internal space S1) (lower side in FIG. 4) in the Y direction. The outer portion 76 is formed in a cylindrical shape having a larger outer shape than that of the intermediate portion 75.

The disposition portion 74 includes a large-diameter portion 74*a* having a cylindrical shape and a small-diameter portion 74*b* having a cylindrical shape that is disposed between the large-diameter portion 74*a* and the intermediate portion 75. An outer shape of the large-diameter portion 74*a* is larger than an outer shape of the small-diameter portion 74*b*. The second window member 31 is disposed over the large-diameter portion 74*a* and the small-diameter portion 74*b*. A part of the second major surface 31*b* of the second window member 31 is in contact with a bottom surface 74*b*1 of the small-diameter portion 74*b*, and a part of the side surface 31*c* of the second window member 31 is in contact with an inner surface 74*b*2 of the small-diameter portion 74*b*.

The second window member 31 is fixed to the second frame member 71 by a joining material 35. Specifically, the joining material 35 joins the side surface 31*c* of the second window member 31 and the first portion 72 of the second frame member 71 to each other over an entire circumference. In this example, the joining material 35 is disposed in the large-diameter portion 74*a* and is in contact with the side surface 31*c* and with a bottom surface 74*a*1 and an inner surface 74*a*2 of the large-diameter portion 74*a*. The joining material 35 is, for example, a metal brazing material and, more specifically, is titanium-doped silver brazing. The titanium-doped silver brazing is, for example, a brazing material composed of 70% silver, 28% copper, and 2% Ti, and is, for example, TB-608T of Tokyo Braze Co., Ltd.

A protective layer 80 is formed on the first major surface 31*a* of the second window member 31. In this example, the protective layer 80 is integrally formed to cover the entirety of surfaces of the second window member 31, the second frame member 71, and the joining material 35, the surfaces being exposed to the outside. In FIG. 4, a region where the protective layer 80 is formed is shown by an alternate long and two short dashed line. Namely, the protective layer 80 is formed to reach the second frame member 71 from the second window member 31, and covers the joining material 35. The protective layer 80 is formed to cover the entirety of the surface of the second frame member 71 except for a contact portion between the second window member 31 and the joining material 35.

Figure 5:
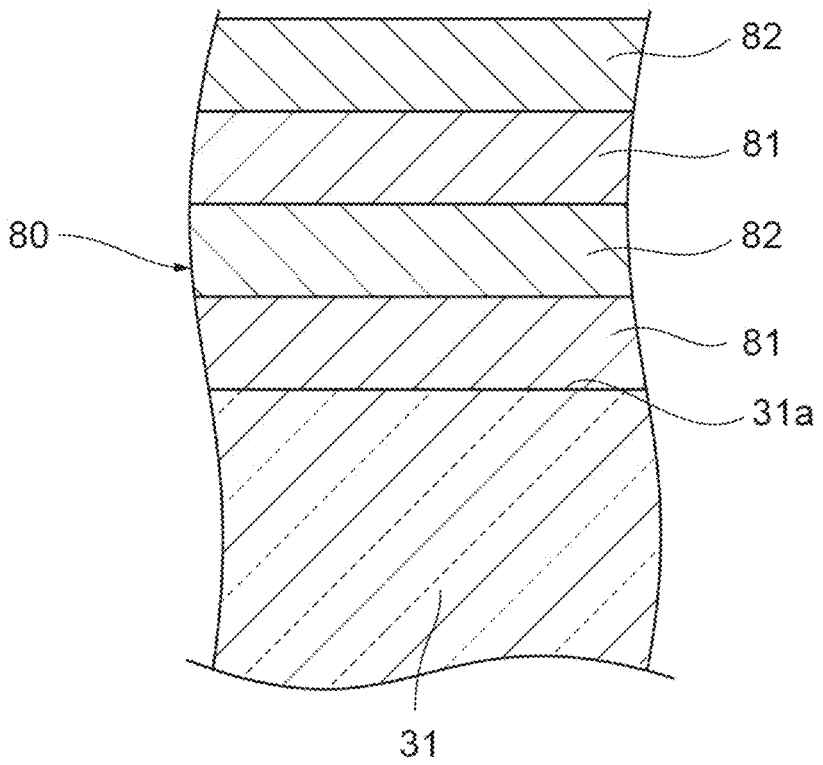
FIG. 5 is a cross-sectional view showing a configuration of a protective layer.

As shown in FIG. 5, the protective layer 80 includes a plurality (two in this example) of first layers 81 and a plurality (two in this example) of second layers 82. The plurality of first layers 81 and the plurality of second layers 82 are alternately stacked on the first major surface 31*a* of the second window member 31. In this example, one of the first layers 81 is in contact with the first major surface 31*a*, and one of the second layers 82 is exposed to the outside.

The protective layer 80 is made of an inorganic material and transmits at least some of the second light L2. As one example, each of the first layers 81 are an ALD layer (first ALD layer) made of $Al_2O_3$ (first material), and each of the second layers 82 is an ALD layers (second ALD layer) made of $TiO_2$ (second material). The ALD layer is a layer formed by atomic layer deposition (ALD). A transmittance of $Al_2O_3$ to ultraviolet light is higher than a transmittance of diamond to ultraviolet light. A transmittance of $TiO_2$ to ultraviolet light is lower than the transmittance of diamond to ultraviolet light. For this reason, in this example, the majority of ultraviolet light included in the second light L2 is absorbed by the second layers 82. The protective layer 80 has, for example, a thickness of approximately 0.1 μm.

The suppression of the occurrence of an opacity phenomenon by the protective layer 80 will be described with reference to FIGS. 6A to 10B. In a case where the window member is made of diamond, when the laser excitation light source is continuously driven, a phenomenon in which the window member becomes opaque (opacity phenomenon) can occur depending on driving conditions.

Figure 6A:
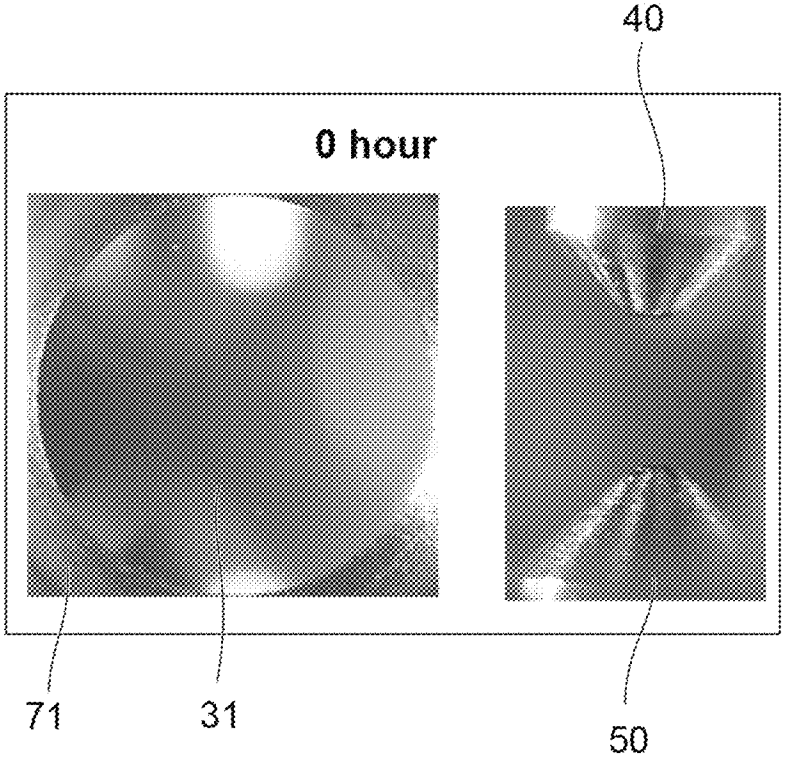
FIG. 6A is a photograph showing a first sample immediately after operation start.
Figure 6B:
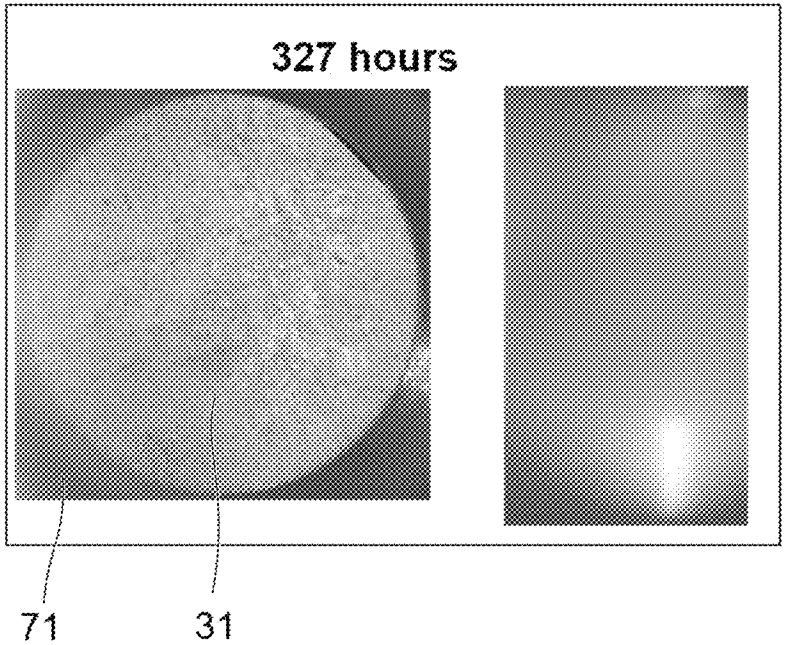
FIG. 6B is a photograph showing the first sample after an elapse of 327 hours.
Figure 7B:
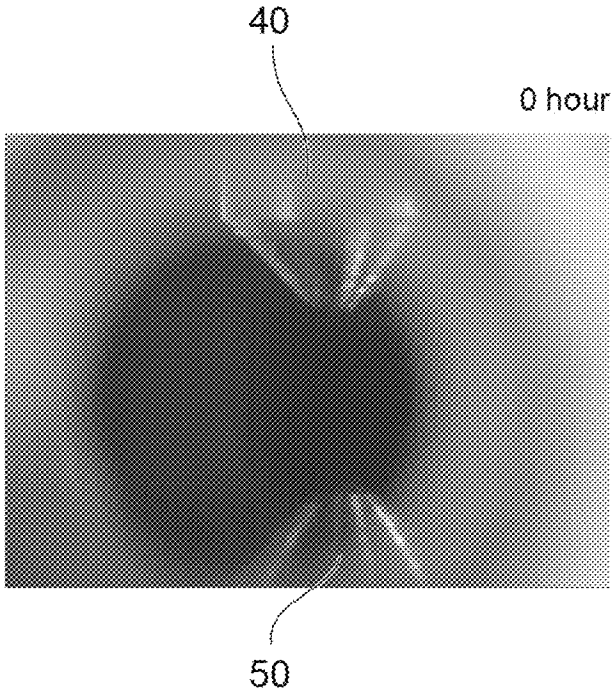
FIGS. 7A and 7B are photographs showing a second sample immediately after operation start.
Figure 7A:
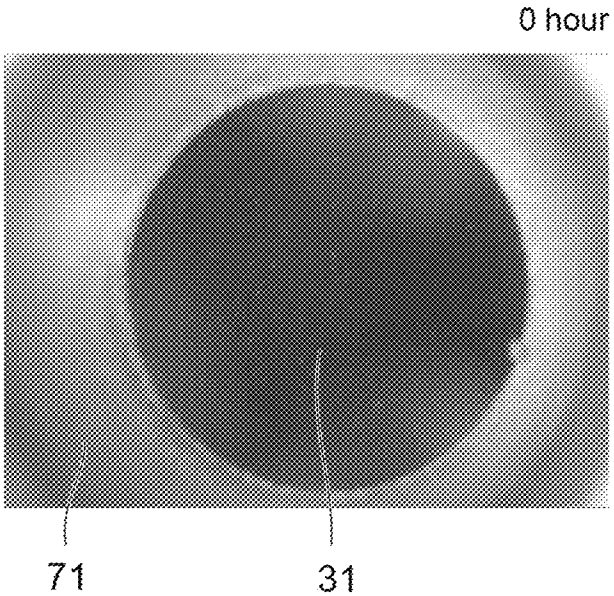
Figure 8B:
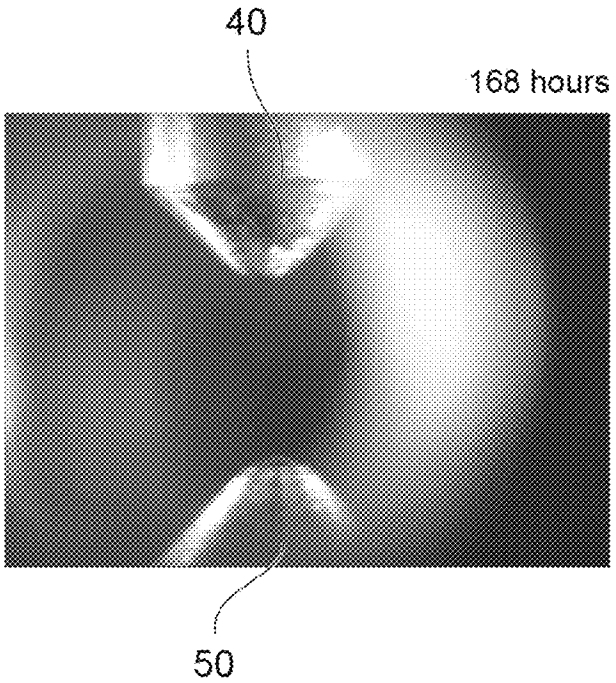
FIGS. 8A and 8B are photographs showing the second sample after an elapse of 168 hours.
Figure 8A:
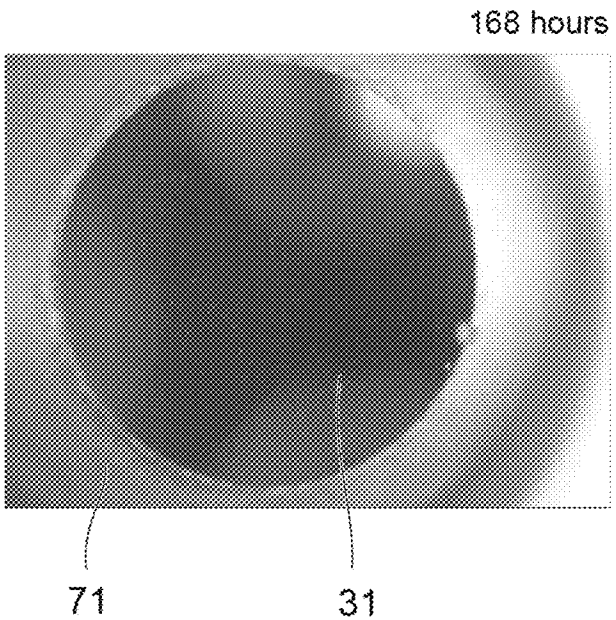
Figure 9B:
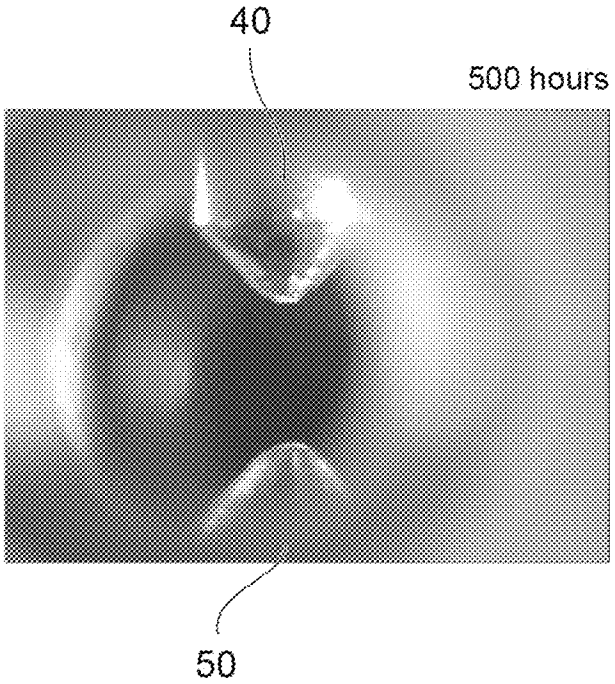
FIGS. 9A and 9B are photographs showing the second sample after an elapse of 500 hours.
Figure 9A:
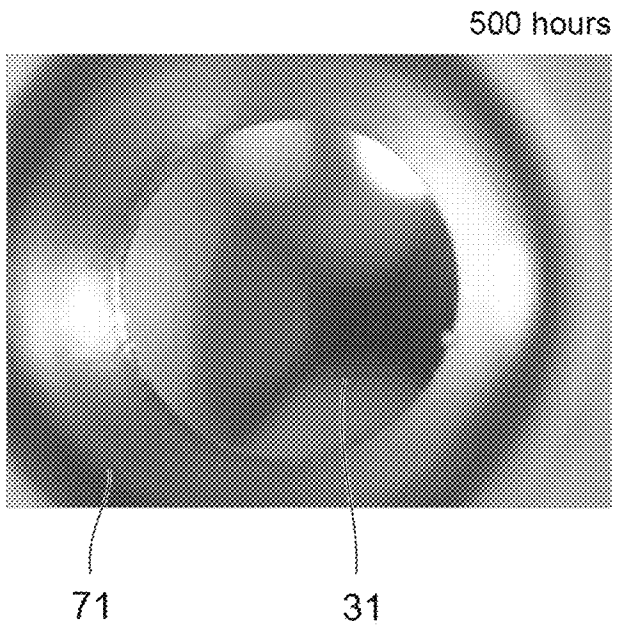
Figure 10B:
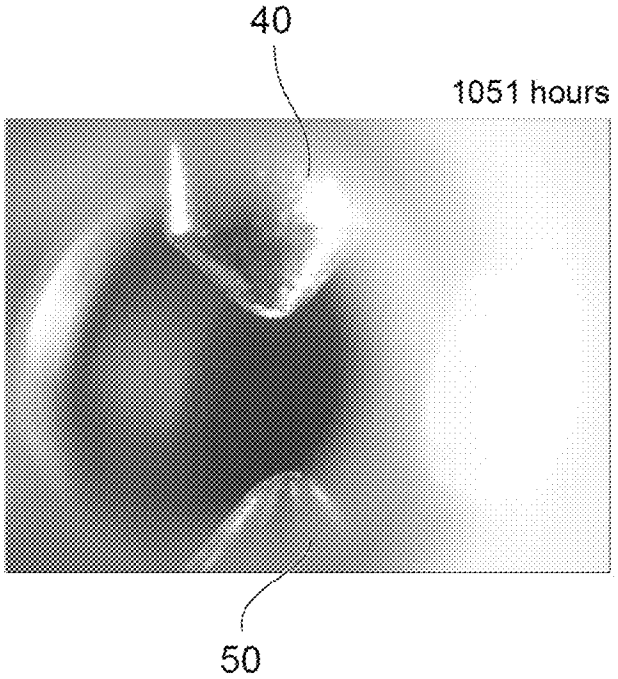
FIGS. 10A and 10B are photographs showing the second sample after an elapse of 1051 hours.
Figure 10A:
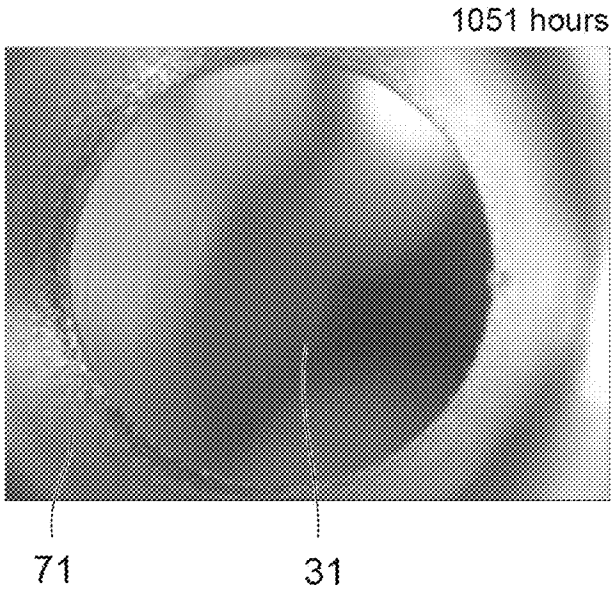

FIG. 6A is a photograph showing a first sample immediately after operation start, and FIG. 6B is a photograph showing the first sample after an elapse of 327 hours. The first sample corresponds to a configuration in which the protective layer 80 is not formed in the light emitting sealed body 1. The focal point is on the second window member 31 in photographs on left sides of FIGS. 6A and 6B, and the focal point is on the first electrode 40 and on the second electrode 50 in photographs on right sides of FIGS. 6A and 6B. In FIGS. 6A and 6B, images of the first electrode 40 and the second electrode 50 are captured through the second window member 31. This point is also the same for FIGS. 7B, 8B, 9B, and 10B, and photographs on right sides of FIGS. 11A, and 11B and for FIGS. 13B, 14B, 15B, and 16B which will be described later.

As shown in FIGS. 6A and 6B, the first electrode 40 and the second electrode 50 were visually recognized through the second window member 31 immediately after operation start, but after an elapse of 327 hours, the transmittance of the second window member 31 to visible light decreased, and the first electrode 40 and the second electrode 50 could not be visually recognized through the second window member 31. After an elapse of 327 hours, the color of the second window member 31 was changed to white, and the second window member 31 became opaque.

It is considered that such an opacity phenomenon can occur due to at least one of the following factors. First, it is considered that the second window member 31 is scraped into a crater shape by impure gas (gas other than the light-emitting gas GS, for example, oxygen and the like) existing in the internal space S1 inside the housing 10. It is considered that another factor is the influence of ultraviolet light included in the second light L2 that is light from the plasma. It is considered that further another factor is an increase in the temperature of the light emitting sealed body 1 during driving. During driving, the temperature of the light emitting sealed body 1 rises due to irradiation with laser light and radiant heat from the plasma.

Figure 11B:
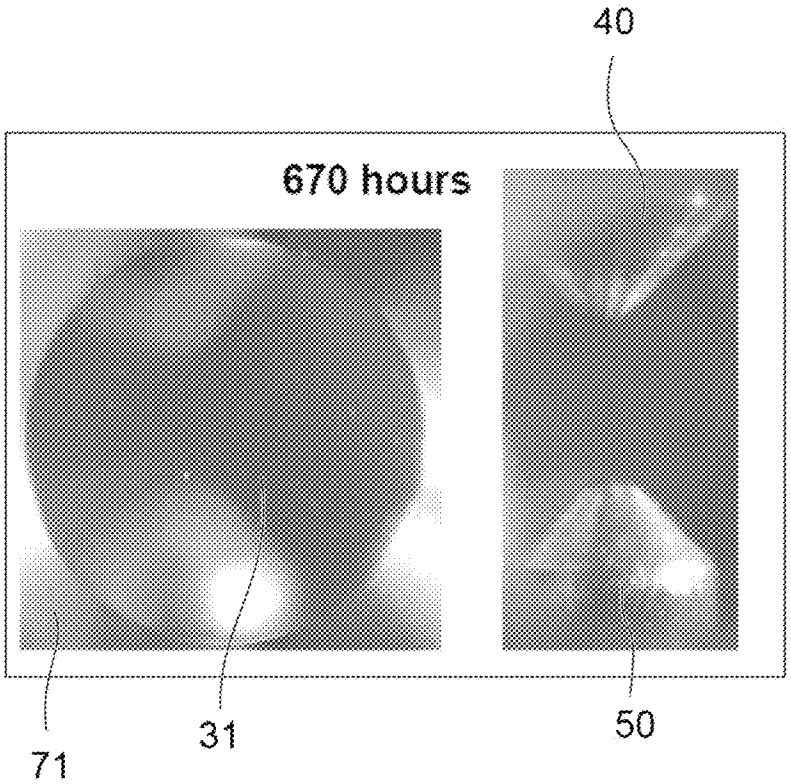
FIG. 11B is a photograph showing the second sample after an elapse of 670 hours.
Figure 11A:
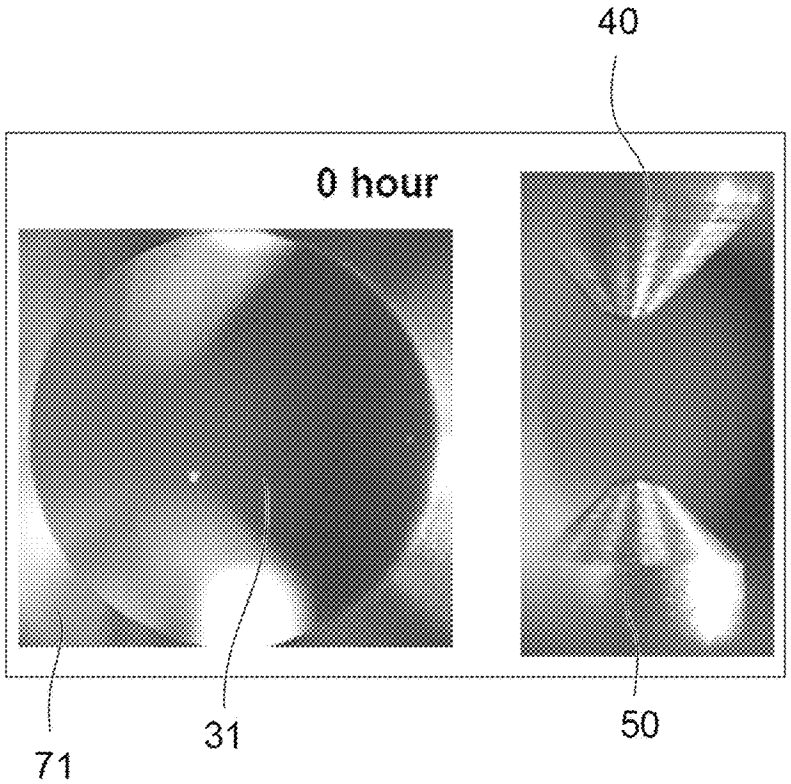
FIG. 11A is a photograph showing the second sample immediately after operation start.

FIGS. 7A to 10B are photographs showing a second sample immediately after operation start, after an elapse of 168 hours, after an elapse of 500 hours, and after an elapse of 1051 hours, respectively. The second sample corresponds to the light emitting sealed body 1. The focal point is on the second window member 31 in FIG. 7A, and the focal point is on the first electrode 40 and on the second electrode 50 in FIG. 7B. This point is also the same for FIGS. 8A to 10B. FIG. 11A is a photograph showing the second sample immediately after operation start, and FIG. 11B is a photograph showing the second sample after an elapse of 670 hours. The focal point is on the second window member 31 in photographs on left sides of FIGS. 11A and 11B, and the focal point is on the first electrode 40 and on the second electrode 50 in photographs on right sides of FIGS. 11A and 11B.

As shown in FIGS. 7A to 11B, in the second sample, the opacity phenomenon did not occur even after an elapse of 1051 hours from the start of driving. From these results, it can be seen that the occurrence of the opacity phenomenon can be suppressed by forming the protective layer 80.

As described above, in the light emitting sealed body 1, the second window member 31 of the second window portion 30 that emits the second light L2 is made of a material containing diamond. In this case, there is a possibility of the occurrence of a phenomenon in which the second window member 31 described above becomes opaque (opacity phenomenon). In this respect, in the light emitting sealed body 1, the protective layer 80 that is made of an inorganic material and transmits at least some of the second light L2 is formed on the first major surface 31*a* (surface on the internal space S1 side) of the second window member 31. Accordingly, for example, the contact of impure gas existing in the internal space S1 inside the housing 10 with the second window member 31 can be suppressed. As a result, the occurrence of the opacity phenomenon can be suppressed, and the life span of the light emitting sealed body 1 can be extended.

The protective layer 80 includes the plurality of layers. Accordingly, the occurrence of the opacity phenomenon can be more reliably suppressed.

The protective layer 80 contains a material ($TiO_2$) having a lower transmittance to ultraviolet light than diamond. Accordingly, the second window member 31 can be prevented from being affected by ultraviolet light and from becoming opaque, and the occurrence of the opacity phenomenon can be more reliably suppressed.

The protective layer 80 includes ALD layers. Accordingly, since the ALD layers are uniform and dense layers, the occurrence of the opacity phenomenon can be more reliably suppressed.

The protective layer 80 includes the first ALD layers made of the first material (first layers 81) and the second ALD layers made of the second material different from the first material (second layers 82). Accordingly, since the protective layer 80 includes the plurality of layers, the occurrence of the opacity phenomenon can be more reliably suppressed. In addition, the occurrence of the opacity phenomenon can be more reliably suppressed also due to the fact that the ALD layers are uniform and dense layers. In addition, holes can be formed in the ALD layer with a certain probability during the formation of the layer, but since the first ALD layers and the second ALD layers made of different materials are included, the positions of holes between the first ALD layers and the second ALD layers can be different from each other. As a result, the occurrence of a situation where impure gas existing in the internal space S1 inside the housing 10 comes into contact with the second window member 31 through the holes can be suppressed.

Figure 12B:
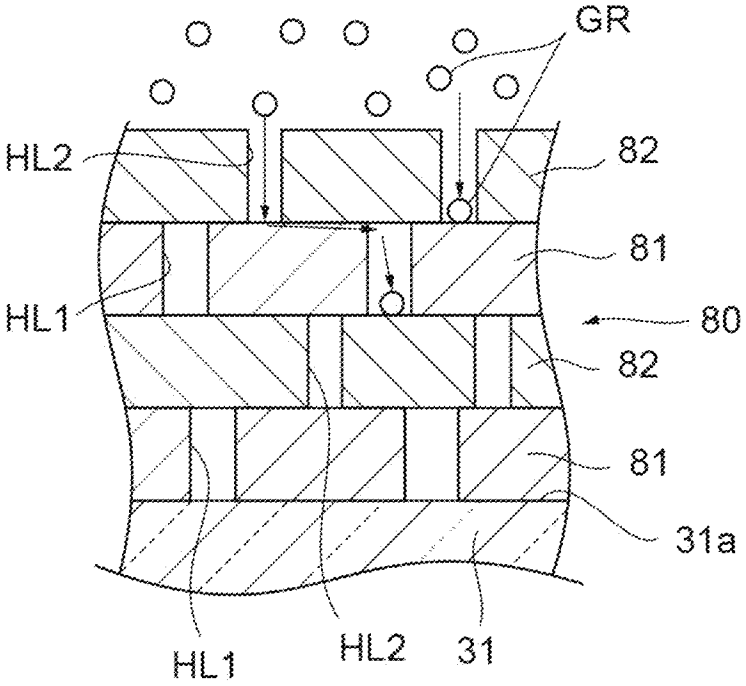
FIG. 12B is a cross-sectional view showing an example of a protective layer formed of first ALD layers and second ALD layers.
Figure 12A:
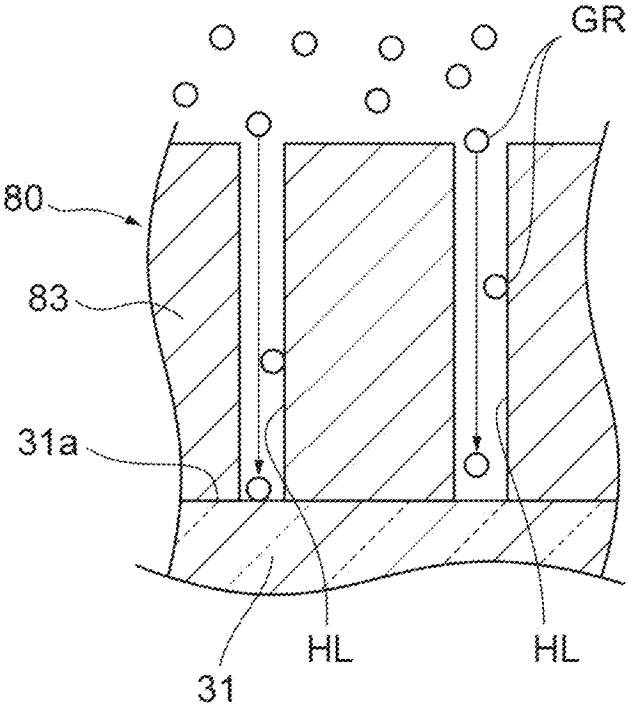
FIG. 12A is a cross-sectional view showing an example of a protective layer formed of one ALD layer.

This point will be further described with reference to FIGS. 12A and 12B. FIG. 12A is a cross-sectional view showing an example (first modification example) of the protective layer 80 formed of only one ALD layer 83. The ALD layer 83 is made of, for example, $Al_2O_3$. Also, in the first modification example, similarly to the first embodiment, the occurrence of the opacity phenomenon can be suppressed, and the life span of the light emitting sealed body 1 can be extended. In addition, since the transmittance of $Al_2O_3$ to ultraviolet light is higher than that of diamond, the second light L2 including ultraviolet light can be emitted from the second window portion 30. In addition, the layer made of $Al_2O_3$ can be stably formed on the second window member 31 made of diamond.

On the other hand, as shown in FIG. 12A, holes (pinholes) HL can be formed in the ALD layer 83 with a certain probability during the formation of the layer. In this case, impure gas GR existing in the internal space S1 inside the housing 10 comes into contact with the second window member 31 through the holes HL, which is a concern. In contrast, in the light emitting sealed body 1 of the first embodiment, the protective layer 80 includes two ALD layers (the first layer 81 and the second layer 82) made of different materials. Accordingly, as shown in FIG. 12B, the position of a hole HL1 formed in the first layer 81 and the position of a hole HL2 formed in the second layer 82 can be different from each other. As a result, the impure gas GR is unlikely to reach the second window member 31 through the holes HL1 and HL2, and the occurrence of a situation where the impure gas GR comes into contact with the second window member 31 can be suppressed.

The protective layer 80 includes, for example, the layer made of $TiO_2$ (second layer 82). Accordingly, since the transmittance of $TiO_2$ to ultraviolet light is lower than that of diamond, the second window member 31 can be prevented from being affected by ultraviolet light and from becoming opaque, and the occurrence of the opacity phenomenon can be more reliably suppressed.

The protective layer 80 includes the first layers 81 made of $Al_2O_3$ and the second layers 82 made of $TiO_2$. Accordingly, since the protective layer 80 includes the plurality of layers, the occurrence of the opacity phenomenon can be more reliably suppressed. In addition, the second window member 31 can be prevented from being affected by ultraviolet light and from becoming opaque, and the occurrence of the opacity phenomenon can be more reliably suppressed.

The housing 10 is made of a metal material. In this case, the charging pressure of the light-emitting gas GS can be increased, and the intensity of the second light L2 emitted from the second window portion 30 can be increased. In addition, in this case, impure gas is likely to exist in the internal space S1, and the opacity phenomenon is likely to occur. Namely, the housing 10 is charged with the light-emitting gas GS in a high vacuum state by vacuum baking, but when the temperature rises or the housing 10 is irradiated with light during driving, impure gas may be released from the housing 10. For example, impure gas adsorbed in irregularities existing on a surface of the housing 10 can be released during driving. When the housing 10 is formed by cutting, large irregularities are likely to be formed. In addition, impure gas adsorbed in the housing 10 can also be released. In this respect, according to the light emitting sealed body 1, even when impure gas is likely to exist in the internal space S1, the occurrence of the opacity phenomenon can be suppressed.

The protective layer 80 is formed to reach the second frame member 71 from the second window member 31. Accordingly, the release of impure gas from the second frame member 71 can be suppressed, and the occurrence of the opacity phenomenon can be more reliably suppressed.

The protective layer 80 covers the joining material 35 that joins the second window member 31 and the second frame member 71. Accordingly, the release of foreign matter from the joining material 35 can be suppressed.

The charging pressure of the light-emitting gas GS in the housing 10 is 3 MPa or more. In this case, the brightness of the plasma generated in the light-emitting gas GS can be increased, so that the intensity of the second light L2 emitted from the second window portion 30 can be increased. For example, when the charging pressure is 3 MPa, the intensity of the second light L2 is increased by approximately five times or more as compared to a case where the charging pressure is 1 MPa. When the charging pressure is 5 MPa, the intensity of the second light L2 is increased by approximately eight times as compared to the case where the charging pressure is 1 MPa. On the other hand, the opacity phenomenon is likely to occur due to an increase in the intensity of the second light L2. In addition, since the temperature of the light emitting sealed body 1 when driven rises due to an increase in light output, the opacity phenomenon is likely to occur. In addition, when the charging pressure is increased, the opacity phenomenon is likely to occur also due to the fact that impure gas is likely to exist in the internal space S1. In this respect, according to the light emitting sealed body 1, also in such a case, the occurrence of the opacity phenomenon can be suppressed.

As a second modification example, the second layer 82 in the first embodiment may be an ALD layer made of $SiO_2$ (second material) (second ALD layer). A transmittance of $SiO_2$ to ultraviolet light is higher than the transmittance of diamond to ultraviolet light and is lower than the transmittance of $Al_2O_3$ to ultraviolet light. Also, in the second modification example, similarly to the first embodiment, the occurrence of the opacity phenomenon can be suppressed, and the life span of the light emitting sealed body 1 can be extended.

Figure 13B:
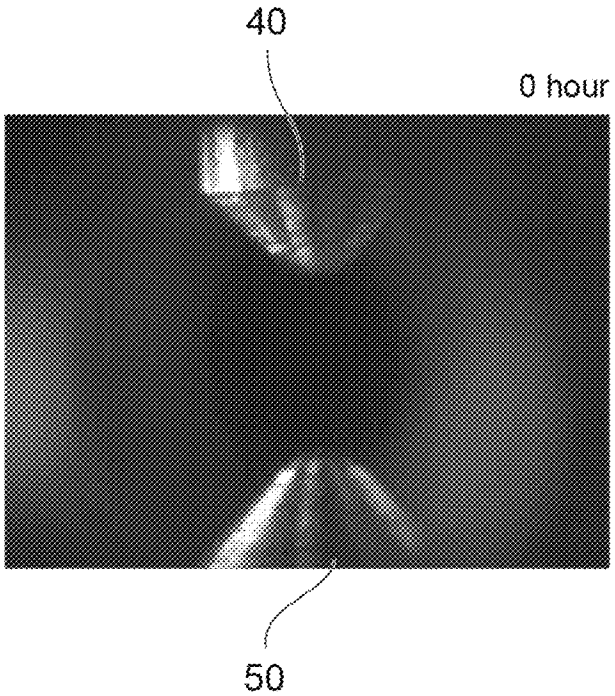
FIGS. 13A and 13B are photographs showing a third sample immediately after operation start.
Figure 13A:
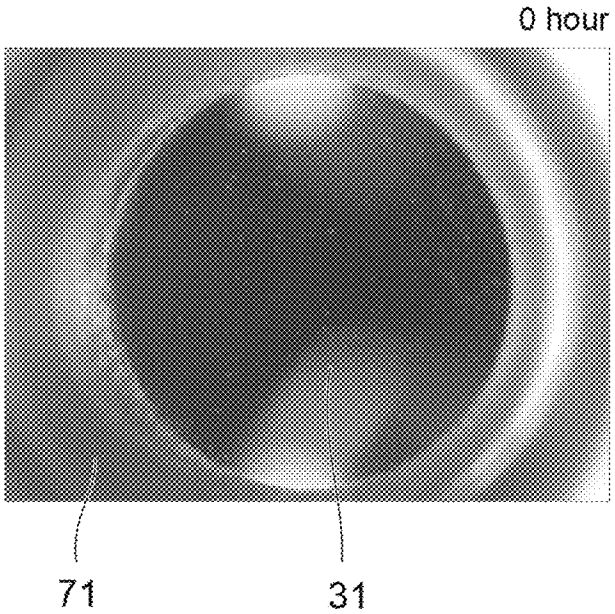
Figure 14B:
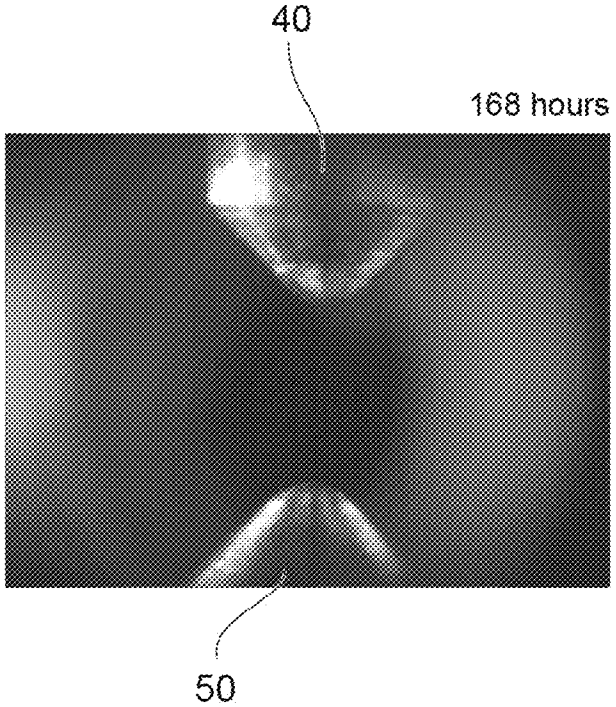
FIGS. 14A and 14B are photographs showing the third sample after an elapse of 168 hours.
Figure 14A:
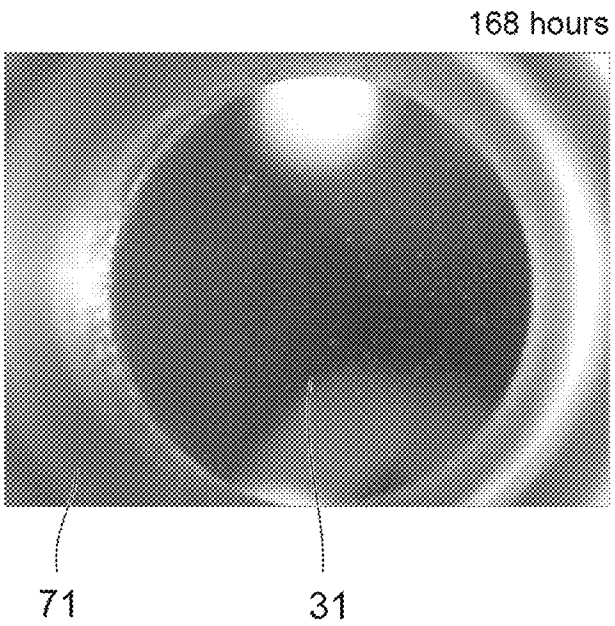
Figure 15B:
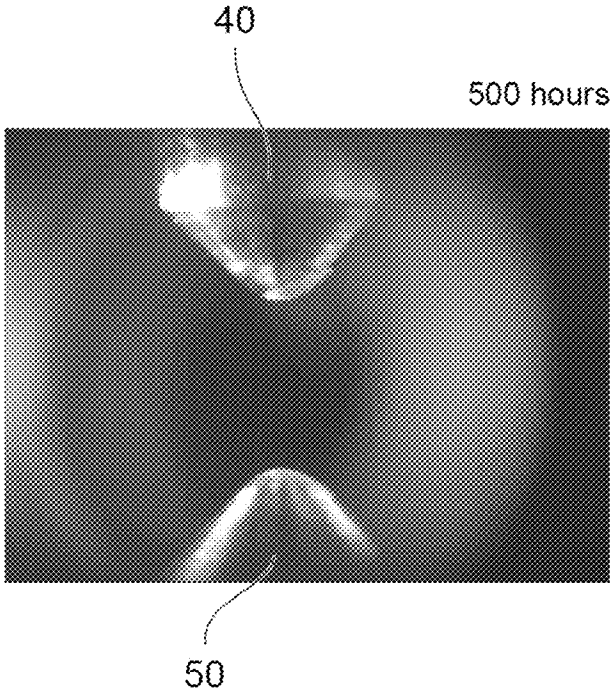
FIGS. 15A and 15B are photographs showing the third sample after an elapse of 500 hours.
Figure 15A:
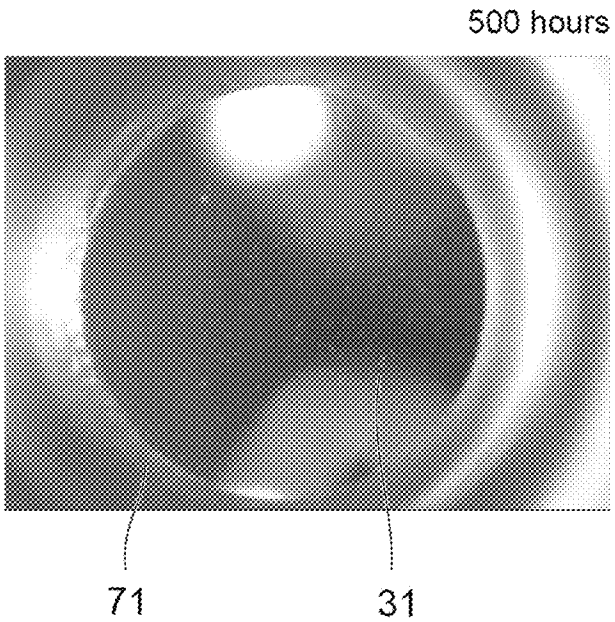
Figure 16B:
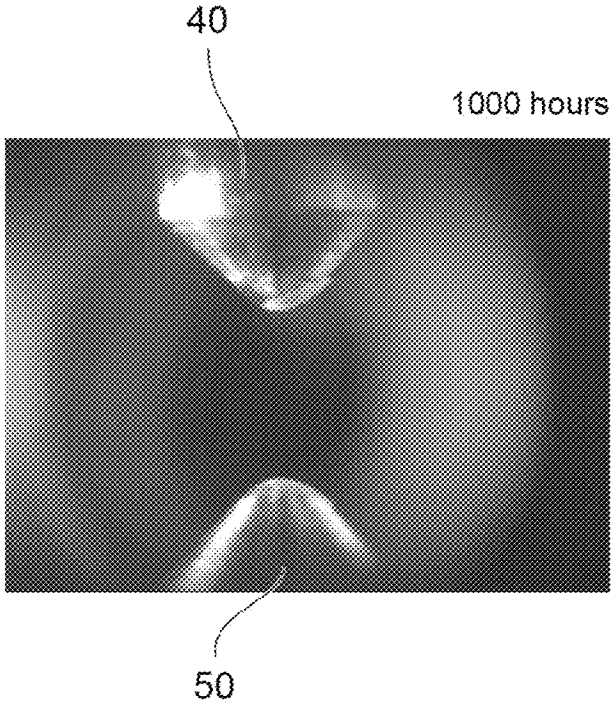
FIGS. 16A and 16B are photographs showing the third sample after an elapse of 1000 hours.
Figure 16A:
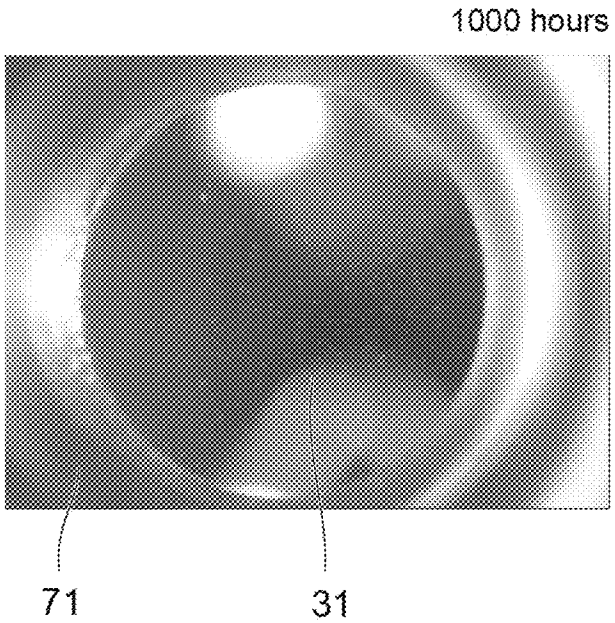

This point will be described with reference to FIGS. 13A and 16B. FIGS. 13A to 16B are photographs showing a third sample immediately after operation start, after an elapse of 168 hours, after an elapse of 500 hours, and after an elapse of 1000 hours, respectively. The third sample corresponds to the second modification example. The focal point is on the second window member 31 in FIG. 13A, and the first electrode 40 and the focal point is on the second electrode 50 in FIG. 13B. This point is also the same for FIGS. 14A to 16B. As shown in FIGS. 13A to 16B, in the third sample, the opacity phenomenon did not occur even after an elapse of 1000 hours from the start of driving.

In addition, in the second modification example, the protective layer 80 is made of only a material having a higher transmittance to ultraviolet light than diamond. Accordingly, the second light L2 including ultraviolet light can be emitted from the second window portion 30.

In the first embodiment, the protective layer 80 may cover at least a part of the first major surface 31*a* of the second window member 31 and, for example, may be formed only on the first major surface 31*a*. Alternatively, the protective layer 80 may be formed to cover only surfaces of the second window member 31, the second frame member 71, and the joining material 35, the surfaces being exposed to the internal space S1. The protective layer 80 may be able to transmit at least some of the second light L2, and may transmit some of the second light L2 as in the first embodiment or may transmit all the second light L2. In the first embodiment, the protective layer 80 is an ALD layer, but the protective layer 80 may be a layer formed by deposition. For example, the protective layer 80 may be a layer formed by sputtering, chemical vapor deposition (CVD), ion plating, vacuum deposition, resistive thermal deposition, or the like. When the protective layer 80 is formed by deposition, the protective layer 80 can be formed at any position (region). In the first embodiment, the second window member 31 of the second window portion 30 is made of a material containing diamond, and the protective layer 80 made of an inorganic material is formed on the first major surface 31*a* (surface on the internal space S1 side) of the second window member 31, but instead of or in addition to this configuration, the first window member 21 of the first window portion 20 may be made of a material containing diamond, and the protective layer 80 made of an inorganic material may be formed at least on a surface on the internal space S1 side (second major surface 21*b* to be described later) of the first window member 21. In this case, the occurrence of the opacity phenomenon on the first window member 21 can be suppressed, and the life span of the light emitting sealed body 1 can be further extended.

[Fixing Condition of First Window Member]

Figure 17:
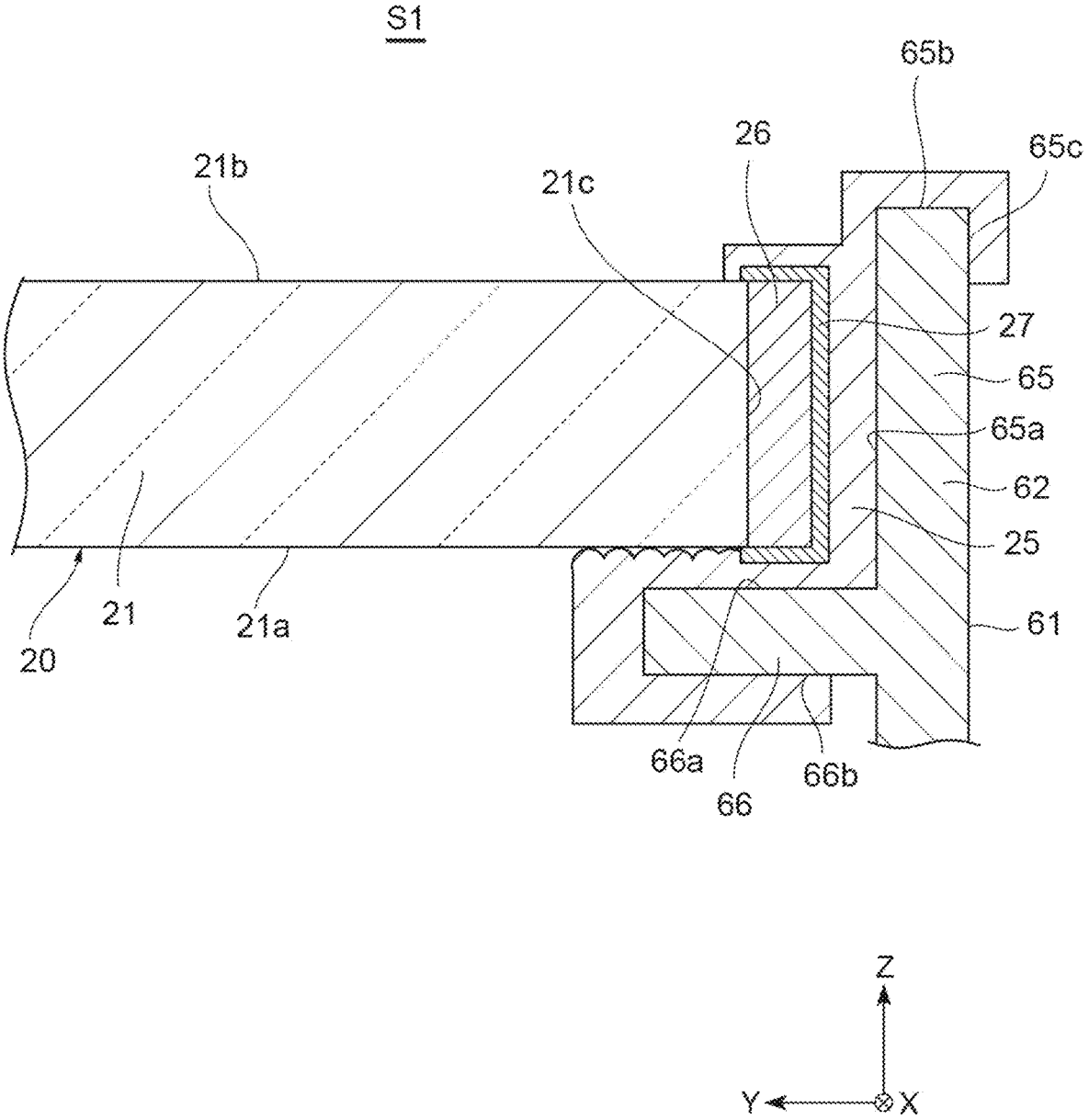
FIG. 17 is an enlarged view of the vicinity of a first window member.

As shown in FIG. 17, the first window member 21 of the first window portion 20 is formed in a circular flat plate shape and has a first major surface 21*a*, the second major surface 21*b*, and a side surface 21*c*. The first major surface 21*a* is a light incident surface on which the first light L1 is incident, and is a surface on a side opposite the internal space S1 (lower side in FIG. 17). The second major surface 21*b* is a surface opposite the first major surface 21*a* and is a light-emitting surface that emits the first light L1. In this example, the first major surface 21*a* and the second major surface 21*b* are flat surface perpendicular to the Z direction, and the side surface 21*c* is a cylindrical surface connected to the first major surface 21*a* and to the second major surface 21*b*.

The first window member 21 is disposed inside the first portion 62 of the first frame member 61. The first portion 62 includes a wall portion 65 having a cylindrical shape and facing the side surface 21*c* of the first window member 21. A flange portion 66 having a circular ring shape and protruding inward in the radial direction is formed on an inner surface 65*a* of the wall portion 65. The first window member 21 is disposed inside the first portion 62 of the first frame member 61 such that the first major surface 21*a* faces a first surface 66*a* of the flange portion 66 and the side surface 21*c* faces the inner surface 65*a* of the wall portion 65. An end surface 65*b* of the wall portion 65 in the Z direction (direction perpendicular to the first major surface 21*a*) is located on the internal space S1 side (upper side in FIG. 17) with respect to the first window member 21 (second major surface 21*b*).

A metallized layer 26 is formed over the entirety of the side surface 21*c* of the first window member 21. The metallized layer 26 is made of, for example, molybdenum-manganese (Mo—Mn) and has a thickness of approximately several hundreds of μm. A plating layer 27 is formed on the metallized layer 26. The plating layer 27 is made of, for example, nickel and has a thickness of approximately several μm. The plating layer 27 covers an entire surface of the metallized layer 26 except for a contact portion between the metallized layer 26 and the first window member 21 such that the metallized layer 26 is not exposed. The plating layer 27 functions as an antioxidant layer that prevents the oxidation of the metallized layer 26.

The first window member 21 is joined to the first frame member 61 by a joining material 25. Specifically, the joining material 25 is joined to the plating layer 27, so that the first window member 21 is joined to the first frame member 61. The joining material 25 joins the side surface 21*c* of the first window member 21 and the wall portion 65 of the first frame member 61 to each other over an entire circumference.

The joining material 25 is inserted between the first major surface 21*a* of the first window member 21 and the first surface 66*a* of the flange portion 66 of the first frame member 61. The joining material 25 is not familiar with the first major surface 21*a* and is locally in contact with the first major surface 21*a* but is not joined. Namely, the joining material 25 is inserted between the first major surface 21*a* and the flange portion 66 in a state where the joining material 25 is not bonded to the first major surface 21*a*. In this example, the joining material 25 is formed to wrap around the flange portion 66, and covers a part of a second surface 66*b* of the flange portion 66. The second surface 66*b* is a surface of the flange portion 66 on the side opposite to the first window member 21.

The joining material 25 covers the metallized layer 26 and the plating layer 27 on the side opposite the internal space S1 (lower side in FIG. 17) such that the metallized layer 26 and the plating layer 27 are not exposed. Namely, edge portions on an opposite side of the metallized layer 26 and the plating layer 27 from the internal space S1 are covered with the joining material 25 and are not exposed to the outside.

The joining material 25 also covers the metallized layer 26 and the plating layer 27 on the internal space S1 side (upper side in FIG. 17) such that the metallized layer 26 and the plating layer 27 are not exposed. Namely, edge portions of the metallized layer 26 and the plating layer 27 on the internal space S1 side are covered with the joining material 25 and are not exposed to an outside (internal space S1). In addition, the joining material 25 is provided to reach the end surface 65*b* of the wall portion 65 in the Z direction and covers the entirety of the end surface 65*b*. In this example, the joining material 25 climbs over the end surface 65*b* to reach an outer surface 65*c* of the wall portion 65, and covers a part of the outer surface 65*c*.

The joining material 25 is, for example, a metal brazing material and, more specifically, is gold-copper brazing. The joining material 25 has, for example, a thickness of approximately several hundreds of μm. The joining material 25 is formed, for example, by disposing a wire made of a metal brazing material at a boundary portion between the first window member 21 and the first frame member 61 and by melting the wire at approximately 1000° C. through baking.

The suppression of the generation of foreign matter on the window member will be described with reference to FIGS. 18A to 23B. For example, in a case where the window member is joined to the housing by a joining material consisting of silver brazing, when the laser excitation light source is continuously driven, foreign matter may be seen on the window member. Since the foreign matter on the window member is dirt on the window member and can interfere with the transmission of laser light or emitted light, suppressing the foreign matter is required.

Figure 18B:
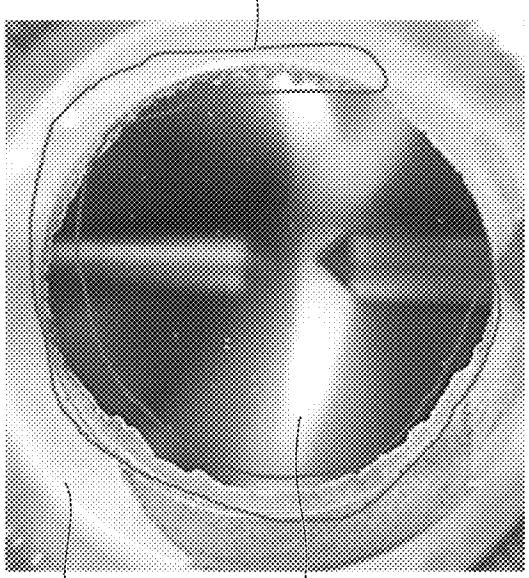
FIGS. 18A and 18B are photographs showing an example in which foreign matter is generated on the window member.
Figure 18A:
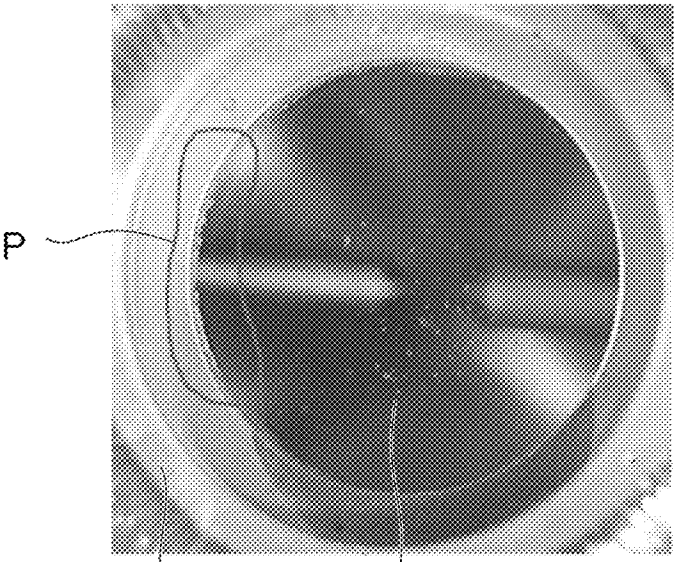
Figure 19B:
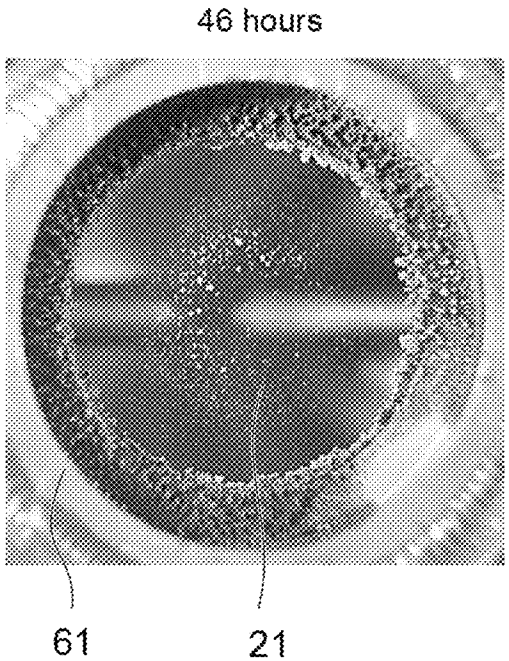
FIGS. 19A and 19B are photographs showing another example in which foreign matter is generated on the window member.
Figure 19A:
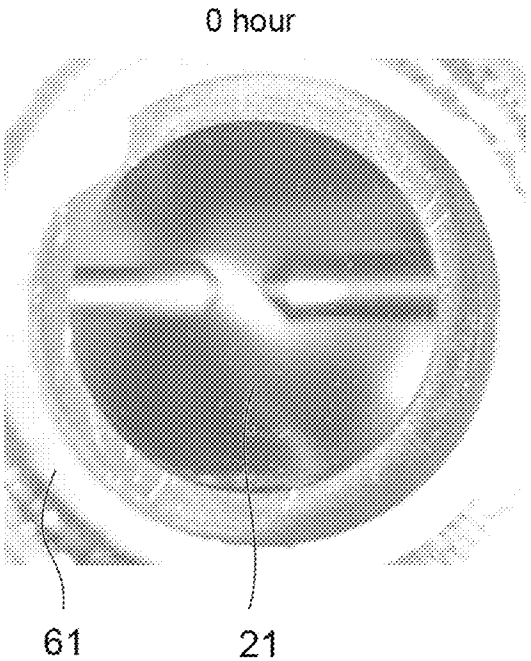

FIGS. 18A and 18B are photographs showing an example in which foreign matter is generated on the first window member 21. FIGS. 19A and 19B are photographs showing another example in which foreign matter is generated on the first window member 21, FIG. 19A shows a state immediately after operation start, and FIG. 19B shows a state after an elapse of 46 hours. Samples shown in FIGS. 18A to 19B correspond to a configuration in which silver brazing is used as the joining material 25 in the light emitting sealed body 1, instead of gold-copper brazing.

In FIGS. 18A and 18B, locations where foreign matter is generated are indicated by reference sign P. Foreign matter shown in FIGS. 18A and 18B is generated after a relatively long time has elapsed after the start of driving. It is considered that when the temperature rises due to driving, the silver brazing contained in the joining material moves to the surface of the first window member 21 to generate the foreign matter (bleed-out phenomenon). It is considered that since the movement of atoms on a joint surface of the silver brazing is intensified due to the light output and the atoms are pushed by internal pressure and gradually move on the surface of the first window member 21, the bleed-out phenomenon occurs.

As shown in FIGS. 19A and 19B, foreign matter was not generated on the first window member 21 immediately after operation start, and foreign matter was generated on the first window member 21 after an elapse of 46 hours. Foreign matter shown in FIG. 19B is generated in a relatively short time after the start of driving. It is considered that the foreign matter can be generated due to at least one of the following factors. First, it is considered that a factor is the influence of ultraviolet light included in the second light L2 that is light from the plasma. For example, oxygen in the atmosphere is ozonized by ultraviolet light, so that the silver brazing contained in the joining material can be oxidized in a short time. It is considered that another factor is an increase in the temperature of the light emitting sealed body 1 during driving. During driving, the temperature of the light emitting sealed body 1 rises due to irradiation with laser light and radiant heat from the plasma.

Figure 20C:
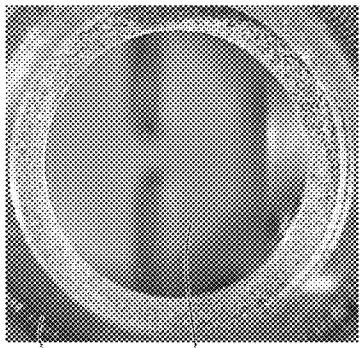
FIG. 20C is a photograph showing the fourth sample after an elapse of 712 hours.
Figure 20B:
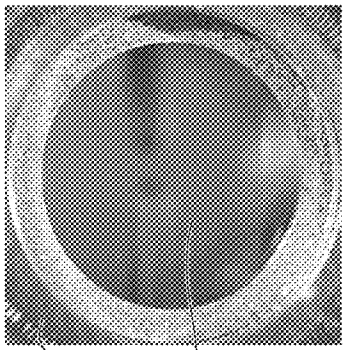
FIG. 20B is a photograph showing the fourth sample after an elapse of 147 hours.
Figure 20A:
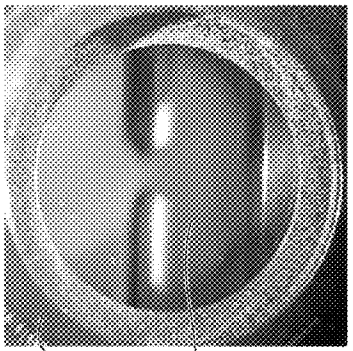
FIG. 20A is a photograph showing a fourth sample immediately after operation start.
Figure 21A:
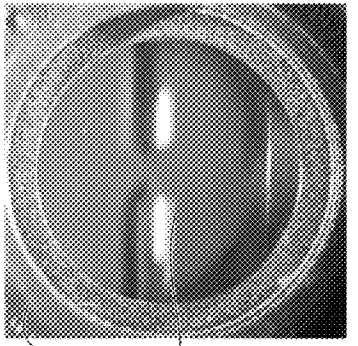
FIG. 21A is a photograph showing a fifth sample immediately after operation start.
Figure 21B:
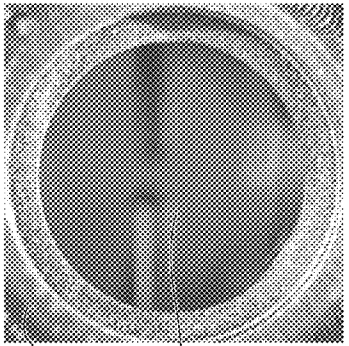
FIG. 21B is a photograph showing the fifth sample after an elapse of 147 hours.
Figure 21C:
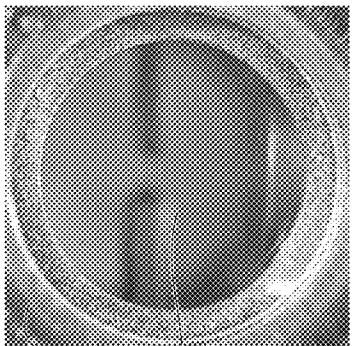
FIG. 21C is a photograph showing the fifth sample after an elapse of 712 hours.
Figure 22A:
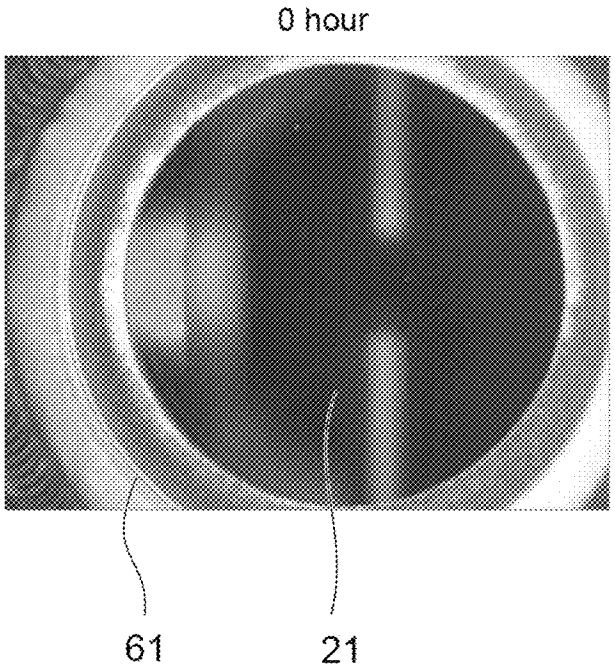
FIG. 22A is a photograph showing a sixth sample immediately after operation start.
Figure 22B:
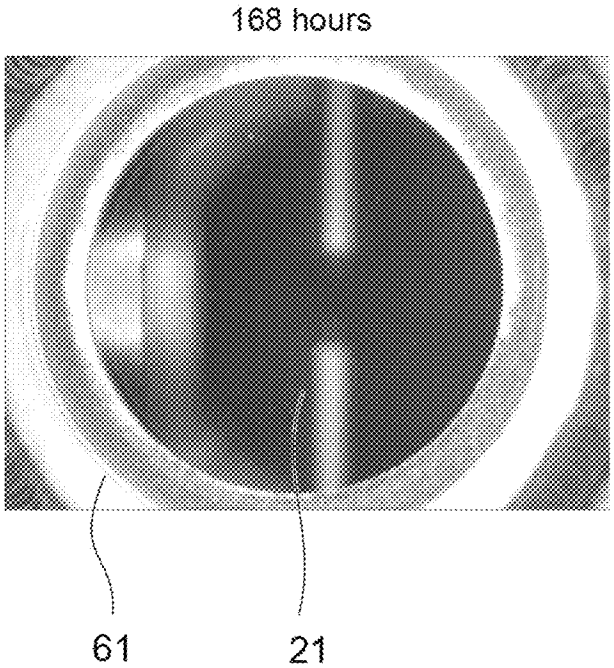
FIG. 22B is a photograph showing the sixth sample after an elapse of 168 hours.
Figure 23A:
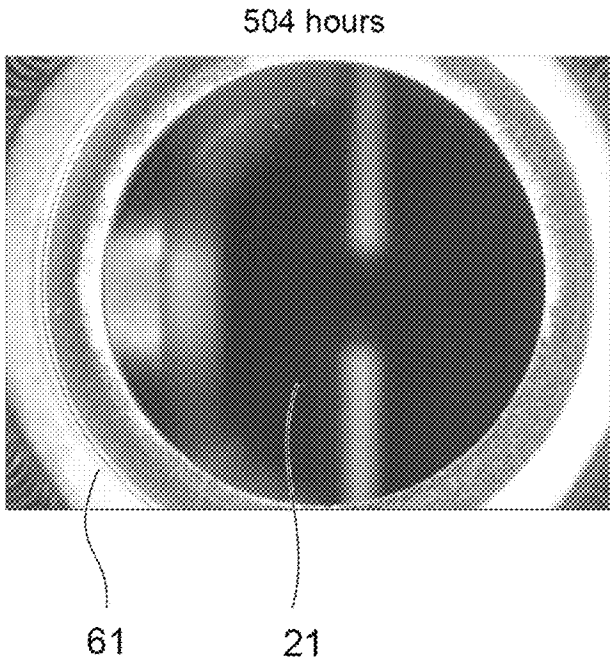
FIG. 23A is a photograph showing the sixth sample after an elapse of 504 hours.
Figure 23B:
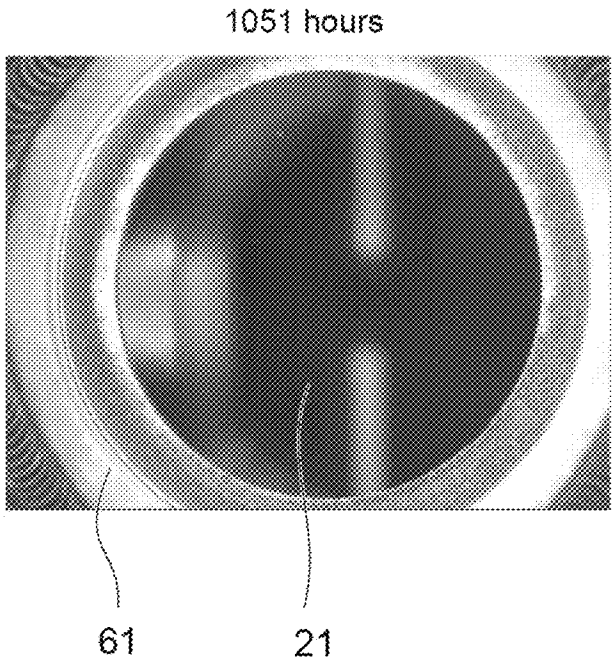
FIG. 23B is a photograph showing the sixth sample after an elapse of 1051 hours.
Figure 24A:
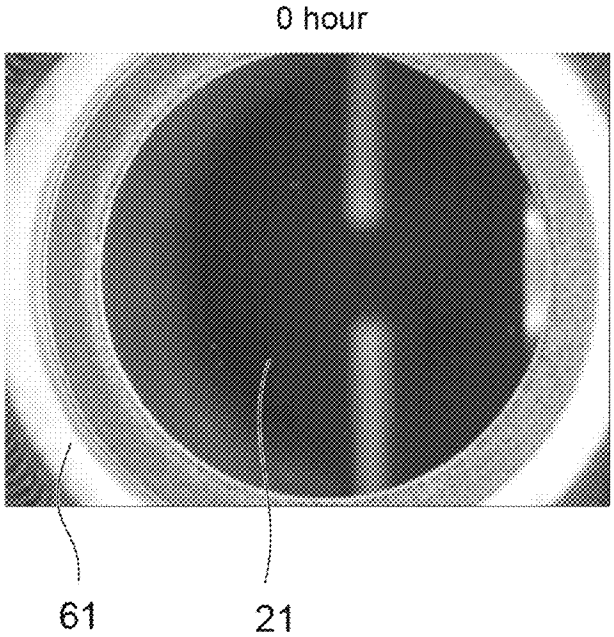
FIG. 24A is a photograph showing a seventh sample immediately after operation start.
Figure 24B:
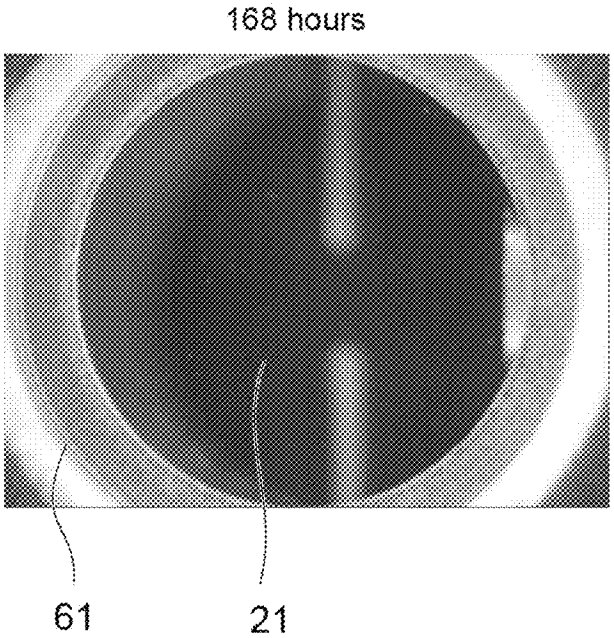
FIG. 24B is a photograph showing the seventh sample after an elapse of 168 hours.
Figure 25B:
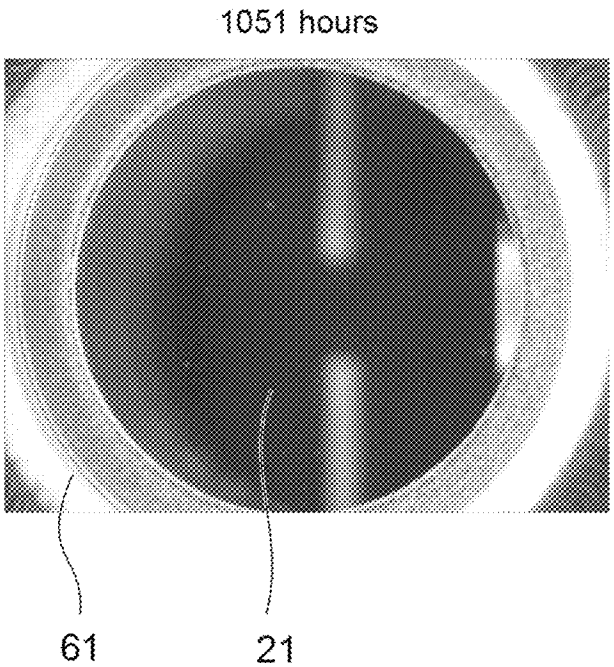
FIG. 25B is a photograph showing the seventh sample after an elapse of 1051 hours.
Figure 25A:
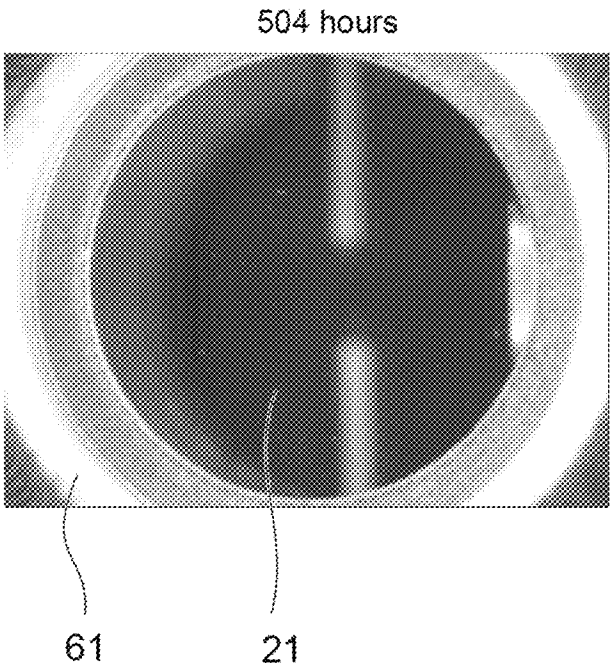
FIG. 25A is a photograph showing the seventh sample after an elapse of 504 hours.
Figure 26B:
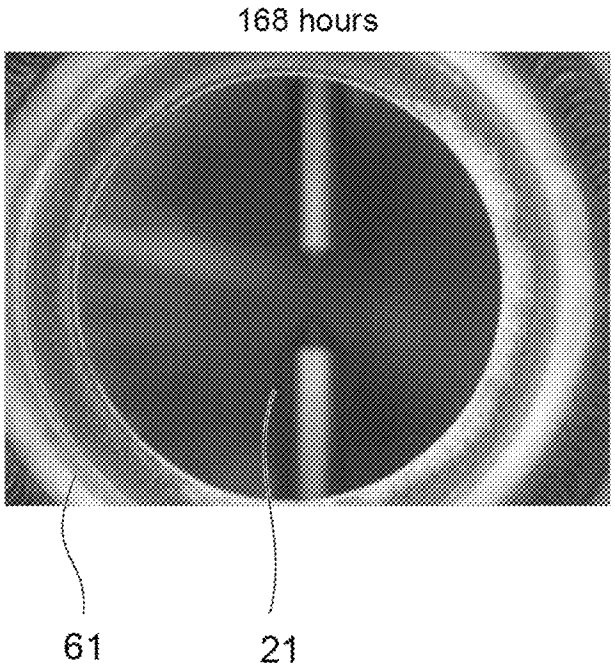
FIG. 26B is a photograph showing the eighth sample after an elapse of 168 hours.
Figure 26A:
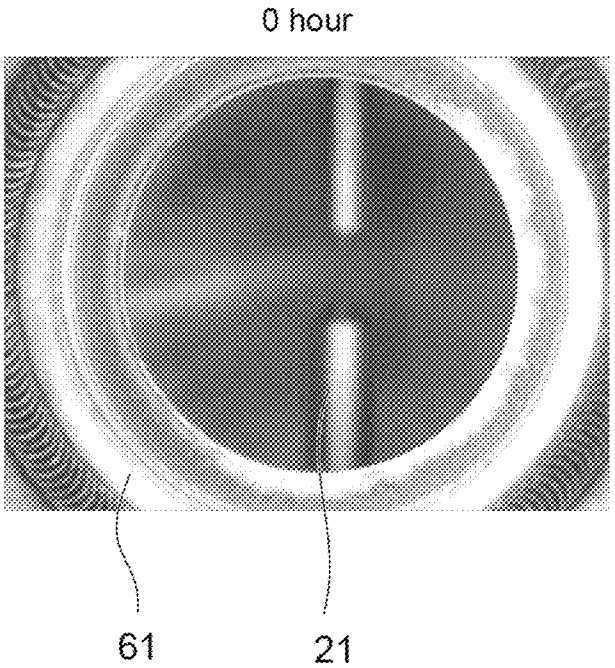
FIG. 26A is a photograph showing an eighth sample immediately after operation start.
Figure 27B:
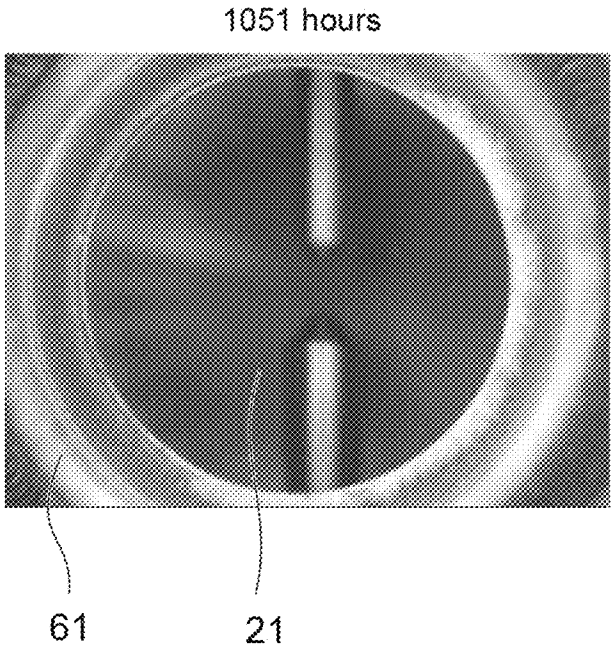
FIG. 27B is a photograph showing the eighth sample after an elapse of 1051 hours.
Figure 27A:
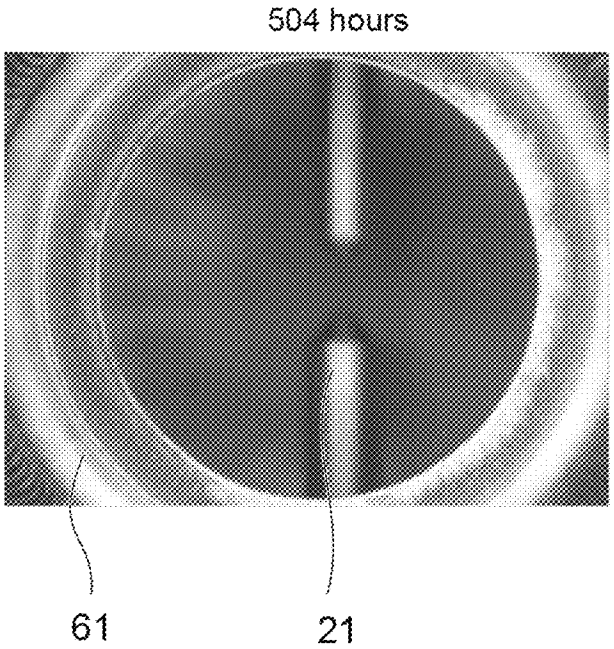
FIG. 27A is a photograph showing the eighth sample after an elapse of 504 hours.

FIGS. 20A to 20C are photographs showing a fourth sample immediately after operation start, after an elapse of 147 hours, and after an elapse of 712 hours, respectively. FIGS. 21A to 21C are photographs showing a fifth sample immediately after operation start, after an elapse of 147 hours, and after an elapse of 712 hours, respectively. FIGS. 22A, 22B, 23A, and 23B are photographs showing a sixth sample immediately after operation start, after an elapse of 168 hours, after an elapse of 504 hours, and after an elapse of 1051 hours, respectively. The fourth sample, the fifth sample, and the sixth sample correspond to the light emitting sealed body 1. As described above, in the light emitting sealed body 1, gold-copper brazing is used as the joining material 25.

As shown in FIGS. 20A to 20C and 21A to 21C, in the fourth sample and in the fifth sample, foreign matter was not generated on the first window member 21 even after an elapse of 712 hours from the start of driving. As shown in FIGS. 22A, 22B, 23A, and 23B, in the sixth sample, foreign matter was not generated on the first window member 21 even after an elapse of 1051 hours from the start of driving. From these results, it can be seen that the generation of foreign matter on the first window member 21 can be suppressed by using a material containing gold as the joining material 25.

As described above, in the light emitting sealed body 1, the first window member 21 is joined to the housing 10 by the joining material 25 consisting of a material containing gold. Accordingly, the formation of foreign matter on the first window member 21 caused by the joining material 25 can be suppressed as compared to a case where the joining material 25 consists of silver brazing. It is considered that the reason is that since gold having a higher melting point than that of silver brazing is used as the forming material of the joining material 25, even when the temperature rises due to driving, the movement of the forming material of the joining material 25 on the first window member 21 can be suppressed and, as a result, the occurrence of the bleed-out phenomenon can be suppressed. In addition, it is considered that since gold is less likely to be oxidized than silver, the oxidation of the forming material of the joining material 25 can be suppressed. Therefore, according to the light emitting sealed body 1, the formation of foreign matter on the first window member 21 can be suppressed, and the life span of the light emitting sealed body 1 can be extended. Note that the inventors of the present application have found that foreign matter can be generated on the first window member 21 because of the forming material of the joining material 25.

The housing 10 (first frame member 61) includes the wall portion 65 facing the side surface 21*c* of the first window member 21, and the joining material 25 joins the side surface 21*c* and the wall portion 65 to each other. Accordingly, the first window member 21 can be reliably joined to the housing 10. In addition, a region through which light transmits on the first window member 21 can be widely secured, for example, as compared to a case where the first window member 21 is joined to the housing 10 through the first major surface 21*a*.

The housing 10 includes the flange portion 66 protruding from the wall portion 65, and the first window member 21 is disposed such that the first major surface 21*a* faces the flange portion 66. Accordingly, the first window member 21 can be reliably joined to the housing 10. In addition, the contact of impure gas with a joint portion (metallized layer 26) between the first window member 21 and the housing 10 can be suppressed, and the deterioration (for example, oxidation) of the joint portion caused by the impure gas can be suppressed.

The joining material 25 is inserted between the first major surface 21*a* of the first window member 21 and the flange portion 66. Accordingly, the contact of impure gas with the joint portion between the first window member 21 and the housing 10 can be suppressed, and the deterioration of the joint portion caused by the impure gas can be suppressed.

The joining material 25 is inserted between the first major surface 21*a* of the first window member 21 and the flange portion 66 in a state where the joining material 25 is not bonded to the first major surface 21*a* of the first window member 21. Accordingly, since the joining material 25 is not bonded to the first major surface 21*a* of the first window member 21, the strain caused by a difference in thermal expansion coefficient between the first window member 21 and the flange portion 66 can be reduced.

The joining material 25 covers a part of the second surface 66*b* (surface on the side opposite to the first window member 21) of the flange portion 66. Accordingly, the release of impure gas from the second surface 66*b* of the flange portion 66 can be suppressed.

The joining material 25 is provided to reach the end surface 65*b* of the wall portion 65 in the Z direction (direction perpendicular to the first major surface 21*a*). Accordingly, the release of impure gas from the end surface 65*b* of the wall portion 65 can be suppressed. Namely, for example, when the end surface 65*b* is a processed metal surface, large irregularities are likely to be formed on the end surface 65*b*, and impure gas adsorbed in the irregularities is likely to be released. In this respect, such release of impure gas can be suppressed by covering at least a part of the end surface 65*b* with the joining material 25.

The metallized layer 26 is formed on the first window member 21, the plating layer 27 is formed on the metallized layer 26, and the joining material 25 is joined to the plating layer 27, so that the first window member 21 is joined to the housing 10. Accordingly, the first window member 21 can be reliably joined to the housing 10. In addition, the metallized layer 26 has high reactivity, but since the plating layer 27 is formed on the metallized layer 26, the deterioration (for example, oxidation) of the metallized layer 26 can be suppressed.

The plating layer 27 covers the metallized layer 26 such that the metallized layer 26 is not exposed. Accordingly, the metallized layer 26 has high reactivity, but since the plating layer 27 is formed on the metallized layer 26, the deterioration of the metallized layer 26 can be suppressed.

The joining material 25 covers the metallized layer 26 and the plating layer 27 on the internal space S1 side such that the metallized layer 26 and the plating layer 27 are not exposed. Accordingly, the deterioration of the metallized layer 26 can be further suppressed.

The joining material 25 covers the metallized layer 26 and the plating layer 27 on the side opposite the internal space S1 such that the metallized layer 26 and the plating layer 27 are not exposed. Accordingly, the deterioration of the metallized layer 26 can be further suppressed.

The metallized layer 26 is made of molybdenum-manganese. Accordingly, since molybdenum-manganese has a higher melting point than that of gold contained in the joining material 25, the diffusion of the forming material of the metallized layer 26 into the joining material 25 during manufacturing (for example, when the joining material 25 is baked) can be suppressed.

The first window member 21 is made of sapphire. In this case, since a transmittance of sapphire to ultraviolet light is relatively high, light including ultraviolet light can be incident on the first window member 21. On the other hand, as described above, when light including ultraviolet light is incident on the first window member 21, foreign matter is likely to be generated on the first window member 21 because of the oxidation of the forming material of the joining material 25. In this respect, according to the light emitting sealed body 1, also in such a case, the generation of foreign matter on the first window member 21 can be suppressed.

The joining material 25 consists of gold-copper brazing. Accordingly, the generation of foreign matter on the first window member 21 can be reliably suppressed.

The housing 10 includes the first frame member 61 fixed to the housing body 11 at the first opening 12, and the first window member 21 is joined to the first frame member 61 by the joining material 25. Accordingly, the first window member 21 can be satisfactorily joined to the housing 10.

The housing 10 is made of a metal material. In this case, the charging pressure of the light-emitting gas GS can be increased, and the intensity of the second light L2 emitted from the second window portion 30 can be increased, whereas foreign matter is likely to be formed on the first window member 21. The reason is that as the intensity of the second light L2 increases, ultraviolet included in the second light L2 also increases. In this respect, according to the light emitting sealed body 1, also in such a case, the generation of foreign matter on the first window member 21 can be suppressed.

The charging pressure of the light-emitting gas GS in the housing 10 is 3 MPa or more. In this case, the brightness of the plasma generated in the light-emitting gas GS can be increased, so that the intensity of the second light L2 emitted from the second window portion 30 can be increased. On the other hand, since the temperature of the light emitting sealed body 1 when driven rises due to an increase in light output, foreign matter is likely to be generated on the first window member 21. In this respect, according to the light emitting sealed body 1, also in such a case, the generation of foreign matter on the first window member 21 can be suppressed.

As a third modification example, the joining material 25 may be gold-nickel brazing. Also, in the third modification example, similarly to the first embodiment, the generation of foreign matter on the first window member 21 can be suppressed, and the life span of the light emitting sealed body 1 can be extended.

This point will be described with reference to FIGS. 24A to 25B. FIGS. 24A, 24B, 25A, and 25B are photographs showing a seventh sample immediately after operation start, after an elapse of 168 hours, after an elapse of 504 hours, and after an elapse of 1051 hours, respectively. The seventh sample corresponds to the third modification example. As shown in FIGS. 24A, 24B, 25A, and 25B, in the seventh sample, foreign matter was not generated on the first window member 21 even after an elapse of 1051 hours from the start of driving.

As a fourth modification example, the metallized layer 26 may be titanium-doped silver brazing. Also, in the fourth modification example, similarly to the first embodiment, the generation of foreign matter on the first window member 21 can be suppressed, and the life span of the light emitting sealed body 1 can be extended.

This point will be described with reference to FIGS. 26A to 27B. FIGS. 26A, 26B, 27A, and 27B are photographs showing an eighth sample immediately after operation start, after an elapse of 168 hours, after an elapse of 504 hours, and after an elapse of 1051 hours, respectively. The eighth sample corresponds to the fourth modification example. As shown in FIGS. 26A, 26B, 27A, and 27B, in the eighth sample, foreign matter was not generated on the first window member 21 even after an elapse of 1051 hours from the start of driving.

In the first embodiment, the first window member 21 is made of sapphire, but as another modification example, the first window member 21 may be made of a material other than sapphire, for example, diamond. When the first window member 21 is made of diamond, it is preferable that the metallized layer 26 is made of a material other than molybdenum-manganese, and for example, the metallized layer 26 may be titanium-doped silver brazing as in the fourth modification example. The reason is that the metallized layer 26 made of molybdenum-manganese is difficult to form on the window member made of diamond.

In the first embodiment, the joining material 25 that joins the first window member 21 to the housing 10 consists of a material containing gold, but in addition to or instead of this configuration, the joining material 35 that joins the second window member 31 to the housing 10 (second frame member 71) may consist of a material containing gold. In this case, the formation of foreign matter on the second window member 31 can be suppressed, and the life span of the light emitting sealed body 1 can be extended. Namely, at least one of the joining material 25 and the joining material 35 may consist of a material containing gold. Similarly to the second window member 31, the protective layer 80 may be formed at least on the surface on the internal space S1 side (second major surface 21*b*) of the first window member 21. In the first embodiment, the first light L1 is incident on the first opening 12, and the second light L2 is emitted from the second opening 13, but one opening may be formed in the housing 10, the first light L1 may be incident on the opening, and the second light L2 may be emitted from the opening. Namely, the opening of the housing 10 may be such that the first light L1 is incident thereon and the second light L2 is emitted therefrom. In this case, a window member that transmits the first light L1 and the second light L2 is disposed in the opening. In such a configuration, the window member may be joined to the housing 10 by a joining material consisting of a material containing gold.

The first window member 21 and the first frame member 61 (housing 10) may be joined by the joining material 25, and for example, the joining material 25 may be disposed only between the side surface 21*c* of the first window member 21 and the wall portion 65 of the first frame member 61. In the first embodiment, the first window member 21 is fixed to the housing body 11 via the first frame member 61, but the first frame member 61 may be omitted and the first window member 21 may be directly fixed to the housing body 11. In this case, for example, the first window member 21 may be disposed on the inner portion 12*a* of the first opening 12, or a portion of the housing body 11 may form a wall portion facing the side surface 21*c* of the first window member 21, the portion forming the inner portion 12*a*, and the side surface 21*c* and the wall portion may be joined by the joining material 25.

[Sealed Portion of Charging Pipe]

Figure 28:
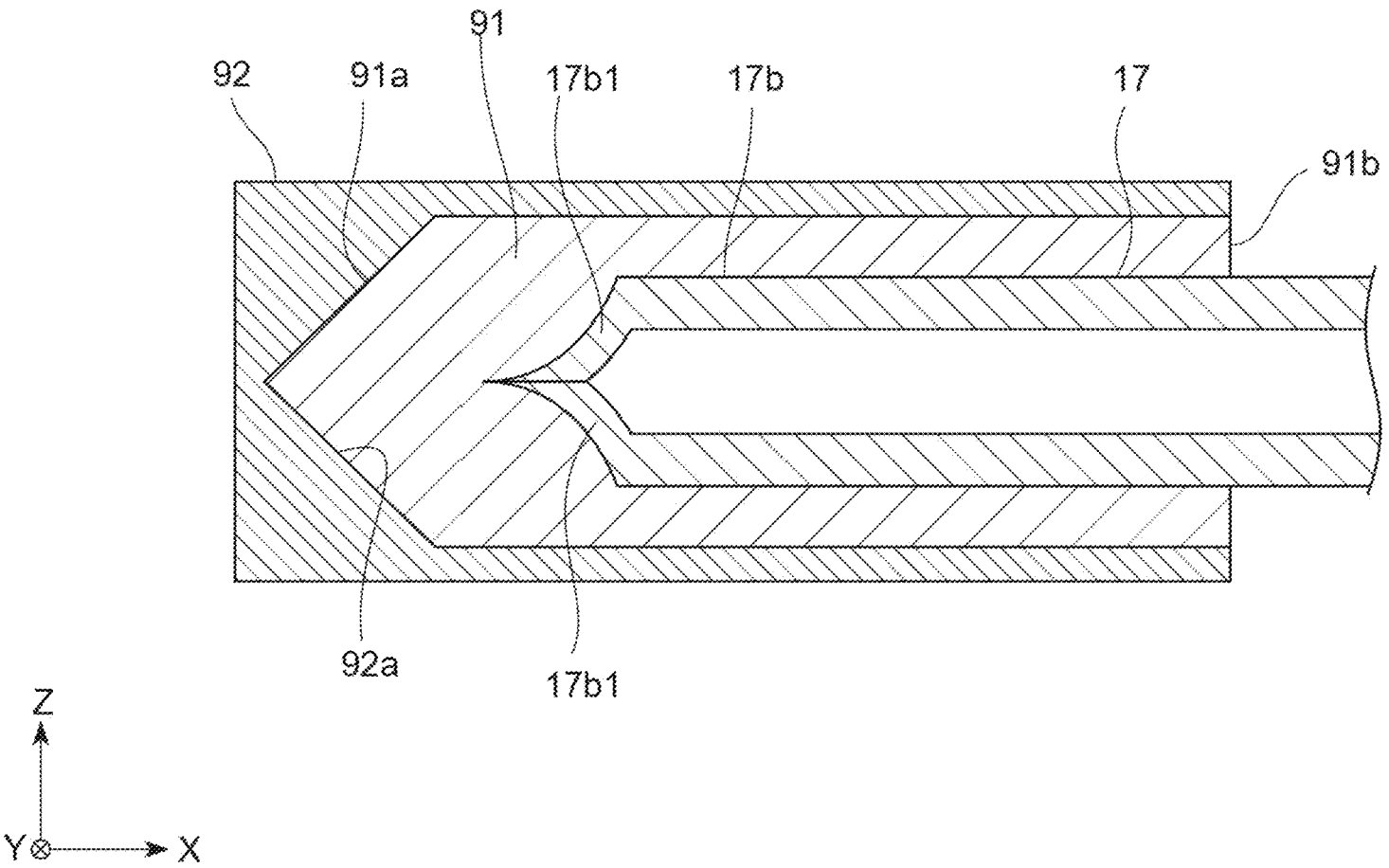
FIG. 28 is a cross-sectional view of the vicinity of a second end portion of a charging pipe.

As shown in FIGS. 1, 3, and 28, the second end portion 17*b* of the charging pipe 17 is sealed by being crushed. When the housing 10 is charged with the light-emitting gas GS, the second end portion 17*b* is sealed (cut in a sealed state) by introducing the light-emitting gas GS into the housing 10 through the charging pipe 17 and then press-cutting (cutting off) the charging pipe 17 while pressing and crushing a second end portion 17*b* side using a tool or the like. As a result, a pipe material 17*b*1 forming the second end portion 17*b* comes into contact with each other, so that the charging pipe 17 is closed at the second end portion 17*b* by the charging pipe 17 itself.

The second end portion 17*b* of the charging pipe 17 is covered with a covering member 91. The covering member 91 covers a part on the second end portion 17*b* side of the charging pipe 17 and covers the entirety of the second end portion 17*b*. The covering member 91 is formed in a substantially cylindrical shape and has a tapered surface 91*a* on an outer surface of a bottom portion of the covering member 91. The tapered surface 91*a* is formed to decrease in diameter as going away from the second end portion 17*b*. The covering member 91 functions as a leakage prevention member that prevents the light-emitting gas GS from leaking from the second end portion 17*b*.

The covering member 91 is covered with a cap member 92. The cap member 92 covers an entire surface of the covering member 91 except for a top surface 91*b*. The top surface 91*b* is a surface of the covering member 91 on a side opposite to the tapered surface 91*a*, and is a surface facing the housing 10. The cap member 92 is formed in a substantially cylindrical shape and has a tapered surface 92*a* on an inner surface of a bottom portion of the cap member 92. The tapered surface 92*a* is in contact with the tapered surface 91*a*, and is formed to decrease in diameter as going away from the second end portion 17*b*. The cap member 92 functions as a protective member that protects the second end portion 17*b* and the covering member 91.

The covering member 91 is made of an inorganic material, and the cap member 92 is made of a metal material. In this example, the charging pipe 17 is made of copper, the covering member 91 is made of solder, and the cap member 92 is made of brass. In this case, a thermal expansion coefficient of the charging pipe 17 is $17.7\times10^{-6}$ (1/K), a thermal expansion coefficient of the covering member 91 is $20.2\times10^{-6}$ (1/K), and a thermal expansion coefficient of the cap member 92 is $18.0\times10^{-6}$ (1/K). Namely, in this example, the thermal expansion coefficient is larger in the order of the covering member 91, the cap member 92, the charging pipe 17. A hardness (Vickers hardness) of the charging pipe 17 is 70 to 80 HV, a hardness of the covering member 91 is approximately 20 HV, and a hardness of the cap member 92 is approximately 180 to 230 HV. Namely, in this example, the hardness is larger in the order of the cap member 92, the charging pipe 17, and the covering member 91.

As described above, in the light emitting sealed body 1, the second end portion 17*b* of the charging pipe 17 which is sealed by being crushed is covered with the covering member 91 made of an inorganic material. Accordingly, the second end portion 17*b* can be prevented from being opened, and even if a leakage from the second end portion 17*b* occurs, the reduction of the charging pressure of the light-emitting gas GS inside the housing 10 can be suppressed. In addition, since the covering member 91 is made of an inorganic material, the covering member 91 can stably cover the second end portion 17*b* even under a high temperature environment. In addition, in the light emitting sealed body 1, the covering member 91 is covered with the cap member 92 made of a metal material. Accordingly, the second end portion 17*b* and the covering member 91 can be protected. In addition, when the temperature rises, the covering member 91 can tend to be deformed toward the second end portion 17*b* side instead of toward a cap member 92 side. As a result, the second end portion 17*b* can be pressed by the covering member 91, and the second end portion 17*b* can be further prevented from being opened. Therefore, according to the light emitting sealed body 1, the leaking of the light-emitting gas GS caused by the opening of the second end portion 17*b* of the charging pipe 17 can be suppressed, and the life span of the light emitting sealed body 1 can be extended. Incidentally, in the laser excitation light source, the light-emitting gas is charged at high pressure for high efficiency and high output, and during driving, the temperature rises due to irradiation with laser light and radiant heat from the plasma. For this reason, when the laser excitation light source is continuously driven for a long time, there is a possibility that the sealed end portion of the charging pipe is expanded and opened and the light-emitting gas leaks. In this respect, according to the light emitting sealed body 1, as described above, the leaking of the light-emitting gas GS caused by the opening of the second end portion 17*b* of the charging pipe 17 can be suppressed, and the life span of the light emitting sealed body 1 can be extended.

The thermal expansion coefficient of the covering member 91 is larger than the thermal expansion coefficient of the charging pipe 17. Accordingly, when the temperature rises, the second end portion 17*b* of the charging pipe 17 can be effectively pressed by the covering member 91, and the second end portion 17*b* can be further prevented from being opened.

The hardness of the cap member 92 is larger than the hardness of the charging pipe 17. Accordingly, when the temperature rises, the covering member 91 can tend to be deformed toward the second end portion 17*b* side instead of toward the cap member 92 side, and the second end portion 17*b* can be further prevented from being opened.

The covering member 91 is made of a thermoplastic material (solder in the above-described example). Accordingly, it is possible to suitably achieve the above-described functions and effects such as being able to prevent the second end portion 17*b* from being opened, being able to suppress the reduction of the charging pressure of the light-emitting gas GS inside the housing 10 even if a leakage from the second end portion 17*b* occurs, and being able to stably cover the second end portion 17*b* even under a high temperature environment.

The cap member 92 is made of brass. Accordingly, it is possible to suitably achieve the above-described functions and effects such as being able to protect the second end portion 17*b* and the covering member 91 and being able to further prevent the second end portion 17*b* from being opened by pressing the second end portion 17*b* using the covering member 91.

The charging pressure of the light-emitting gas GS in the housing 10 is 3 MPa or more. In this case, the intensity of the plasma generated in the light-emitting gas GS can be increased, whereas the second end portion 17*b* of the charging pipe 17 is likely to be opened; however, according to the light emitting sealed body 1, also in such a case, the second end portion 17*b* can be prevented from being opened.

The materials of the charging pipe 17, the covering member 91, and the cap member 92 are not limited to the above-described examples, and these components may be made of any material.

Second Embodiment

Figure 29:
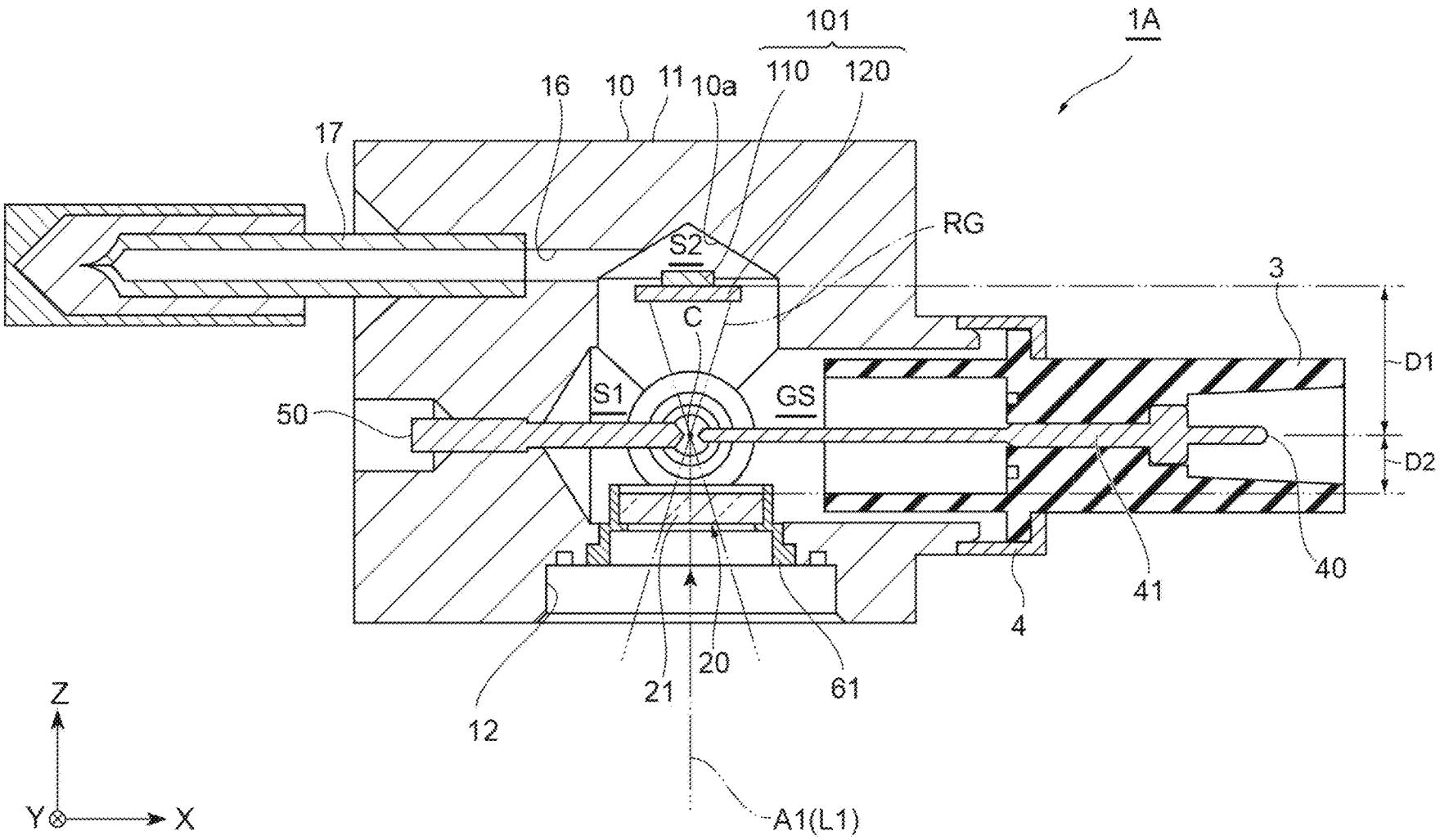
FIG. 29 is a cross-sectional view of a light emitting sealed body according to a second embodiment.

As shown in FIGS. 29 to 32, a light emitting sealed body 1A according to a second embodiment further includes a getter portion 101. In FIG. 29, the getter portion 101 is schematically shown. In the light emitting sealed body 1A, the protective layer 80 is not formed on the second window member 31. The getter portion 101 includes a getter material 110 and a support member 120 that supports the getter material 110. The getter material 110 is heated and activated to adsorb impure gas existing in the internal space S1. The getter material 110 is made of, for example, a material containing nichrome and is configured as a non-evaporable type. Namely, in this example, the getter material 110 does not evaporate when heated and activated. The getter material 110 is activated by being heated to, for example, 250° C. or higher. The getter material 110 is formed in, for example, a rectangular plate shape.

The support member 120 is formed from, for example, a metal material in a rectangular plate shape having a larger outer shape than that of the getter material 110. Examples of the metal material forming the support member 120 include high-melting point metals such as tungsten and molybdenum.

Figure 30:
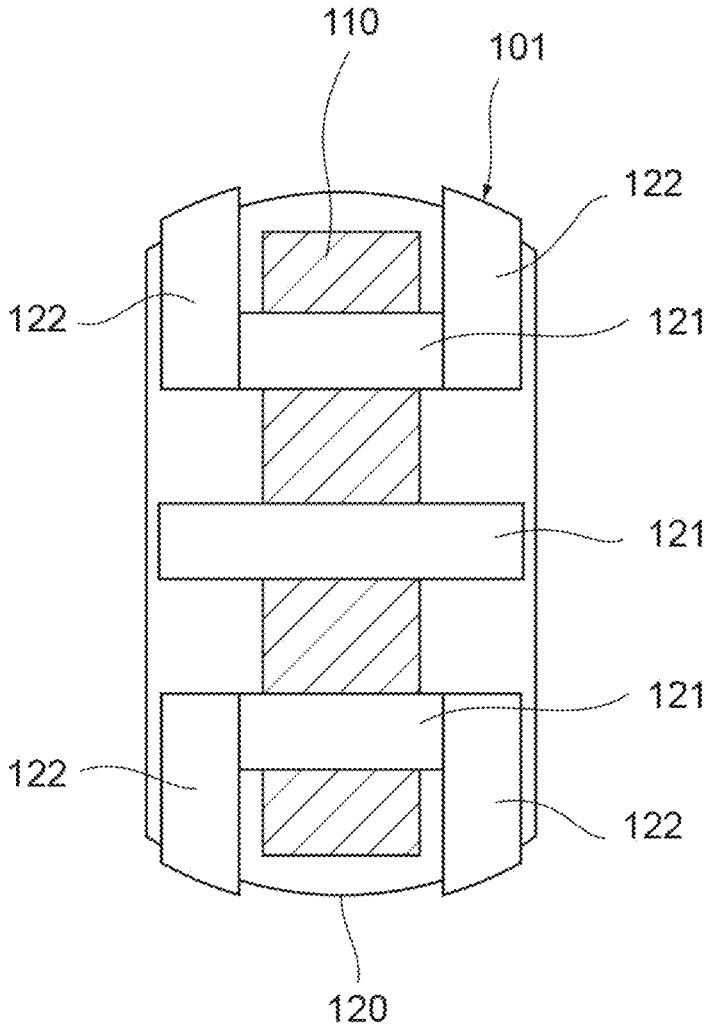
FIG. 30 is a plan view of a getter portion.
Figure 31B:
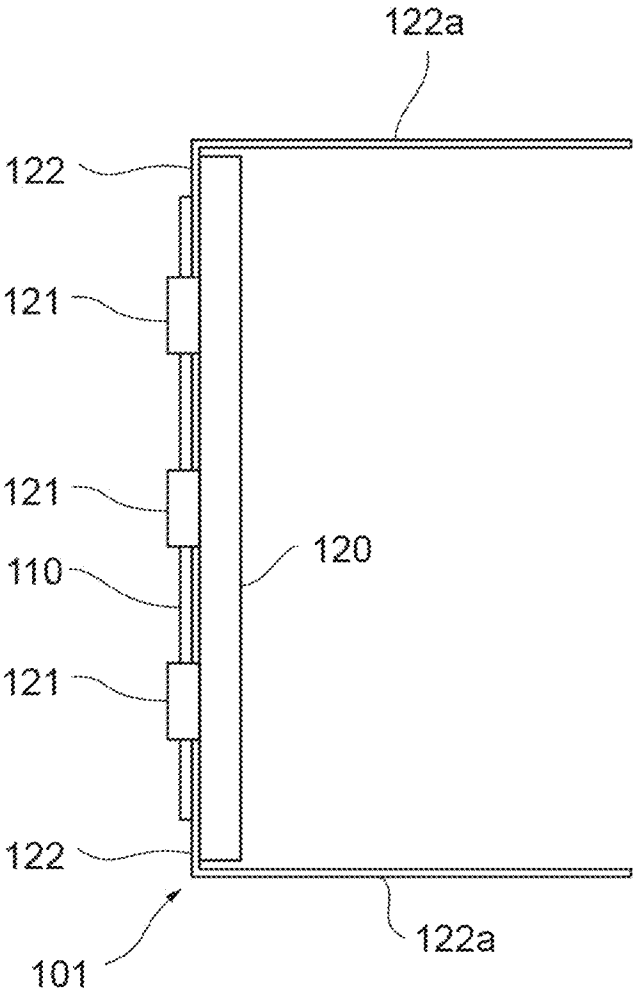
FIG. 31B is a side view of the getter portion.
Figure 31A:
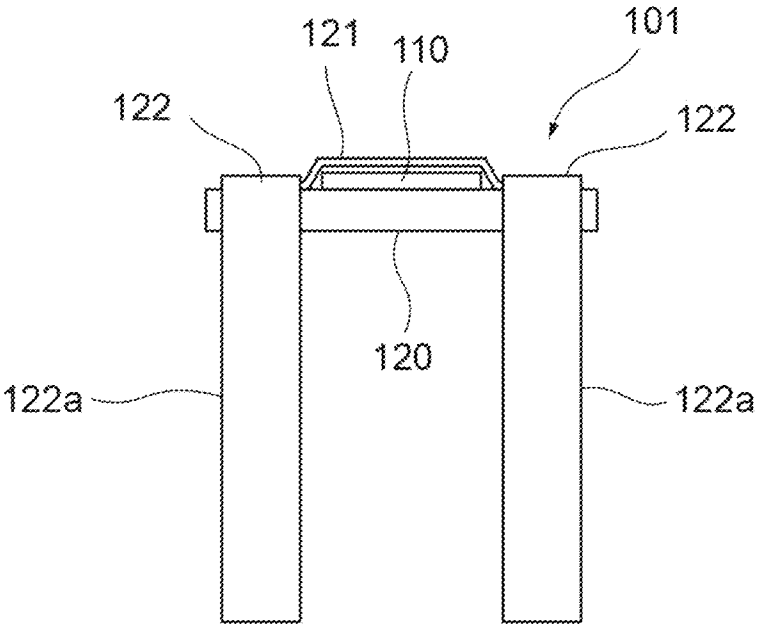
FIG. 31A is a front view of the getter portion.
Figure 32:
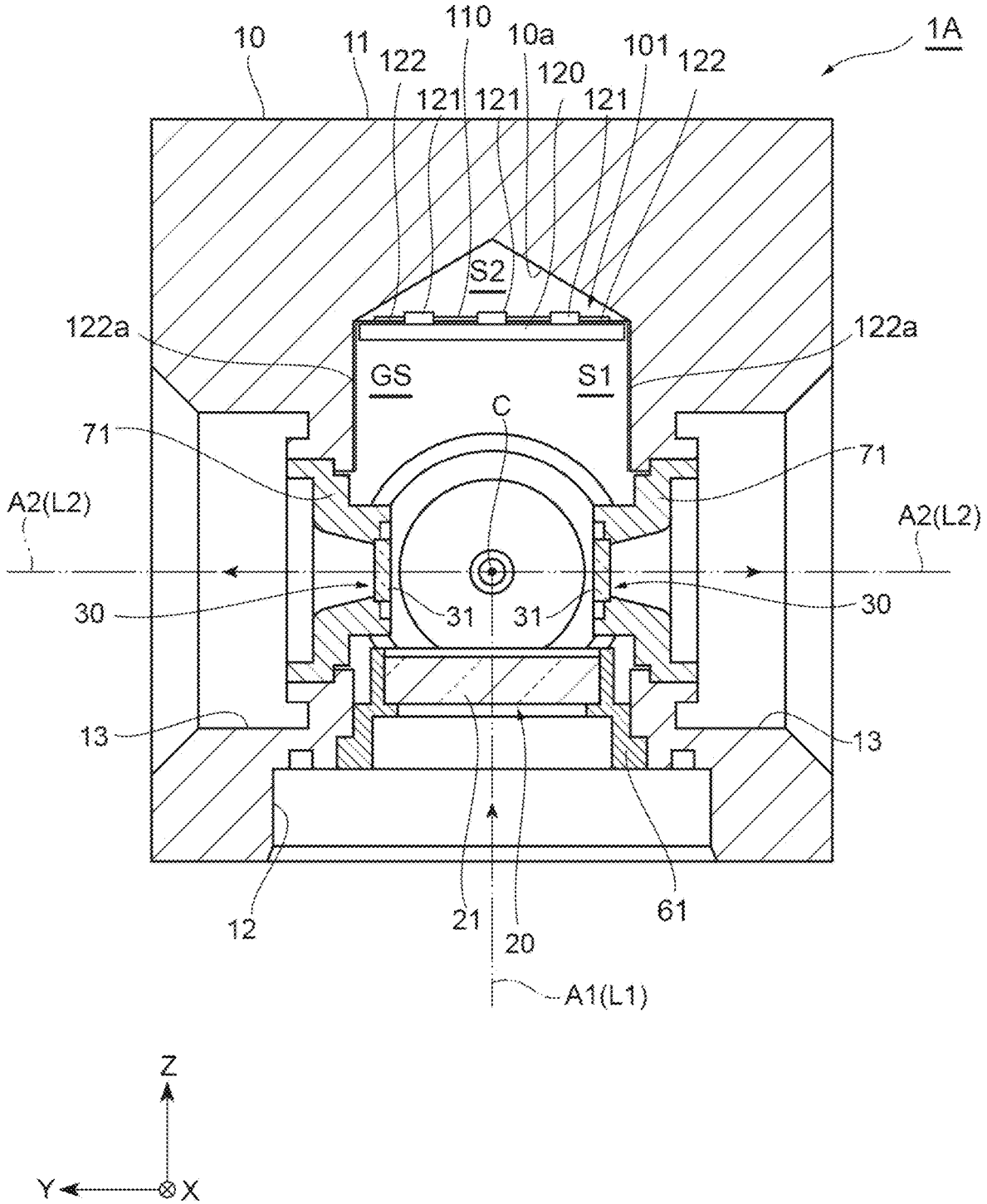
FIG. 32 is another cross-sectional view of the light emitting sealed body according to the second embodiment.

The getter material 110 is disposed on the support member 120 and is fixed to the support member 120 by three fixation members 121. The fixation members 121 are formed from, for example, nickel in a band shape (ribbon shape). Each of the fixation members 121 is disposed to press the getter material 110 at an intermediate portion thereof and is fixed to the support member 120 at both end portions thereof, for example, by welding. Accordingly, the getter material 110 is fixed to the support member 120. In FIG. 30, the getter material 110 is hatched for ease of understanding.

The support member 120 is fixed to the housing body 11 (housing 10) by four fixation members 122. The fixation members 122 are formed from, for example, nickel in a band shape (ribbon shape). Each of the fixation members 122 includes an extending portion 122*a* extending from a corner portion of the support member 120 perpendicularly to the support member 120. The extending portion 122*a* is fixed to the housing body 11, for example, by welding. In addition, the fixation members 122 are fixed to the support member 120, for example, by welding. Accordingly, the support member 120 is fixed to the housing body 11.

The getter portion 101 is disposed in an irradiation region RG of the first light L1 inside the housing 10. FIG. 29 shows the irradiation region RG of the first light L1. As shown in FIG. 29, for example, the first light L1 that has transmitted through the first window portion 20 converges such that the focal point is located on the intersection point C (generation position of the second light L2) of the first optical axis A1 and the second optical axis A2. The first light L1 that has passed through the intersection point C travels to a side opposite the first window portion 20 (upper side in FIG. 29) while expanding. In this example, the getter portion 101 (the getter material 110 and the support member 120) is disposed on the first optical axis A1 of the first light L1.

The getter portion 101 is disposed such that the getter material 110 faces the side opposite the first window portion 20 (upper side in FIG. 29). Accordingly, the support member 120 is disposed to face a first window portion 20 side, and the support member 120 is irradiated with the first light L1. In the light emitting sealed body 1A, the support member 120 is heated by being irradiated with the first light L1, and the getter material 110 is indirectly heated by averaged heat transferred from the support member 120.

The getter portion 101 is disposed such that the getter material 110 faces an inner surface 10*a* of the housing 10. The inner surface 10*a* is a surface of the housing 10 facing the first window portion 20. Here, the fact that the inner surface 10*a* faces the first window portion 20 means that the inner surface 10*a* and the first window portion 20 overlap each other in the Z direction (direction parallel to the first optical axis A1), and another member may be disposed between the inner surface 10*a* and the first window portion 20. In this example, the inner surface 10*a* has a tapered shape in which the diameter decreases as the inner surface 10*a* goes away from the getter portion 101.

The getter portion 101 is disposed to define a space S2 between the getter portion 101 and the inner surface 10*a*. The space S2 is a part of the internal space S1. In this example, the space S2 is a space having a substantially conical shape in which the diameter decreases as the space S2 goes away from the getter portion 101. The space S2 is not completely separated by the getter portion 101 and is connected to a portion of the internal space S1 other than the space S2 via a very small gap.

The getter portion 101 is disposed between the generation position (intersection point C of the first optical axis A1 and the second optical axis A2) of the second light L2 and the charging hole 16 in the internal space S1. As described above, the charging hole 16 also functions as an exhaust hole that discharges gas (impure gas) from the internal space S1 to the outside when the light emitting sealed body 1A is manufactured. A distance D1 from the getter material 110 to the generation position of the second light L2 is longer than a distance D2 from the generation position of the second light L2 to the first window portion 20.

A melting point of the support member 120 is higher than a melting point of the getter material 110. As one example, the getter material 110, the support member 120, the housing body 11, and the first frame member 61 (second frame member 71) are made of nichrome, tungsten, SUS304, and Kovar metal, respectively. Melting points of nichrome, tungsten, SUS304, and Kovar metal are 1400° C., 3387° C., 1400 to 1450° C., and 1450° C., respectively. Namely, in this example, the melting point of the support member 120 is higher than the melting points of the getter material 110, the housing body 11, and the first frame member 61. When the support member 120 is made of molybdenum also, since the melting point of molybdenum is 2623° C., the melting point of the support member 120 is higher than the melting points of the getter material 110, the housing body 11, and the first frame member 61.

A thermal conductivity of the support member 120 is higher than a thermal conductivity of the getter material 110. Thermal conductivities of nichrome, tungsten, SUS304, and Kovar metal are 14 (W/m·K), 168 (W/m·K), 16.7 (W/m·K), and 17 (W/m·K), respectively. Namely, in an example where the getter material 110, the support member 120, the housing body 11, and the first frame member 61 (second frame member 71) are made of nichrome, tungsten, SUS304, and Kovar metal, respectively, the thermal conductivity of the support member 120 is higher than the thermal conductivities of the getter material 110, the housing body 11, and the first frame member 61. When the support member 120 is made of molybdenum also, since the thermal conductivity of molybdenum is 142 (W/m·K), the thermal conductivity of the support member 120 is higher than the thermal conductivities of the getter material 110, the housing body 11, and the first frame member 61.

When the light emitting sealed body 1A is driven, as a first step, the getter material 110 is heated and activated by irradiation with the first light L1 through the first window portion 20. Subsequently, in a state where the getter material 110 is activated, as a second step, a plasma is generated in the light-emitting gas GS, and the second light L2 is emitted from the second window portion 30. Accordingly, impure gas existing in the internal space S1 can be adsorbed by the activated getter material 110. The first step and the second step may be sequentially performed as in this example, but may be simultaneously performed.

Next, the suppression of defects by the getter portion 101 will be described. In the laser excitation light source, when impure gas exists in the internal space inside the housing, various defects may occur inside the housing. In order to extend the life span of the laser excitation light source, suppressing such defects is required.

One of defects caused by impure gas is a phenomenon in which the above-described window member becomes opaque (opacity phenomenon) (FIGS. 6A and 6B).

Figure 33B:
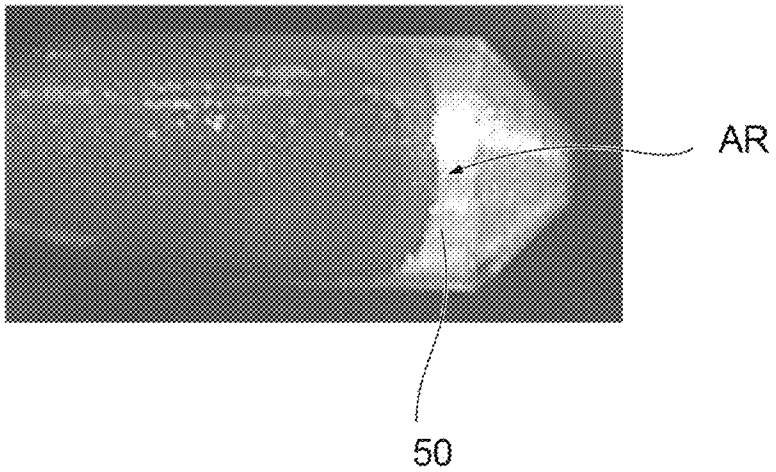
FIGS. 33A and 33B are photographs showing an example in which foreign matter is generated on electrodes.
Figure 33A:
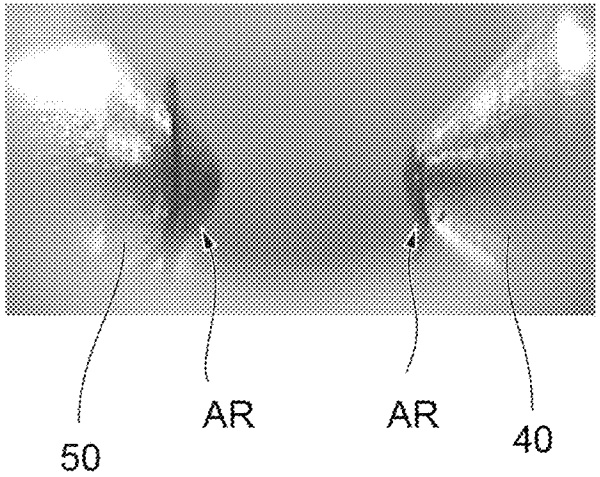

Another defect caused by impure gas is the generation of foreign matter inside the housing 10. FIGS. 33A and 33B are photographs showing an example in which foreign matter is generated on the first electrode 40 and/or on the second electrode 50. In the photograph shown in FIG. 33A, as indicated by arrow AR, foreign matter adheres to the tips of the first electrode 40 and to the second electrode 50. The foreign matter has, for example, carbon as a main component. In the photograph shown in FIG. 33B, as indicated by arrow AR, foreign matter adheres to a side surface of the second electrode 50. The foreign matter consists of, for example, tungsten oxide. It is considered that the foreign matter is generated due to impure gas existing in the internal space S1 inside the housing 10. Since the foreign matter can interfere with the operation of the light emitting sealed body 1A, suppressing the foreign matter is required.

Figure 34C:
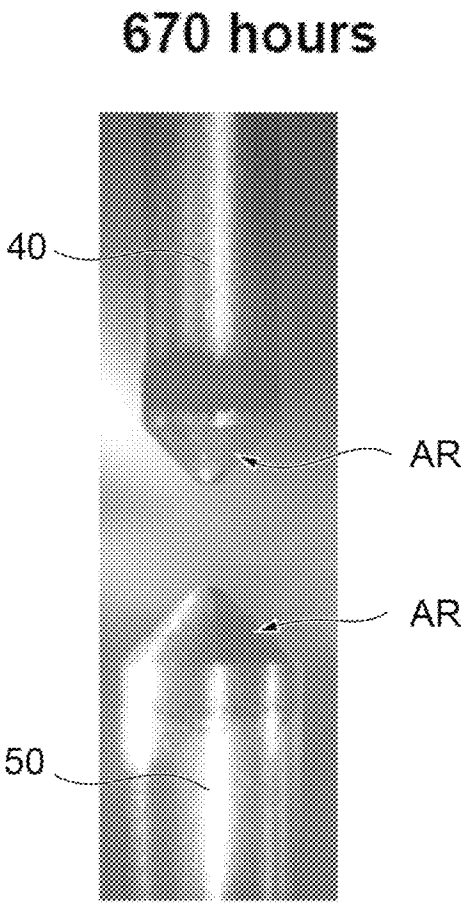
FIG. 34C is a photograph showing the ninth sample after an elapse of 670 hours.
Figure 34B:
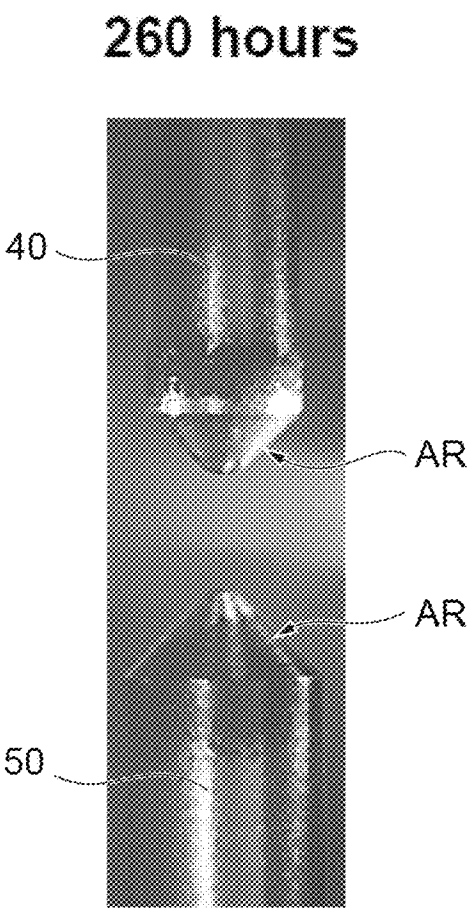
FIG. 34B is a photograph showing the ninth sample after an elapse of 260 hours.
Figure 34A:
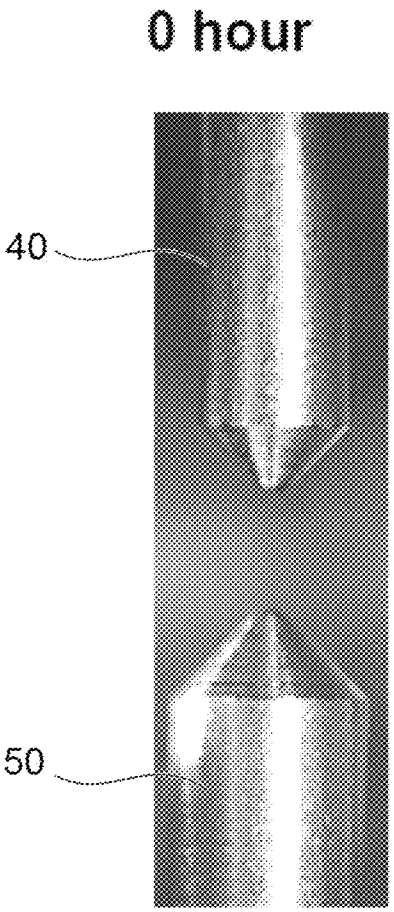
FIG. 34A is a photograph showing a ninth sample immediately after operation start.
Figure 35C:
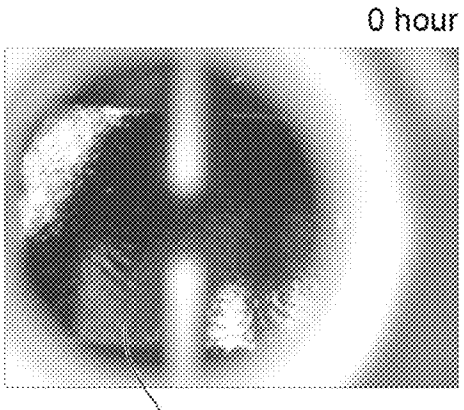
FIGS. 35A, 35B, and 35C are photographs showing a tenth sample immediately before operation start.
Figure 35B:
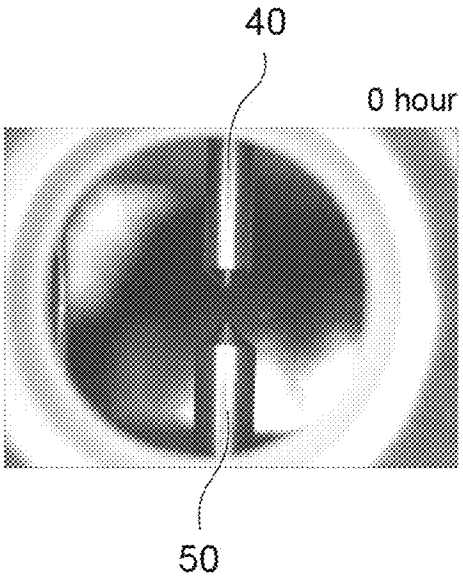
Figure 35A:
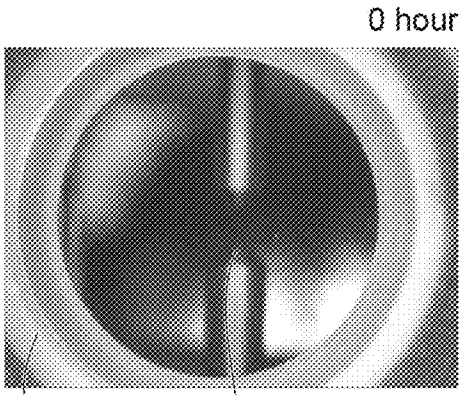
Figure 36C:
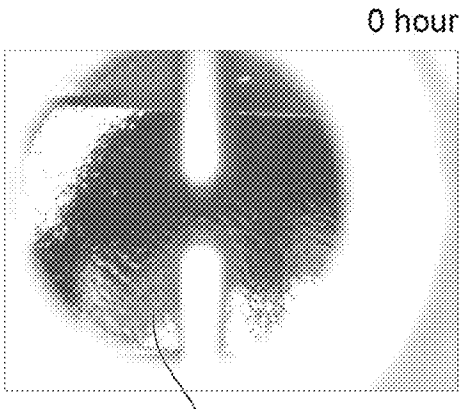
FIGS. 36A, 36B, and 36C are photographs showing the tenth sample immediately after operation start.
Figure 36B:
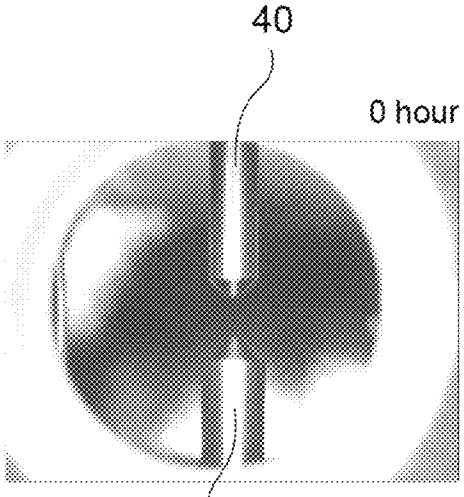
Figure 36A:
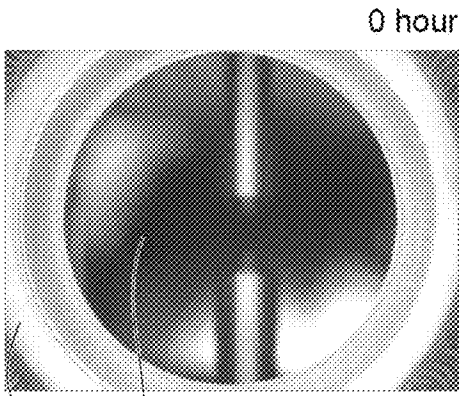
Figure 37A:
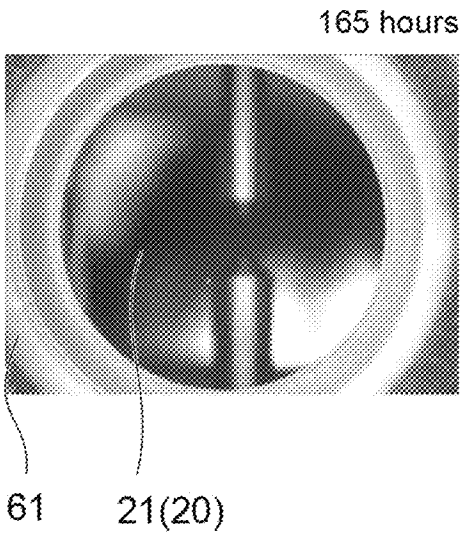
FIGS. 37A, 37B, and 37C are photographs showing the tenth sample after an elapse of 165 hours.
Figure 37B:
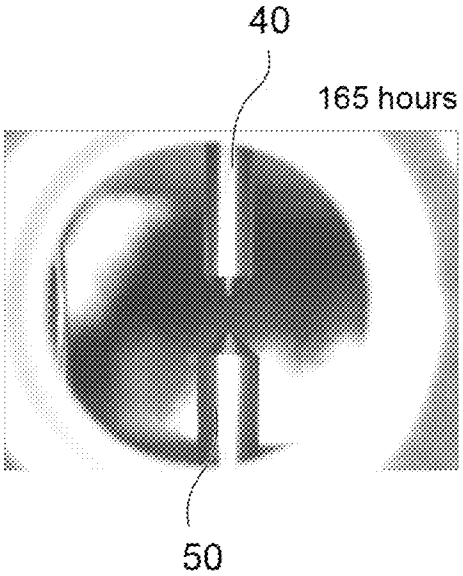
Figure 37C:
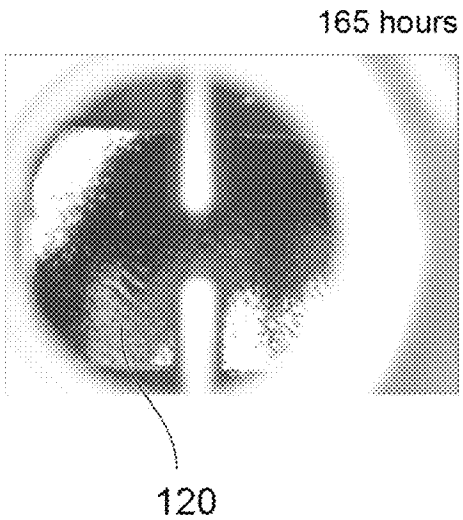

FIGS. 34A to 34C are photographs showing a ninth sample immediately after operation start, after an elapse of 260 hours, and after an elapse of 670 hours, respectively. The ninth sample corresponds to a configuration in which the getter portion 101 is not provided in the light emitting sealed body 1A. As shown in FIG. 34A, foreign matter did not adhere onto the first electrode 40 and onto the second electrode 50 immediately after operation start. As indicated by arrow AR in FIGS. 34B and 34C, foreign matter adhered to the first electrode 40 and to the second electrode 50 after an elapse of 260 hours and after an elapse of 670 hours.

FIGS. 35A to 37C are photographs showing a tenth sample immediately before operation start, immediately after operation start, and after an elapse of 165 hours, respectively. FIGS. 35A to 37C show the first window portion 20. The focal point is on the first window member 21 in FIG. 35A, the focal point is on the first electrode 40 and on the second electrode 50 in FIG. 35B, and the focal point is on the support member 120 in FIG. 35C. This point is also the same for FIGS. 36A to 37C. The tenth sample corresponds to the light emitting sealed body 1A. As shown in FIGS. 35A to 37C, even after an elapse of 165 hours from the start of driving, the opacity phenomenon did not occur on the first window member 21, and foreign matter did not adhere to the first electrode 40 and the second electrode 50.

Figure 38B:
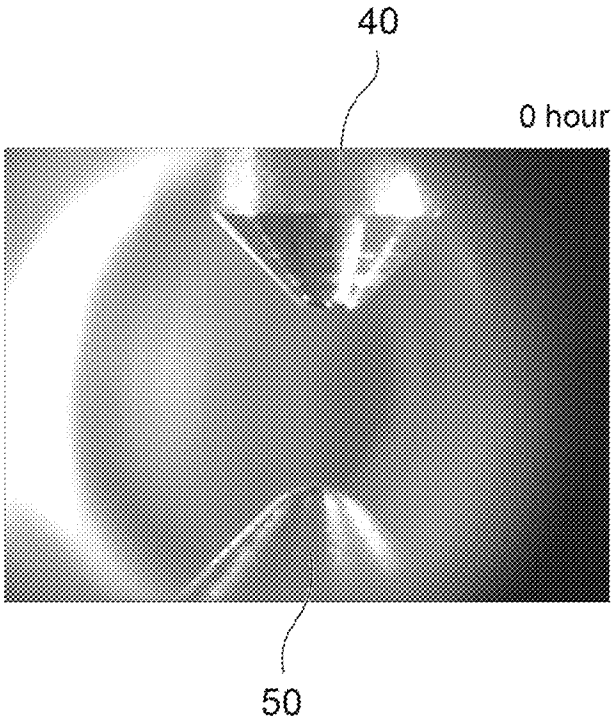
FIGS. 38A and 38B are photographs showing an eleventh sample immediately before operation start.
Figure 38A:
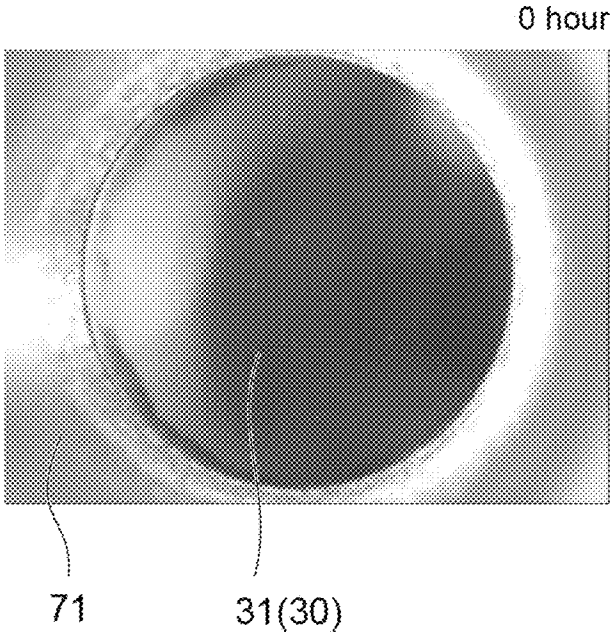
Figure 39B:
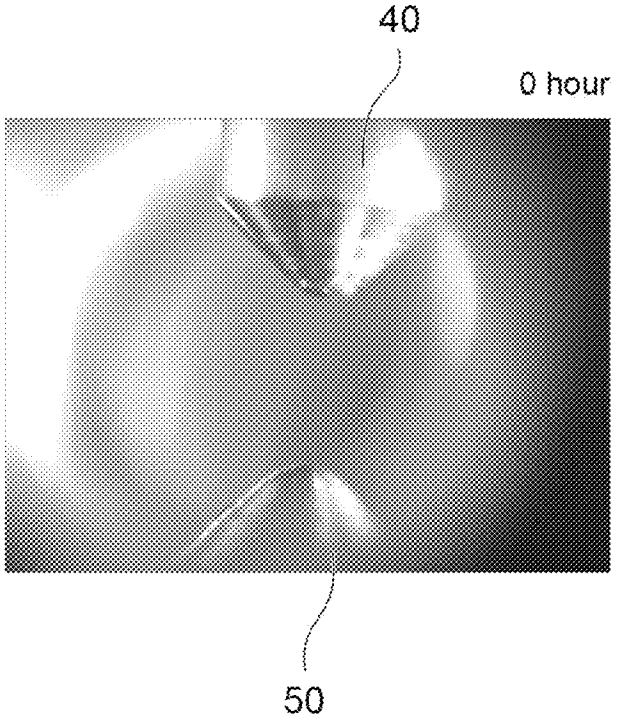
FIGS. 39A and 39B are photographs showing the eleventh sample immediately after operation start.
Figure 39A:
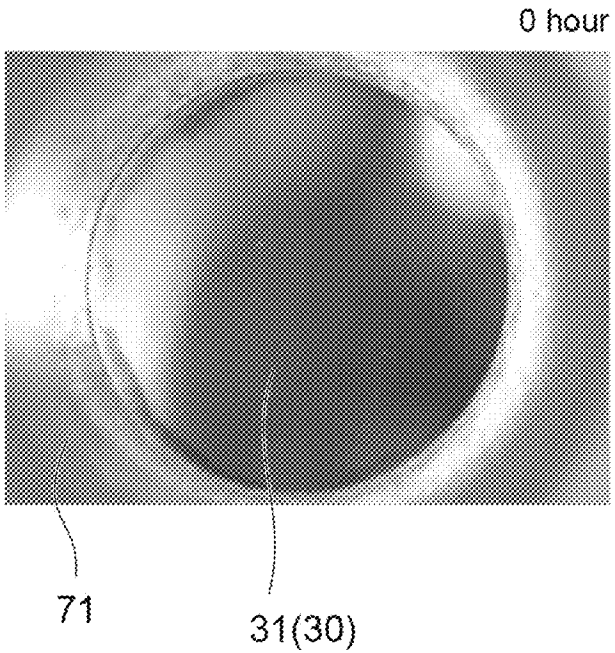
Figure 40B:
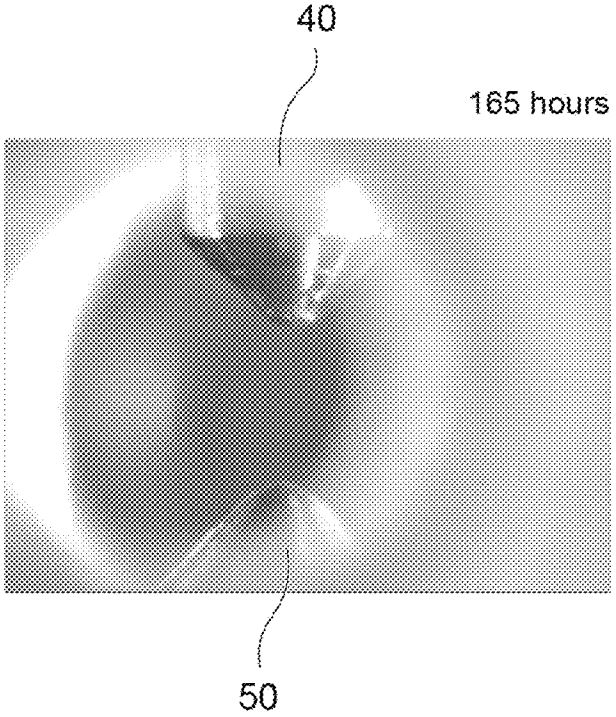
FIGS. 40A and 40B are photographs showing the eleventh sample after an elapse of 165 hours.
Figure 40A:
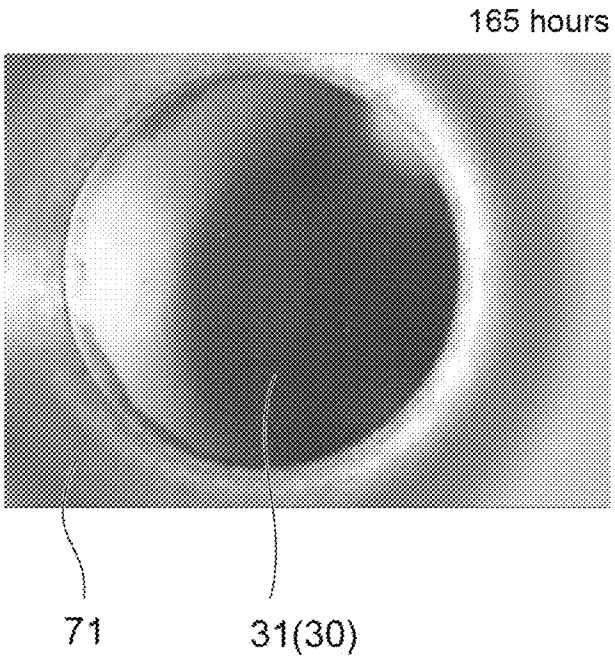
Figure 41B:
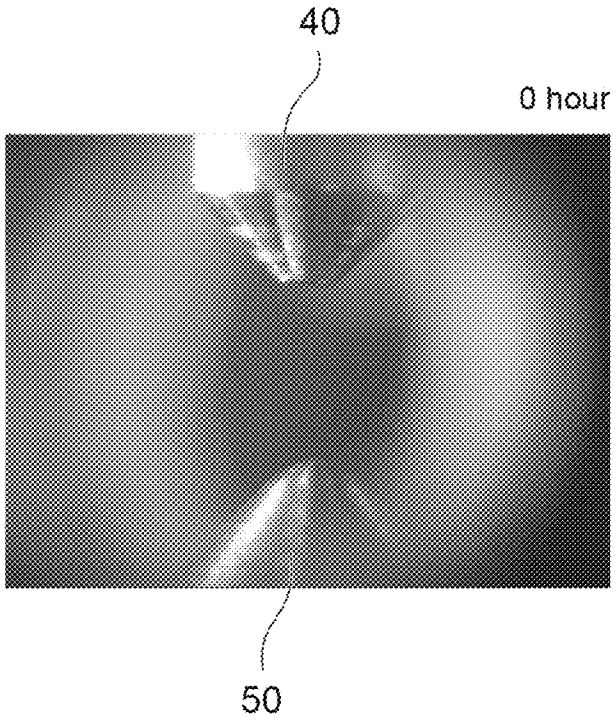
FIGS. 41A and 41B are photographs showing a twelfth sample immediately before operation start.
Figure 41A:
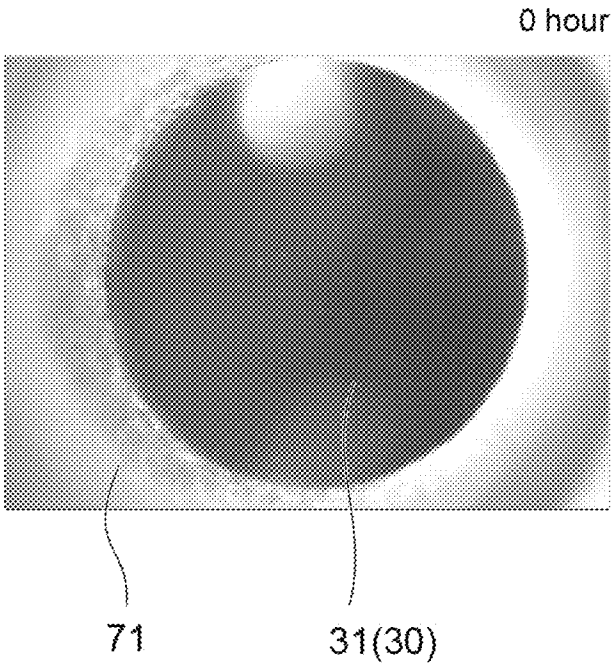
Figure 42B:
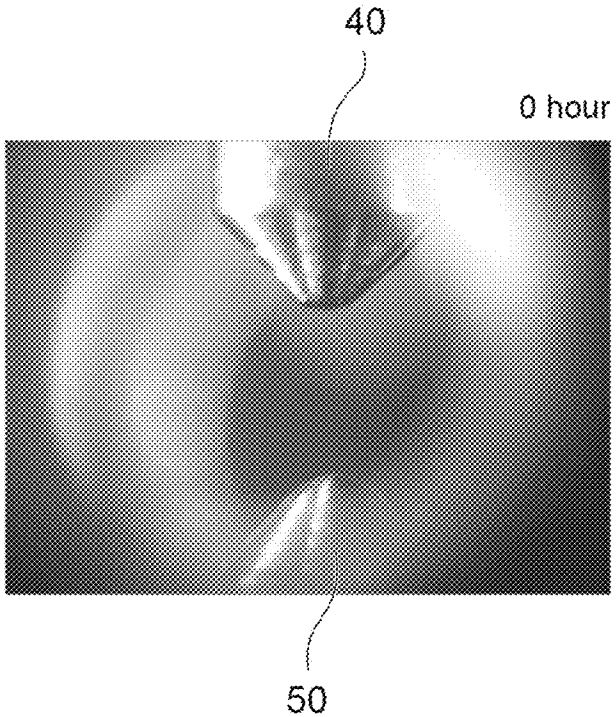
FIGS. 42A and 42B are photographs showing the twelfth sample immediately after operation start.
Figure 42A:
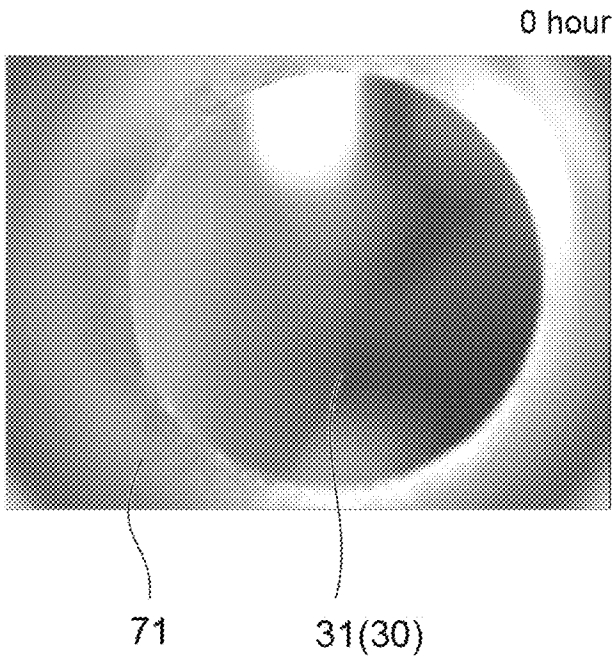
Figure 43B:
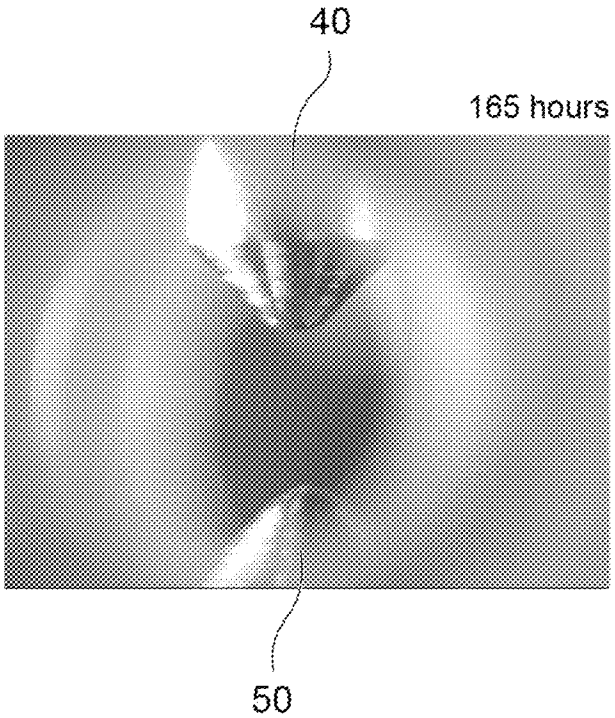
FIGS. 43A and 43B are photographs showing the twelfth sample after an elapse of 165 hours.
Figure 43A:
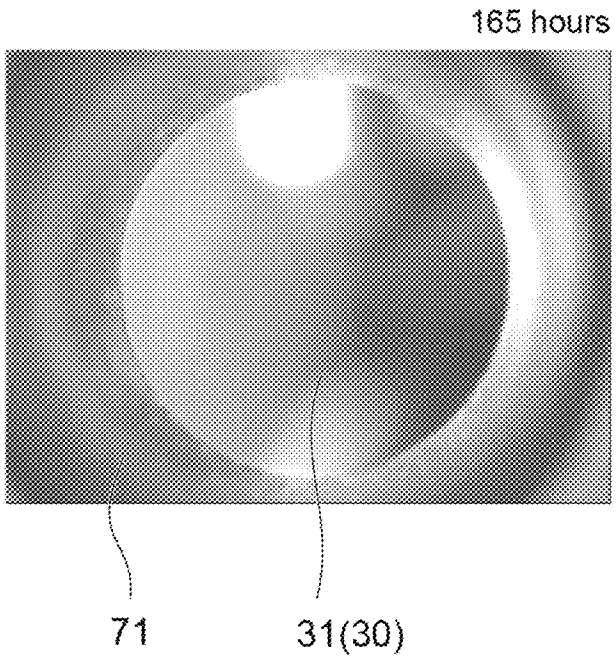

FIGS. 38A to 40B are photographs showing an eleventh sample immediately before operation start, immediately after operation start, and after an elapse of 165 hours, respectively. FIGS. 41A to 43B are photographs showing a twelfth sample immediately before operation start, immediately after operation start, and after an elapse of 165 hours, respectively. FIGS. 38A to 43B show the second window portion 30. In FIG. 38A, the focal point is on the second window member 31. In FIG. 38B, an image of the first electrode 40 and the second electrode 50 is captured through the second window member 31, and the focal point is on the first electrode 40 and on the second electrode 50. These points are also the same for FIGS. 39A to 44B. The eleventh sample and the twelfth sample correspond to the light emitting sealed body 1A. As shown in FIGS. 38A to 43B, in both the eleventh sample and the twelfth sample, even after an elapse of 165 hours from the start of driving, the opacity phenomenon did not occur on the second window member 31, and foreign matter did not adhere to the first electrode 40 and the second electrode 50.

Figure 44B:
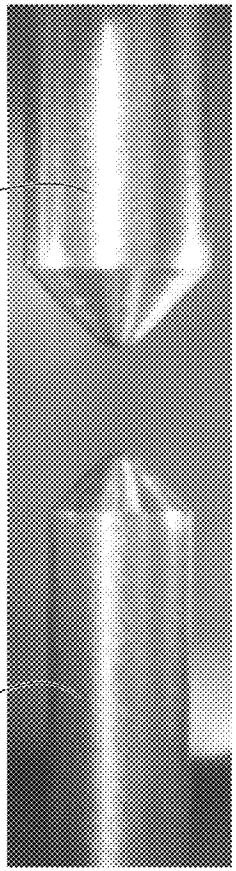
FIG. 44B is a photograph showing the thirteenth sample after an elapse of 262 hours.
Figure 44A:
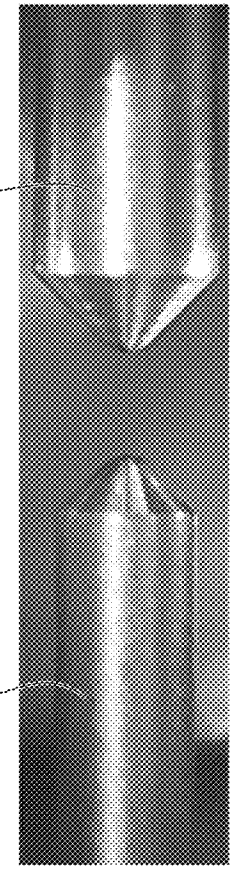
FIG. 44A is a photograph showing a thirteenth sample immediately after operation start.

FIG. 44A is a photograph showing a thirteenth sample immediately after operation start, and FIG. 44B is a photograph showing the thirteenth sample after an elapse of 262 hours. The thirteenth sample corresponds to the light emitting sealed body 1A. As shown in FIGS. 44A and 44B, even after an elapse of 165 from the start of driving, foreign matter did not adhere to the first electrode 40 and the second electrode 50.

From the above results, it can be seen that the occurrence of the opacity phenomenon and the generation of foreign matter inside the housing 10 can be suppressed by providing the getter portion 101.

As described above, in the light emitting sealed body 1A, the getter portion 101 including the getter material 110 is disposed in the irradiation region RG of the first light L1 inside the housing 10. Accordingly, the getter material 110 can be heated and activated by irradiation with the first light L1, and impure gas existing in the internal space S1 can be adsorbed by the activated getter material 110. As a result, the occurrence of a defect caused by impure gas can be suppressed. In addition, since the getter material 110 is heated and activated by irradiation with the first light L1, the heating of a member other than the getter portion 101, for example, the heating of the housing 10 can be suppressed. As a result, for example, the occurrence of a defect (for example, a leakage of the light-emitting gas GS or the like) caused by an increase in the temperature of the housing 10 can be suppressed. Therefore, according to the light emitting sealed body 1A, the life span can be extended.

The getter portion 101 includes the support member 120 that supports the getter material 110. Accordingly, for example, the getter material 110 can be indirectly heated through the support member 120, and the excessive heating of the getter material 110 can be suppressed.

The getter portion 101 is disposed such that the getter material 110 faces the side opposite the first window portion 20. Accordingly, the support member 120 functions as an adhesion prevention plate, and the spattered getter material 110 can be prevented from moving to the first window portion 20 side and from adhering to the first window portion 20 and the like.

The getter portion 101 is disposed such that the support member 120 is irradiated with the first light L1. Accordingly, the getter material 110 can be indirectly heated through the support member 120, and the excessive heating of the getter material 110 can be suppressed.

The melting point of the support member 120 is higher than the melting point of the getter material 110. Accordingly, damage to the support member 120 caused by heating through irradiation with the first light L1 can be suppressed.

The thermal conductivity of the support member 120 is higher than the thermal conductivity of the getter material 110. Accordingly, the getter portion 101 can be efficiently heated through the support member 120.

The getter portion 101 is disposed such that the getter material 110 faces the inner surface 10*a* of the housing 10, the inner surface 10*a* facing the first window portion 20. Accordingly, the spattered getter material 110 can adhere to the inner surface 10*a*. The getter material 110 that has adhered to the inner surface 10*a* can be heated and activated again by the first light L1. As a result, impure gas can be adsorbed by the getter material 110 that has adhered to the inner surface 10*a*.

The getter portion 101 is disposed to define the space S2 between the getter portion 101 and the inner surface 10*a* of the housing 10. Accordingly, the spattered getter material 110 can be kept in the space S2, and the adhesion of the getter material 110 to other members can be suppressed.

The getter portion 101 is disposed between the generation position (intersection point C of the first optical axis A1 and the second optical axis A2) of the second light L2 and the charging hole 16 (exhaust hole) in the internal space S1. Gas may be generated from the getter material 110 when the light emitting sealed body 1A is manufactured, but the gas can be easily discharged from the charging hole 16 to the outside.

The distance D1 from the getter material 110 to the generation position of the second light L2 is longer than the distance D2 from the generation position of the second light L2 to the first window portion 20. Accordingly, the excessive heating of the getter material 110 can be suppressed.

The getter material 110 is configured as the non-evaporable type. Also, in this case, the occurrence of a defect caused by impure gas can be suppressed, and the life span of the light emitting sealed body 1A can be extended. The amount of the getter material 110 of the non-evaporable type may be determined in consideration of the degree of vacuum, the life span, or the like of the light emitting sealed body 1A.

The second window portion 30 includes the second window member 31 made of a material containing diamond. In this case, light in a wide wavelength range including ultraviolet light can pass through the second window member 31. In addition, foreign matter containing carbon is likely to be generated as a defect caused by impure gas, but according to the light emitting sealed body 1A, also in such a case, the generation of foreign matter can be suppressed.

The housing 10 is made of a metal material. In this case, the charging pressure of the light-emitting gas GS can be increased, and the intensity of the second light L2 emitted from the second window portion 30 can be increased. In addition, as described above, impure gas is likely to exist in the internal space S1, but according to the light emitting sealed body 1A, also in such a case, the occurrence of a defect caused by impure gas can be suppressed.

The light emitting sealed body 1A includes the first electrode 40 and the second electrode 50 that face each other with the generation position of the second light L2 interposed therebetween. In this case, a plasma can be more reliably generated. In addition, foreign matter caused by impure gas is likely to be generated on the first electrode 40 and the second electrode 50, but according to the light emitting sealed body 1A, the generation of foreign matter on the first electrode 40 and the second electrode 50 can be suppressed.

The charging pressure of the light-emitting gas GS in the housing 10 is 3 MPa or more. In this case, as described above, the brightness of the plasma generated in the light-emitting gas GS can be increased, so that the intensity of the second light L2 emitted from the second window portion 30 can be increased. On the other hand, impure gas is likely to exist inside the housing 10. In this respect, according to the light emitting sealed body 1A, also in such a case, the occurrence of a defect caused by impure gas can be suppressed.

A method for driving the light emitting sealed body 1A according to the second embodiment includes a step of activating the getter material 110 by irradiating the getter material 110 with the first light L1, and a step of generating a plasma in the light-emitting gas GS and of emitting the second light L2. In this driving method, the getter material 110 can be heated and activated by irradiation with the first light L1, and impure gas existing in the internal space S1 can be adsorbed by the activated getter material 110. As a result, the occurrence of a defect caused by impure gas can be suppressed, and the life span of the light emitting sealed body 1A can be extended.

Figure 45:
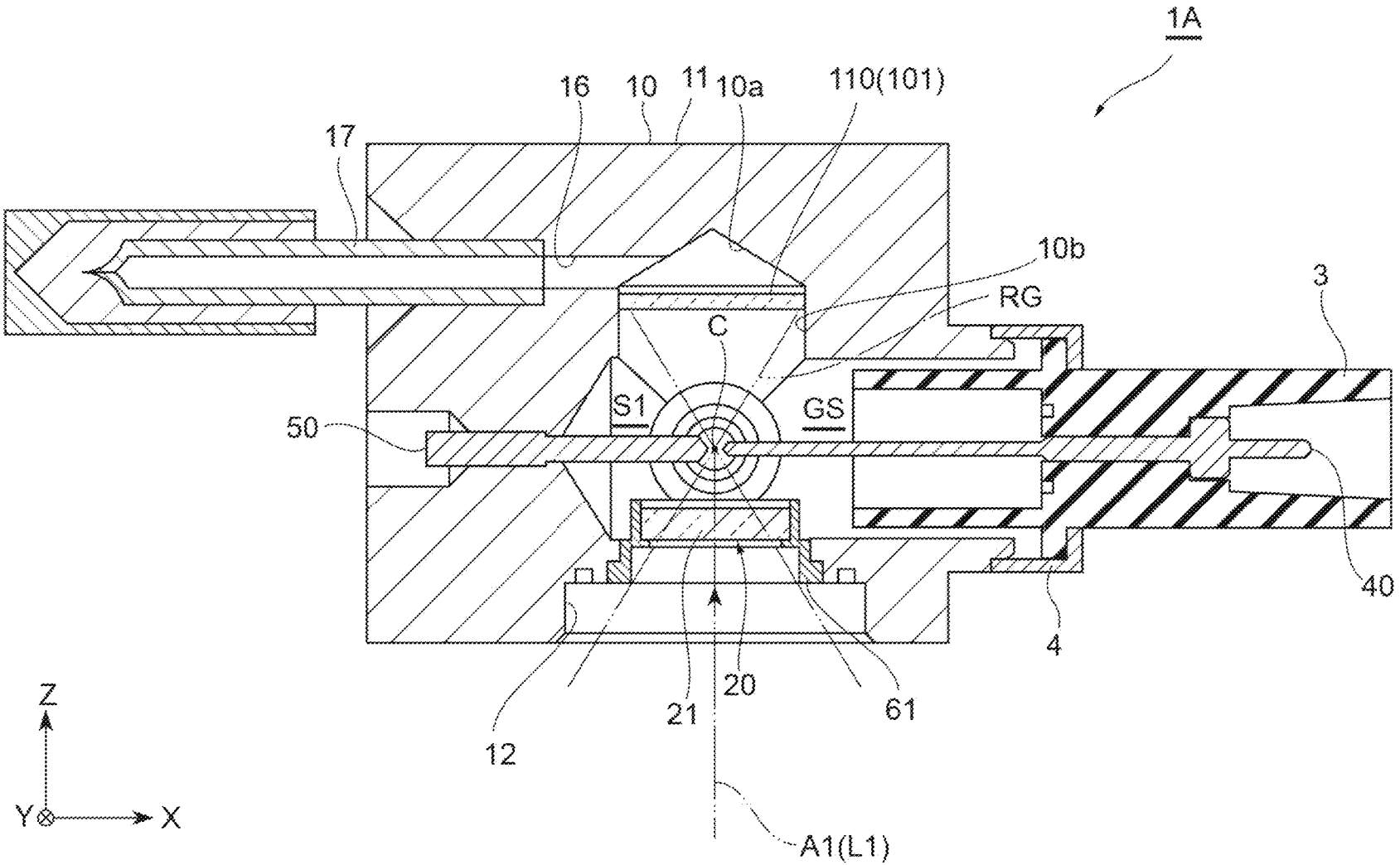
FIG. 45 is a cross-sectional view of a light emitting sealed body according to a fifth modification example.

As in a fifth modification example shown in FIG. 45, the getter material 110 may be fixed to an inner surface of the housing 10. In FIG. 45, the getter material 110 is hatched for ease of understanding. In the fifth modification example, the getter portion 101 includes only the getter material 110 and does not include the support member 120 and the like. The inner surface of the housing 10 has an inner peripheral surface 10*b* having a cylindrical shape and extending with a straight line parallel to the first optical axis A1 of the first light L1 set as a center line. The getter material 110 is fixed to the inner peripheral surface 10*b*. The getter material 110 extends along a circumferential direction to have a cylindrical shape (annular band shape) as a whole, but may have a gap (break) at a part in the circumferential direction. Also, in the fifth modification example, the getter material 110 is disposed in the irradiation region RG of the first light L1. More specifically, the getter material 110 is disposed such that a bottom edge of the first light L1 that is laser light is incident thereon, and is directly heated by irradiation with the first light L1.

Also, in the fifth modification example, similarly to the second embodiment, the occurrence of a defect caused by impure gas can be suppressed, and the life span of the light emitting sealed body 1A can be extended. In addition, the getter material 110 can be heated using the bottom edge of the first light L1 that is laser light. For this reason, the occurrence of a defect caused by impure gas can be suppressed while suppressing the excessive heating of the getter material 110.

Figure 46:
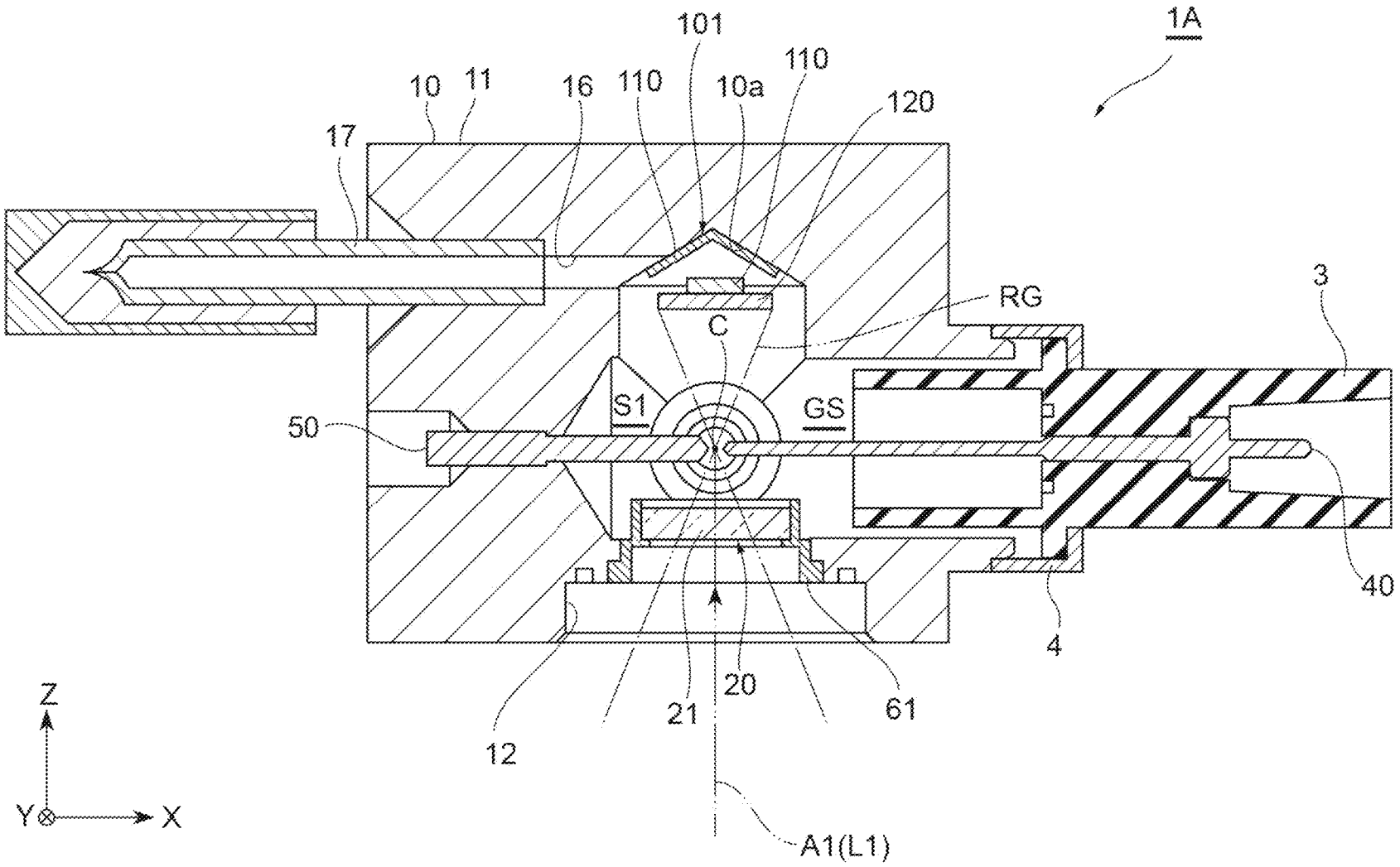
FIG. 46 is a cross-sectional view of a light emitting sealed body according to a sixth modification example.

In a sixth modification example shown in FIG. 46, the getter material 110 is configured as an evaporable (depositable) type. The getter material 110 of the evaporable type is made of, for example, a material containing barium. When the getter material 110 of the evaporable type is heated and activated, at least a part of the getter material 110 evaporates (barium is emitted). The evaporated getter material 110 is deposited on the inner surface 10*a* of the housing 10. The deposited getter material 110 forms an adsorption surface for impure gas. When the driving of the light emitting sealed body 1A is started, the getter material 110 is heated by irradiation with the first light L1 and is deposited on the inner surface 10*a*. Thereafter, a plasma is generated and a part of the first light L1 is absorbed by the plasma, so that the heating of the getter material 110 is reduced and the deposition is stopped. Since the getter material 110 is heated to form a new adsorption surface at each time of driving, the adsorption surface can be brought into good condition at each time of driving. Also, in the sixth modification example, similarly to the second embodiment, the occurrence of a defect caused by impure gas can be suppressed, and the life span of the light emitting sealed body 1A can be extended. Incidentally, the amount of the getter material 110 of the evaporable type may be determined in consideration of the degree of vacuum, the life span, or the like of the light emitting sealed body 1A, and there is no need to necessarily set such an amount that the getter material 110 is heated to form a new adsorption surface at each time of driving. For example, the amount may be set such that the getter material 110 is heated to form a new adsorption surface only during initial driving and several subsequent driving where the amount of release of impure gas considered to be particularly high. In this case, the support member 120 on which the getter material 110 is not left has an effect of shielding and protecting the getter material 110 deposited on the inner surface 10*a* of the housing 10, from the first light L1.

As another modification example, similarly to the second embodiment, the getter material 110 may be disposed in the irradiation region RG of the first light L1 or may be disposed at any position other than the above-described position. At least a part of the getter material 110 may be disposed in the irradiation region RG, for example, the support member 120 may be disposed in the irradiation region RG, whereas the getter material 110 may be disposed outside the irradiation region RG. The getter material 110 may be disposed to face the first window portion 20 side. In this case, the getter material 110 is directly heated by irradiation with the first light L1. The distance D1 from the getter material 110 to the generation position of the second light L2 may be shorter than the distance D2 from the generation position of the second light L2 to the first window portion 20. In this case, the getter material 110 can be efficiently heated by irradiation with the first light L1. In the light emitting sealed body 1A of the second embodiment, the protective layer 80 may be formed on the second window member 31. In this case, the occurrence of the opacity phenomenon can be further suppressed. The materials of the getter material 110 and the support member 120 are not limited to the above-described examples, and these components may be made of any material.

The present disclosure is not limited to the embodiments and to the modification examples. For example, the material and the shape of each configuration are not limited to the material and the shape described above, and various materials and shapes can be adopted. The shape of the first opening 12, the second opening 13, the first window member 21, and the second window member 31 is not limited to a circular plate shape and may be various shapes. In the above-described examples, the two second openings 13 are formed, but only one second opening 13 may be formed or three or more second openings 13 may be formed. As described above, the first light L1 may be incident through one opening formed in the housing 10, and the second light L2 may be emitted through the one opening. The material forming the housing 10 may not necessarily be a metal material and may be an insulating material, for example, ceramic or the like. The first electrode 40 and the second electrode 50 may be omitted. Also, in this case, a plasma can be generated at a focal point by irradiating the light-emitting gas GS with the condensed first light L1.

The first window member 21 may be made of diamond, and the second window member 31 may be made of sapphire. Alternatively, both the first window member 21 and the second window member 31 may be made of sapphire or diamond. When ultraviolet light is used, the first window member 21 and/or the second window member 31 may be made of magnesium fluoride or quartz. The first window member 21 and/or the second window member 31 may be made of Kovar glass. The first window member and the second window member may be configured to be the same window member. Namely, the first light L1 and the second light L2 may be configured to pass through the same window member. The first window member, the second window member, and the housing 10 may be integrally made of a light transmissive material. In this case, in a light-transmitting region on the housing 10, a region through which the first light L1 passes can be regarded as the first window member (first window portion), and a region through which the second light L2 passes can be regarded as the second window member (second window portion). When the first window member 21 is made of diamond, the protective layer 80 may be formed on the surface on the internal space S1 side (second major surface 21*b*) of the first window member 21. The protective layer 80 may not be formed on the second window member 31. The joining material 25 may be titanium-doped silver brazing. The second end portion 17*b* of the charging pipe 17 may not be covered with the covering member 91 and with the cap member 92. Namely, at least one of the covering member 91 and the cap member 92 may be omitted. In this specification, "A and/or B" means "at least one of A and B".

What is claimed is:

1. A light emitting sealed body comprising:

a housing containing light-emitting gas in an internal space, on which laser light for maintaining a plasma generated in the light-emitting gas is incident; and a charging pipe including a first end portion and a second end portion and connected to the internal space at the first end portion, wherein the second end portion of the charging pipe is sealed by being crushed, the second end portion of the charging pipe is covered with a covering member consisting of an inorganic material, and the covering member is covered with a cap member consisting of a metal material.

2. The light emitting sealed body according to claim 1, wherein a thermal expansion coefficient of the covering member is larger than a thermal expansion coefficient of the charging pipe.

3. The light emitting sealed body according to claim 1, wherein a hardness of the cap member is larger than a hardness of the charging pipe.

4. The light emitting sealed body according to claim 1, wherein the covering member consists of a thermoplastic material.

5. The light emitting sealed body according to claim 1, wherein the covering member consists of solder.

6. The light emitting sealed body according to claim 1, wherein the cap member is made of brass.

7. The light emitting sealed body according to claim 1, wherein a charging pressure of the light-emitting gas in the housing is 3 MPa or more.

8. A light source device comprising:

the light emitting sealed body according to claim 1; and a light introduction unit that causes the laser light to be incident on the housing.

* * * * *